US005583403A

United States Patent [19]

Anjanappa et al.

[11] Patent Number: 5,583,403

[45] Date of Patent: Dec. 10, 1996

[54] METHOD OF USING AND APPARATUS FOR USE WITH EXERCISE MACHINES TO ACHIEVE PROGRAMMABLE VARIABLE RESISTANCE

[75] Inventors: Muniswamappa Anjanappa, Columbia, Md.; Warren G. Miller, Linthicum, both of Md.

[73] Assignee: University of Maryland Baltimore Campus, Baltimore, Md.

[21] Appl. No.: 435,380

[22] Filed: May 5, 1995

Related U.S. Application Data

[62] Division of Ser. No. 266,901, Jun. 24, 1994.

[51] Int. Cl.[6] ..... A63B 21/002

[52] U.S. Cl. ..... 318/9; 482/91; 318/286; 318/471; 318/433

[58] Field of Search ..... 482/4–7, 91; 318/9–15, 318/432, 433, 280–300, 446, 466, 471–473; 388/934

[56] References Cited

U.S. PATENT DOCUMENTS

| | | | |
|---|---|---|---|
| 4,711,450 | 12/1987 | McArthur | 272/129 |
| 4,778,175 | 10/1988 | Wusherplenning | 272/129 |
| 4,909,262 | 3/1990 | Halpern | 128/774 |
| 4,930,770 | 6/1990 | Baker | 272/129 |
| 5,015,926 | 5/1991 | Casler | 318/9 |
| 5,020,795 | 6/1991 | Airy | 272/129 |
| 5,037,089 | 8/1991 | Spagnuolo | 272/134 |
| 5,050,590 | 9/1991 | Futakami | 128/25 R |
| 5,054,774 | 10/1991 | Belsito | 272/130 |
| 5,067,710 | 11/1991 | Watterson | 272/129 |
| 5,230,672 | 7/1993 | Brown | 482/4 |
| 5,243,998 | 9/1993 | Silverman | 128/782 |
| 5,244,441 | 9/1993 | Dempster | 482/9 |
| 5,256,115 | 10/1993 | Scholder | 482/6 |
| 5,407,403 | 4/1995 | Coleman | 482/6 |

*Primary Examiner*—Brian Sircus

*Attorney, Agent, or Firm*—Armstrong, Westerman, Hattori, McLeland & Naughton

[57] ABSTRACT

An exercise machine which can independently vary the force and the speed at the user end is developed. The exercise machine includes a constant torque, variable speed reversible motor, a temperature controlled magnetic particle clutch, a gear reducer, a controller, and a suitable lever mechanism. The motor, clutch and gear reducer are chosen in a combination in order to achieve a predetermined output so that any combination of isotonic, isokinetic, isometric, isotonic/isokinetic, constant, variable, active, passive, uni-directional or bi-directional exercise routines can be performed with the exercise machine. With suitable lever modifications, the resistance providing unit can be successfully modified to emulate a shoulder press, bench press, leg exercise machine, arm exercise machine, etc. The output parameters, user force and user speed, are controlled in real time to maintain accuracy. This is made possible by the use of a PC-based controller interfaced to off-the-shelf motor and clutch control boards. A user interface written in C programming language helps facilitate maintenance of user exercise records for future reference, maintains the large array of protocols and encourages direct user participation for protocol selection. The PC-based controller can also be replaced with a microcontroller-based controller to minimize the cost. The machine features three different levels of safety ensuring total user safety and minimizing any chances of mishaps.

3 Claims, 16 Drawing Sheets

| Fig. 2(a)1 | Fig. 2(a)2 |
|---|---|

Fig. 2(a)1

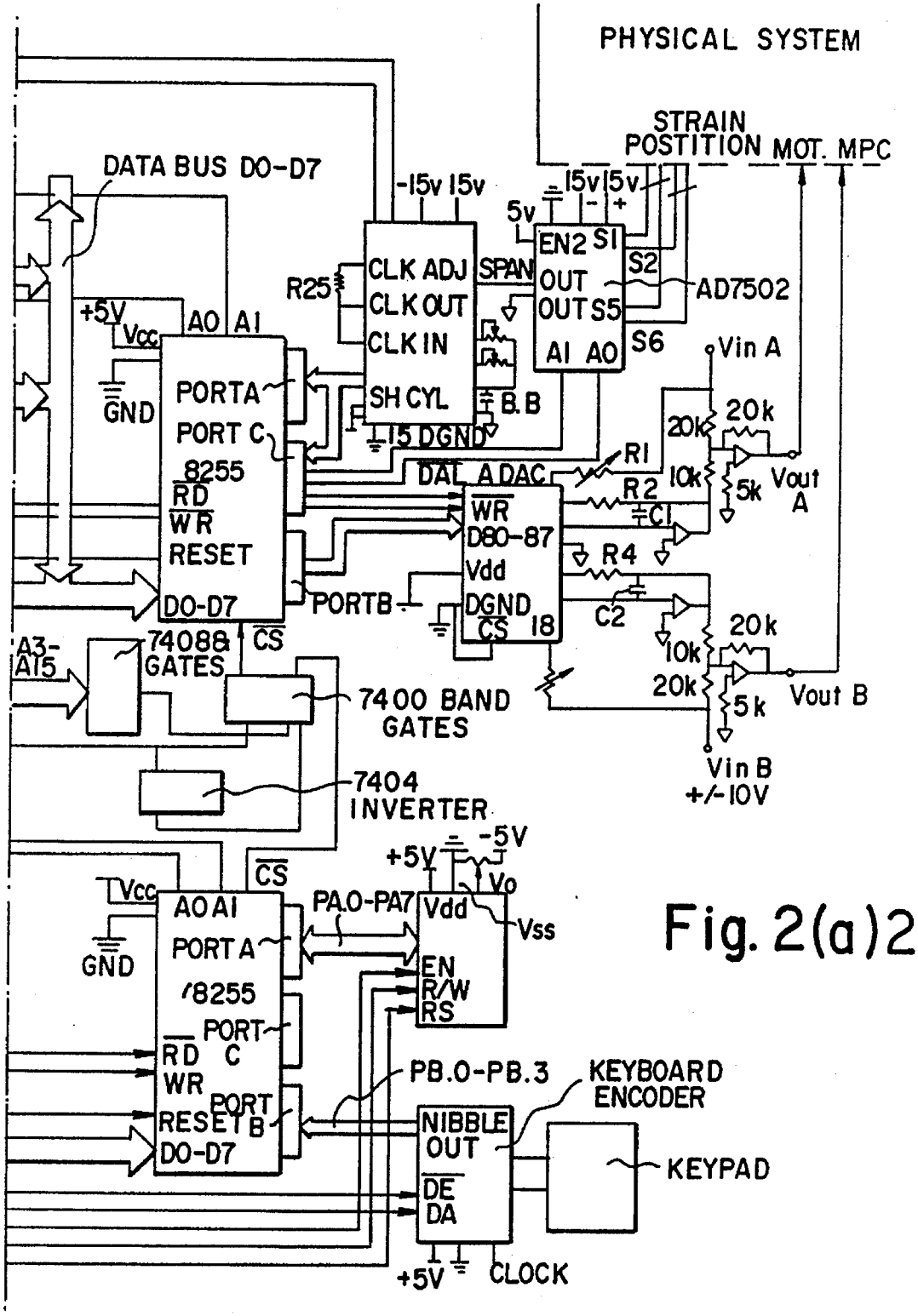
Fig. 2(a)2

Fig. 5(d)1

Fig.5(d)2
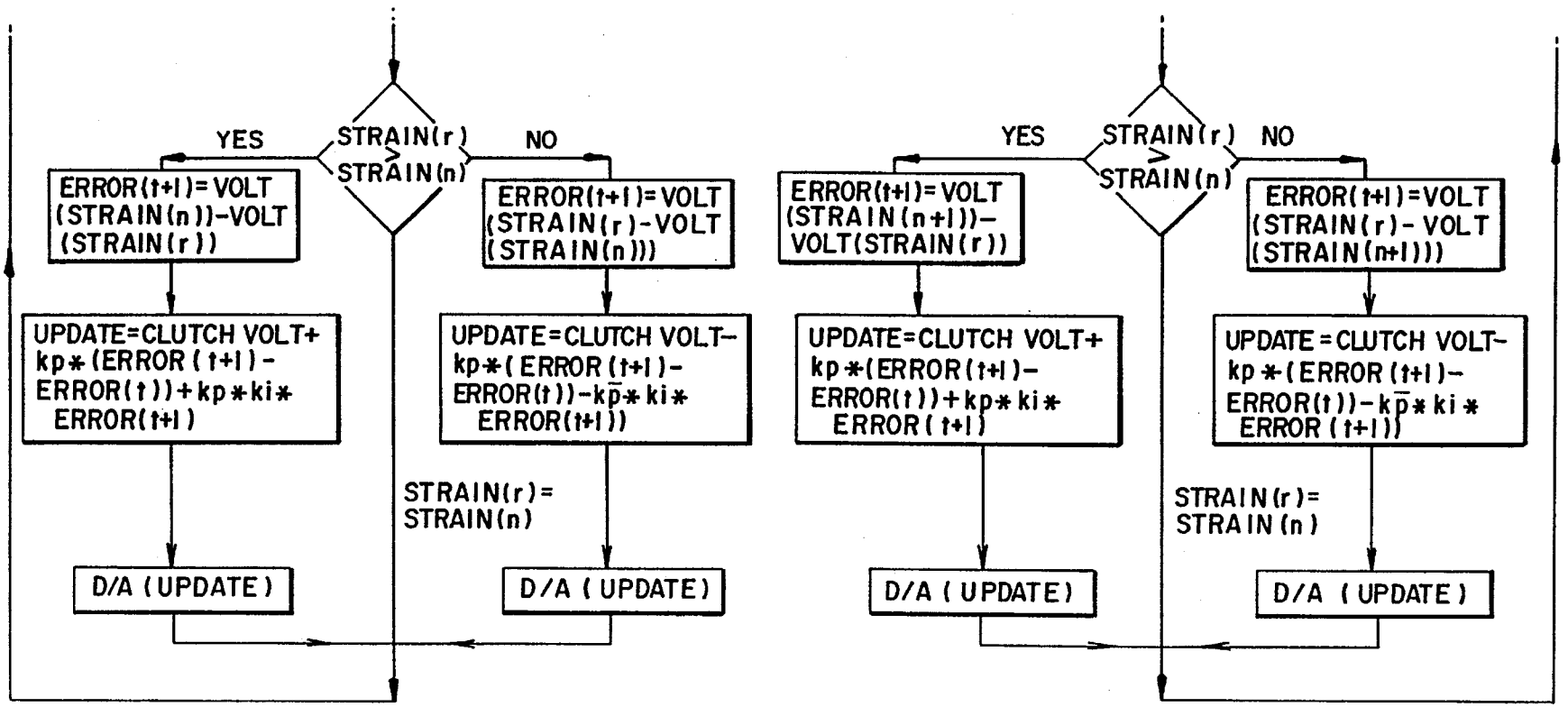

LEGEND
OM=OUTER MEMBER
IM= INNER MEMBER

METHOD OF USING AND APPARATUS FOR USE WITH EXERCISE MACHINES TO ACHIEVE PROGRAMMABLE VARIABLE RESISTANCE

This is a Divisional of application Ser. No. 08/266,901 filed Jun. 24, 1994.

FIELD OF THE INVENTION

The present invention relates generally to exercise machines and more particularly, to a method of using and an apparatus for use with an exercise machine, such as a Nautilus or Universal machine, which apparatus is attachable to the handle bars of an exercise machine via a connector, such as a lever or pulley mechanism, so that the user of the exercise machine apparatus which includes a motor, clutch and gear reducer combination can program the apparatus to achieve variable resistance in order to perform at least 21 different exercise protocols including all combinations of isotonic and isokinetic exercises with either a constant force or variable force controlled parameter and active or passive resistance unidirectionally or bi-directionally.

BACKGROUND OF THE INVENTION

Today's society is becoming increasingly health conscious. In recent years, many new industries have sprung up to promote healthy eating habits and routines of regular exercise. With respect to regular exercise, health club memberships are at an all time high and sales of fitness equipment, both commercial and at-home, are booming.

Numerous studies have been conducted to explore the benefits to the human body of a regular course of daily exercise. A recent article reports that several classic studies have indicated that people who exercise are less likely to die of cardiovascular disease, a leading cause of death in the United States, which is attributable to the fitter person having a lower body weight, lower blood pressure and a better cholesterol profile.

Although the advantages of routine exercising have been well known for many years, the advantages of weight training were first realized only in 1934 when Hoffman, an Olympic weight lifting coach, introduced the concept of weight training for athletes. Weight training is now a common practice used everywhere to train athletes.

In 1945, DeLorme discovered the benefits of weight training in physical medicine and rehabilitation. By the use of his system which utilized the concept of "heavy resistance exercise" he was able to treat a patient with knee anomalies successfully. He also showed that a few repetitions with heavy weight can build up strength and volume in muscles. Since this revelation, many new exercise machines have been developed and constant improvements to those machines are being made.

The human body receives numerous physiological benefits from a properly performed program of daily exercise. For instance, a regular routine of weight training may result in increases in muscle mass, contractile force, flexibility, blood circulation, efficient energy conversion and motor coordination. In addition, regular exercise may have psychological benefits such as an improved sense of well being.

Of course, the results achieved by the individual performing the exercise routine depends on the amount of effort put forth by the individual as well as on certain inherited and unchangeable factors such as genetic make-up, sex and age. Regardless of the human factors, however, an individual must perform a comprehensive exercise program to achieve the best results. For a comprehensive exercise program to be conducted properly, an exercise machine is needed that provides all combinations of exercise protocols, i.e., various combinations of isotonic, isokinetic, isometric or isotonic/isokinetic types of exercises with constant or variable and active or passive force in either one or two directions.

To conduct a comprehensive exercise program, the exerciser needs exercise equipment which can provide a combination of active, passive, uni- and bi-directional resistance. Active resistance is when the resistance to the muscle exists continuously and is independent of motion, whereas, passive resistance provides resistance only when there is motion. In other words, the passive resistance has zero resistance when there is no motion.

Uni-directional resistance generates force in one direction only irrespective of the direction of the user's stroke. Bi-directional resistance, on the other hand, generates force in a direction dependent on the direction of the stroke.

In addition, the exercise protocols widely used in the area of rehabilitation and physical therapy are classified based on the type of resistance a muscle undergoes. The type of change in length that a muscle undergoes determines whether the contraction is termed isometric or static, isotonic or dynamic or isokinetic.

An isometric contraction is one in which the muscle length does not change. An isotonic contraction, contrary to isometric contraction, refers to a contraction in which there is a change in the length of the muscle which undergoes movement about the joint while the resistance is kept constant. In isokinetic contraction, the limb velocity is kept constant throughout the range of motion.

Further, there are classifications on the basis of muscle contractions, namely, concentric or positive and eccentric or negative. The concentric contraction is the controlled shortening of a muscle. The eccentric contraction is the controlled lengthening of a muscle.

To achieve a biomechanically correct conditioning effect, the user of the exercise machine needs a machine that can provide variable resistance in combination with active or passive force and uni- or bi-directional resistance in order to accommodate the varying mechanical leverage of the arms or legs. Furthermore, because a concentric contraction requires four times more oxygen than does an eccentric contraction, the eccentric contraction can assume a larger load and thus, should be loaded with a force greater than that of the eccentric contraction.

In the performance of a complete cycle, power is absorbed during the negative stroke and is generated in the positive stroke. Thus, ideal speed during the negative stroke should be such as to ascertain minimum absorption of power. This refers to zero speed during the negative stroke. However, the exercise should be kept dynamic and therefore, the speed in the negative stroke should be kept as low as possible.

Thus, it would be desirable to incorporate variable resistance producing capabilities into exercise machines, however, to date there are no exercise machines commercially available that have variable resistance in order to accommodate a wide a range of possible exercise protocols.

While exercise is important, exercising correctly is even more important. The term exercising correctly is defined based on the use's age, sex, type of effect desired, the muscle to be exercised, presence of any injury, and other physical features. However, an exerciser of any age or physical condition would benefit from a single exercise machine which could provide: both active and passive, variable resistance as a function of stroke-position; both uni- and bi-directional resistance, i.e., push and pull; a custom programmable resistance profile which is dependent on stroke length; real-time feedback of performance indicators such as work load and calorie spent, etc.; and a low cost, compact, safe and reliable system.

A total of 21 exercise protocols exist which cover all the known combinations of isotonic, isokinetic, isometric and isotonic/isokinetic types of exercises with either a constant force or variable force controlled parameter, an active or passive type of force in a uni-directional or bi-directional direction as shown in Table 1 .

TABLE 1

| Type of Exercise | Controlled Parameter | Type of Force | Direction | Protocol # |
|---|---|---|---|---|
| Isotonic | Constant Force | Active | Uni | 1 |
| | | | Bi | 2 |
| | | Passive | Uni | 3 |
| | | | Bi | 4 |
| | Variable Force | Active | Uni | 5 |
| | | | Bi | 6 |
| | | Passive | Uni | 7 |
| | | | Bi | 8 |
| Isokinetic | Constant Force | Active | Unit | 9 |
| | | | Bi | 10 |
| | | Passive | Uni | 11 |
| | | | Bi | 12 |
| | Variable Force | Active | Uni | 13 |
| | | | Bi | 14 |
| | | Passive | Uni | 15 |
| | | | Bi | 16 |
| Isometric | Constant Force | Active | Uni | 17 |
| Isotonic/Isokinetic | Constant Force/Constant Velocity | Active | Uni | 18 |
| | | | Bi | 19 |
| | | Passive | Uni | 20 |
| | | | BI | 21 |

It would be desirable for a single exercise machine to be capable of accommodating all of these 21 exercise protocols. Presently, there is no single, multipurpose exercise machine that is capable of performing all the 21 exercise protocols. Prior art devices, such as taught in U.S. Pat. Nos. 4,930,770 to Baker and 5,015,926 to Casler, are incapable of providing all combinations of isotonic, isokinetic, isometric, or isotonic/isokinetic types of exercises with constant or variable force and active or passive resistance in a uni-directional or bi-directional direction. In particular, a user of the exercise machine taught in either U.S. Pat. No. 4,930,770 to Baker or U.S. Pat. No. 5,015,926 to Casler can only perform exercise protocols in the combination of isotonic, isokinetic, or isotonic/isokinetic exercise protocols with constant and active force in a one direction.

The Casler device uses a constant speed, high torque motor which is mechanically coupled to a dynamic clutch drive. The controlled coupling of the rotary force input to the rotary output is accomplished in the clutch assembly via electromagnetic coil activation of metallic powder particles forming coupling particle chains between the input and the output assemblies. The machine also includes a speed reduction device between the input and the output assemblies and a speed reduction device between the dynamic clutch and the exercise machine. An electric sensor is used to sense speed, motion and torque force of the system output shaft. The sensed information is used to control the coupling torque of the dynamic clutch through a control unit connected to the drive motor and electromagnetic coil of the dynamic clutch which in turn is directed by a microprocessor.

The Baker device is a processor-controlled eccentrically loaded exercise machine. A variable torque motor provides a torque to a magnetic particle torque coupler. The torque coupler is coupled to the user interface device through a gear reducer and a chain and sprocket arrangement. A position sensor and a load cell coupled to the user interface device provide position and force signal to the processor. The processor is capable of providing resisting and powering force which can be varied by position by controlling the motor torque and the torque coupling of the coupler.

Although the Casler and Baker devices are schematically similar to the apparatus of the present invention, the present invention has several features that are distinct from either the Casler or Baker devices. First, Casler uses a constant speed, high torque motor while the apparatus of the present invention uses a reversible, constant torque, variable speed motor. The reversible, constant torque, variable speed motor of the present invention provides more capabilities to an exercise machine to which the apparatus of the present invention is attached. For instance, the constant torque, variable speed motor of the present invention allows an exercise machine to achieve resistance in both a uni-axial direction and a bi-axial direction which is not possible with the Casler device.

Second, Casler's device uses an off-the-shelf magnetic clutch whereas the apparatus of the present invention uses a magnetic particle clutch that has been modified to incorporate a temperature sensor or thermocouple. The incorporation of a temperature sensor or thermocouple into the magnetic particle clutch allows the apparatus of the present invention to be capable of more different exercise protocols with the same efficiency.

Third, the Casler device has a microprocessor-based controller, while the apparatus of the present invention incorporates a microcontroller-based controller which uses a custom developed software that gives the apparatus of the present invention more versatility.

Finally, the Baker device uses a variable torque motor and a standard, unmodified clutch combination which is identical in its capabilities to the Casler device. Thus, Casler and Baker are both capable of accommodating only a certain limited number of exercise protocols, unlike the apparatus of the present invention which is capable of providing all of the 21 protocols shown in Table 1.

With either the Baker or Casler devices, the user could not perform any isometric exercise protocols nor any of the isotonic or isokinetic in combination with any of the following: constant and active force in two directions; constant and passive force in one or two directions; variable and active force in one or two directions; or, variable and passive force in one or two directions.

Furthermore, the user would not be able to perform isotonic/isokinetic exercises with constant force and constant velocity in combination with active, bi-directional resistance nor passive, uni- or bi-directional resistance.

An ideal exercising machine would provide: 1. both active and passive, variable resistance as a function of stroke position; 2. both uni and bi-directional resistance, i.e., push and pull; 3. a custom programmable resistance profile which is stroke length dependent; 4. real-time feedback of performance indicators, e.g., work load or calorie spent; and 5. an apparatus with programmable, variable resistance which is low in cost, compact, safe and reliable.

Most of today's conventional exercise machines can be classified as shown in Table 2, based on the type of device to provide the resistance.

TABLE 2

| Type of Resistance in Exercising Machine | | | |
|---|---|---|---|
| Type of exercise machine | Type | Direction | Magnitude |
| Weight-based | Active | Uni-direction | Constant |
| Cam/spring-based | Active | Uni-direction | Variable |
| Hydraulic/pneumatic-based | Passive | Bi-direction | Constant |
| Magnetic brake-based | Passive | Bi-direction | Variable |
| Cybex | Passive | Bi-direction | Variable |
| Kincom | Active, passive | Uni-direction | Variable |
| Proposed electromechanical device | Active, Passive | Uni, bi-direction | Variable |

Weight-based exercise machines satisfy the second requirement of an ideal machine only partially because, as a recent article reports, the inertia causes large fluctuations in the actual resistance as the weight changes speed and direction during the exercise stroke. Thus, weight-based exercise may result in muscles being loaded unevenly since there is no control over the resistance profile.

Cam/spring-based exercise machines are improved versions of weight-based machines since they provide variable resistance with a fixed resistance profile which depends on the cam. However, the cam/spring-based machines only partially satisfy the first, second and third requirements of an ideal machine.

Hydraulic/pneumatic-based exercise machines are passive since the resistance is achieved by forcing a liquid through an orifice. These types of machines provide no resistance when there is no motion and thus, only partially satisfy the second requirement of an ideal machine. While many of the hydraulic/pneumatic machines come with a microprocessor-based monitoring system to satisfy the fourth requirement of an ideal machine, they do not satisfy the fifth requirement of an ideal machine because they incur more than average attendant and maintenance costs.

A pneumatically actuated exercise system which varies the force depending upon the unique force capabilities of the exercising individual has been developed. However, because this system is pneumatically actuated, it suffers from the same inherent drawbacks as the hydraulic/pneumatic machines.

Cybex, a division of Lumex, Inc., has an exercise machine system which uses a dynamometer to obtain the desired force and has an extensive on-line control. The Cybex system has a non-powered mode which allows isokinetic concentric/concentric activity and it accommodates a user's force capability by requiring the user to initiate all movement. Since the clutch disconnects the user from the unit's motor, the Cybex system allows free limb acceleration. The powered mode allows both concentric and eccentric activity as well as continuous passive motion.

However, the Cybex system has certain drawbacks. First, due to the use of the dynamometer, the Cybex system generates force only when there is some motion provided by the user. In other words, it cannot provide active resistance. The Cybex system also is disadvantageous because of its high cost which limits its use to clinical or institutional applications.

The Kincom exercise machine system is used mainly in rehabilitation centers and provides both active and passive resistance. The Kincom system is more versatile than other machines on the market but it still cannot perform all of the at least 21 protocols which the apparatus of the present invention can perform.

Universal Gym Equipment Inc. of Cedar Rapids, Iowa has developed a leg extension machine which is a step forward from the hydraulic/pneumatic systems. The slip torque of a magnetic particle brake is controlled by manipulating the current supplied to the electromagnetic coil that energizes the brake. Although this machine satisfies most of the requirements of an ideal machine, it lacks one important requirement. If such a magnetic brake is used for a bench press machine with this system, the user has to push-up the handle bar and in the reverse direction has to pull-down the bar which is totally different from weight-based bench presses where it is push-up and push-down. This push-up/push-down motion is one of the essential components to receive a biomechanically correct conditioning effect. Hence, Universal's magnetic particle brake device cannot give a multi-purpose exercise machine a biomechanically correct conditioning effect such as is accomplished by the apparatus of the present invention.

It is an object of the present invention to provide a single, multi-purpose exercise machine capable of performing at least 21 possible combinations of isotonic, isokinetic, isometric, or isotonic/isokinetic types of exercise with constant or variable force, active or passive resistance in either one or two directions.

A further object of the present invention is to provide a high performance, microcontroller-based "smart" exercise machine using a magnetic particle clutch to provide the active, passive, uni-, and bi-directional, programmable, variable resistance.

A further object of the present invention is to provide a multi-purpose machine having numerous exercising capabilities, namely, active, passive, uni-, and bi-directional, variable resistance, with custom programmable resistance profile and stroke length to suit a particular individual by providing real-time feedback of work load, progress, and various other performance indicators for monitoring and evaluating the individual's progress.

A further object of the present invention is to provide a low cost, safe, compact, and highly reliable exercising machine.

A further object of the present invention is to replace several existing exercise machines with one compact, multipurpose machine, in place of the traditional weight stack.

SUMMARY OF THE INVENTION

The present invention provides a method of using an apparatus for use with an exercise machine to provide a programmable, variably resistant device to the user of the exercise machine to which the apparatus is connected. The apparatus includes a variable speed, constant torque force creation device, a plurality of sensing units, a microcontroller-based controller, a magnetic particle clutch and gear reduction unit. The force creation device, the magnetic particle clutch and the gear reduction unit are chosen in combination to achieve a predetermined output in order for a user of the exercise machine to be able to perform any and all of 21 exercise protocols, including isotonic, isokinetic or isometric exercise, constant or variable resistance, active or passive force, in a uni-directional or bi-directional direction as shown in Table 3.

TABLE 3

| Type of Exercise | Controlled Parameter | Type of Force | Direction | # | Weight-based | Cam-based | Hydraulic or Magnetic brake based | Cybex | Casler Baker | Kincom | "Smart" Exercising Machine |
|---|---|---|---|---|---|---|---|---|---|---|---|
| Isotonic | Constant Force | Active | Uni | 1 | X | X | | X | X | X | X |
| | | | Bi | 2 | | | | | | | X |
| | | Passive | Uni | 3 | | | | | | X | X |
| | | | Bi | 4 | | | X | X | | | X |
| | Variable Force | Active | Uni | 5 | | X | | | X | X | X |
| | | | Bi | 6 | | | | | | | X |
| | | Passive | Uni | 7 | | | | | | X | X |
| | | | Bi | 8 | | | X | X | | | X |
| Isokinetic | Constant Force | Active | Uni | 9 | | | | | X | X | X |
| | | | Bi | 10. | | | | | | | X |
| | | Passive | Uni | 11 | | | | | | X | X |
| | | | Bi | 12 | | | X | X | | | X |
| | Variable Force | Active | Uni | 13 | | | | | X | X | X |
| | | | Bi | 14 | | | | | | | X |
| | | Passive | Uni | 15 | | | | | | X | X |
| | | | Bi | 16 | | | X | X | | | X |
| Isometric | Constant Force | Active | Uni | 17 | X | X | | | | | X |
| Isotonic/ Isokinetic | Constant force/ constant velocity | Active | Uni | 18 | | | | | X | | X |
| | | | Bi | 19 | | | | | | | X |
| | | Passive | Uni | 20 | | | | | | | X |
| | | | BI | 21 | | | | | | | X |

BRIEF DESCRIPTION OF THE DRAWING FIGURES

FIG. 1(*b*) is a block diagram of the apparatus for use with an exercise machine showing details of the microcontroller-based controller.

FIG. 2(*b*) is a block diagram showing the circuit diagram of the controller.

FIG. 2(*c*) is a block diagram showing the circuit diagram of the relays for emergency stop and motor.

FIG. 5(*b*) is a flow chart of the isotonic protocol.

FIG. 5(*c*) is a flow chart of the isokinetic protocol.

FIG. 5(*d*) is a flow chart of the 'variable force' protocol.

FIG. 6(*b*) is a control block diagram showing isotonic exercise using a constant force controlled parameter and passive resistance.

FIG. 6(*c*) is a control block diagram showing isotonic exercise using a variable force controlled parameter and active resistance.

FIG. 6(*d*) is a control block diagram showing isokinetic exercise using a constant force controlled parameter and active resistance.

FIG. 7(*b*) is a schematic of a front view of the magnetic field in a magnetic particle clutch.

FIG. 7(*c*) is a schematic of two magnetic particles in motion and the magnetic force between them in a magnetic particle clutch.

DETAILED DESCRIPTION OF THE INVENTION

Figure 1A:
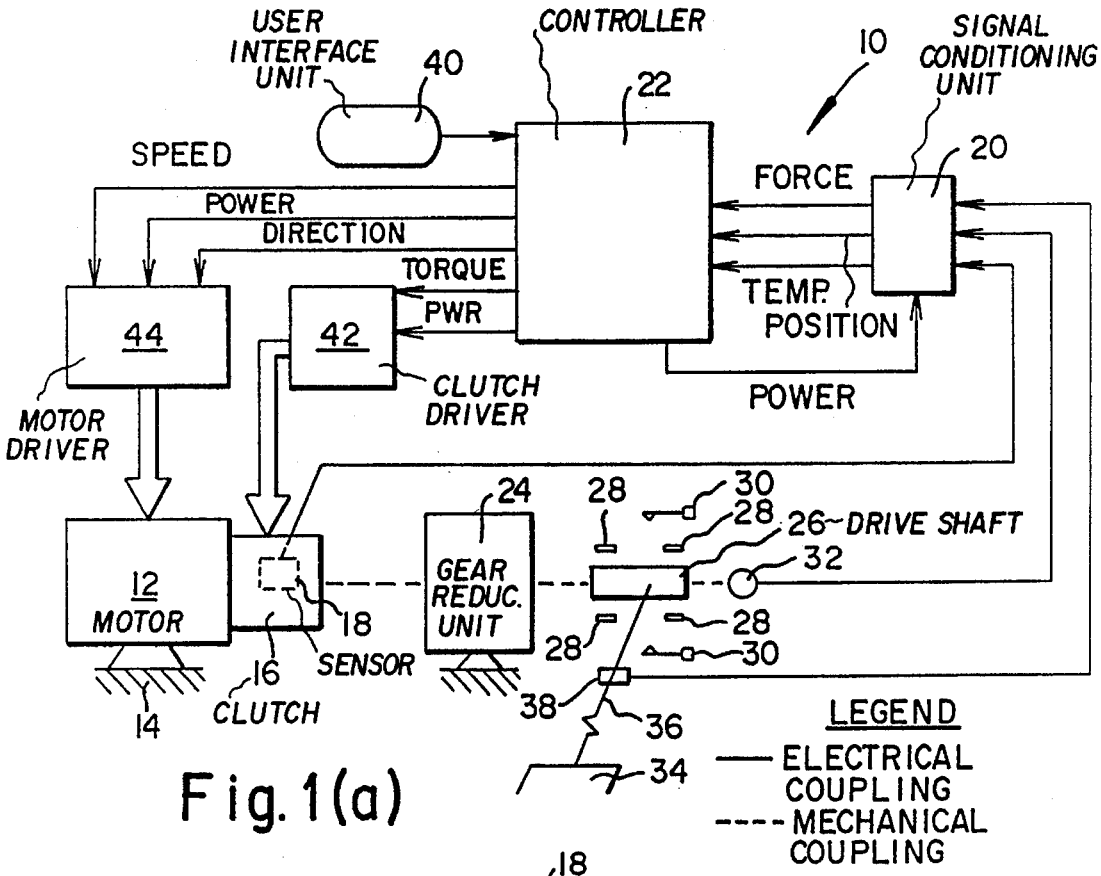
FIG. 1(*a*) is a schematic view of the apparatus for use with an exercise machine to achieve programmable variable resistance.
Figure 1B:
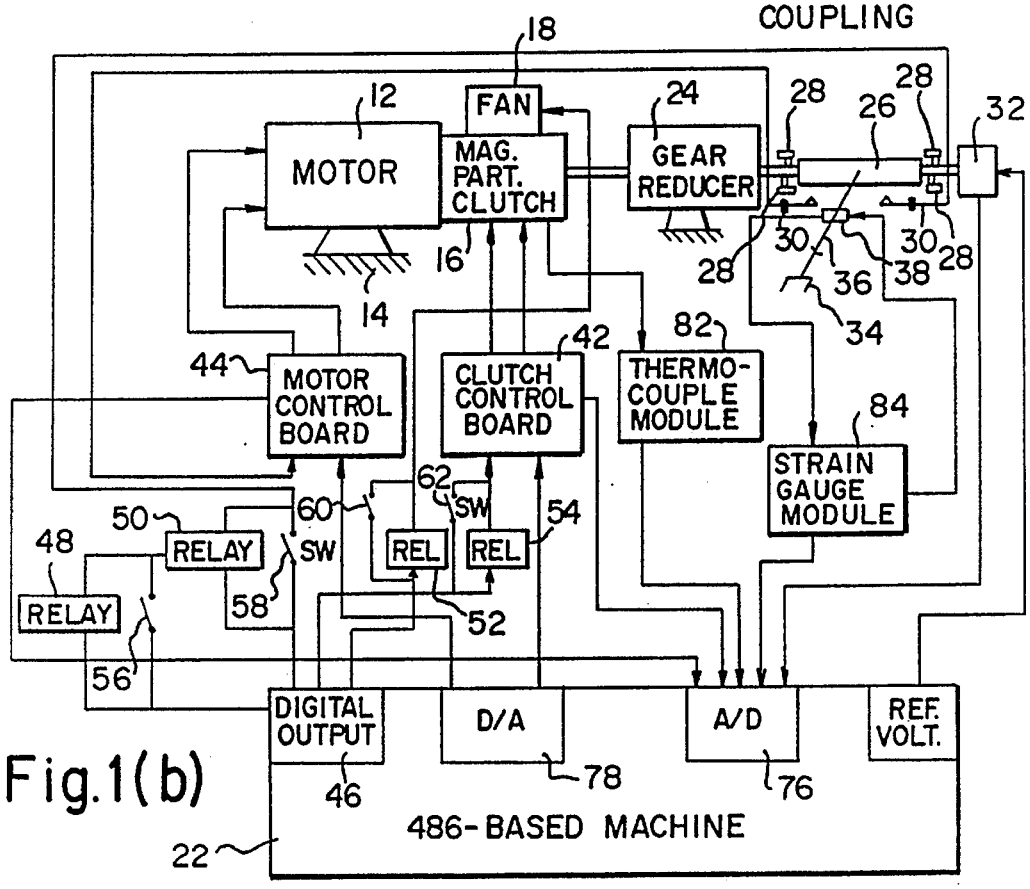

FIGS. 1(*a*) and 1(*b*) schematically depict the apparatus for use with exercise machines to achieve programmable variable resistance of the present invention. Referring to FIG.

1(*a*), the apparatus 10 for use with an exercise machine is shown as including a reversible, variable speed, constant torque motor 12. The reversible, variable speed, constant torque motor 12 is reversible in the direction of rotation and is fixedly mounted on a support frame 14.

A magnetic particle clutch or MPC 16 is shown as being attached to the side of the reversible, variable speed, constant torque motor 12 in the preferred embodiment of the invention. However, the magnetic particle clutch or MPC 16 may be positioned with respect to the motor 12 in any manner which allows the motor 12 and clutch 16 to work together cooperatively.

The magnetic particle clutch or MPC 16 may be an off-the-shelf model but is preferably then modified to include a thermocouple or temperature sensor 18. The thermocouple or temperature sensor 18 is important to the efficient operation of the apparatus 10. This is because the thermocouple or temperature sensor 18 senses temperature information from the magnetic particle clutch or MPC 16, which information is sent electronically first to the signal conditioning unit or SCU 20 and then to the microcontroller-based controller 22. The microcontroller-based controller 22 uses the temperature information from the thermocouple or temperature sensor 18 to detect the amount of heat being generated inside the magnetic particle clutch or MPC 16. When the amount of heat generated inside the magnetic particle clutch or MPC 16 is too great, the magnetic particle clutch or MPC 16 will be shut down or disengaged in order to maintain its efficiency and safe operation.

The magnetic particle clutch or MPC 16 is mechanically coupled to a gear reduction unit 24 by means of a drive shaft 26. A magnetic particle clutch or MPC 16 is used in the preferred embodiment of the present invention, for among other reasons, because: 1. the transmitted torque of a magnetic particle clutch or MPC 16 is independent of speed; 2. the driven shaft 26 of a magnetic particle clutch or MPC 16 slips smoothly without clogging, pulsating and excessive heat dissipation when applied torque exceeds the driving torque; 3. a magnetic particle clutch or MPC 16 has no contaminating wear products due to the absence of mechanical friction; 4. a magnetic particle clutch or MPC 16 has a compact design which is in part due to the temperature monitoring capability of the attached thermocouple or temperature sensor 18; 5. a magnetic particle clutch or MPC 16 is readily interfacable to computer control; and 6. the operation of a magnetic particle clutch or MPC 16 is smooth, clean, silent, and reliable.

The gear reduction unit 24 is mechanically coupled to a drive shaft 26 and is fixedly mounted to the support frame 14. The drive shaft 26 is surrounded by four roller bearings 28 and two adjustable limit switches 30. The drive shaft 26 is mechanically coupled to a position sensor 32 for sensing position information of the handle bars 34 of the exercise machine to which the drive shaft is connected via a connector 36. The connector 36 can either be a lever mechanism or alternatively, a combination pulley and drum mechanism.

The position sensor 32 is electrically coupled to the signal conditioning unit or SCU 20. As previously discussed, the signal conditioning unit or SCU 20 also receives electric signals from the thermocouple or temperature sensor 18 of the magnetic particle clutch or MPC 16. Additionally, the signal conditioning unit or SCU 20 also receives force information in the form of electronic signals from a force sensor 38. The force sensor 38 senses the amount of force the user of the exercise machine places on the connector 36 through the handle bars 34 of the exercise machine.

The signal conditioning unit or SCU 20 is electrically coupled to the microcontroller-based controller 22. The microcontroller-based controller 22 supplies power to the signal conditioning unit or SCU 20. The signal conditioning unit or SCU 20 takes the messages it receives from the thermocouple or temperature sensor 18 the position sensor 32 and the force sensor 38 and sends the temperature, position and force data, respectively, to the microcontroller-based controller 22.

The microcontroller-based controller 22 processes the temperature, position and force data and in combination with an user interface unit 40 calculates torque and power information. This torque and power information is then sent to a clutch driver 42. The microcontroller-based controller 22 also uses the temperature, position and force data from the signal conditioning unit or SCU 20 to calculate speed or velocity (V), power and direction information which is sent to the motor driver 44. The torque and power information sent to the clutch driver 42 is used to drive the magnetic particle clutch or MPC 16. The speed or velocity (V), power and direction information sent to the motor driver 44 is used to drive the reversible, variable speed, constant torque motor 12.

Referring to FIG. 1(*b*), a block diagram of the preferred embodiment of the apparatus 10 of the present invention for use with an exercise machine to achieve programmable variable resistance is shown. FIG. 1(*b*) is a more detailed version of FIG. 1(*a*) in that it shows the details of the microcontroller-based controller 22 and the various relays and switches necessary to operate the system. The digital output 46 outputs digital commands to operate relays 48, 50, 52 and 54. The relays, in turn, are coupled in parallel to manual override switches 56, 58, 60 and 62.

Figure 2A:
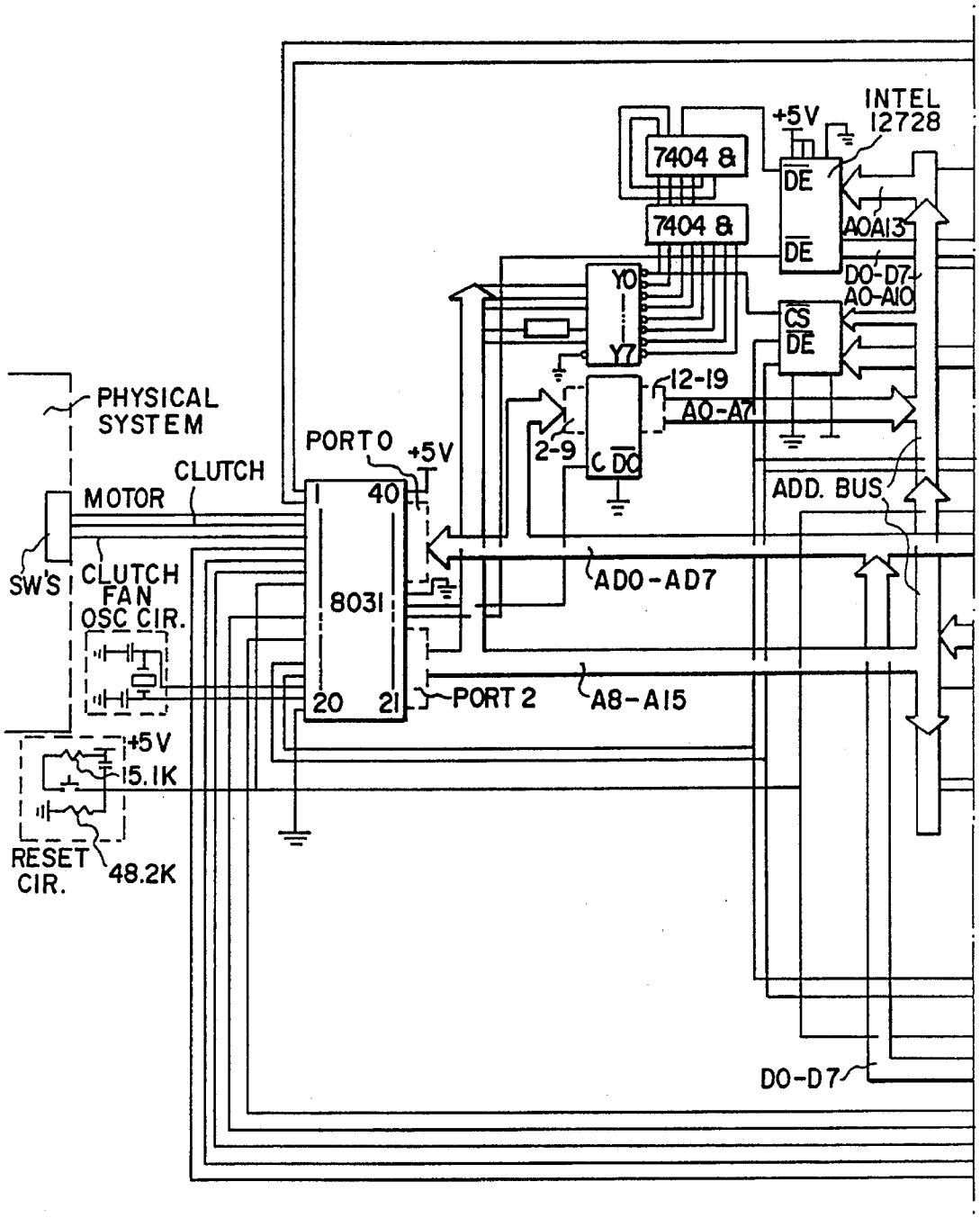
FIG. 2(*a*) is a block diagram showing the hardware configuration of the microcontroller-based controller.
Figure 2B:
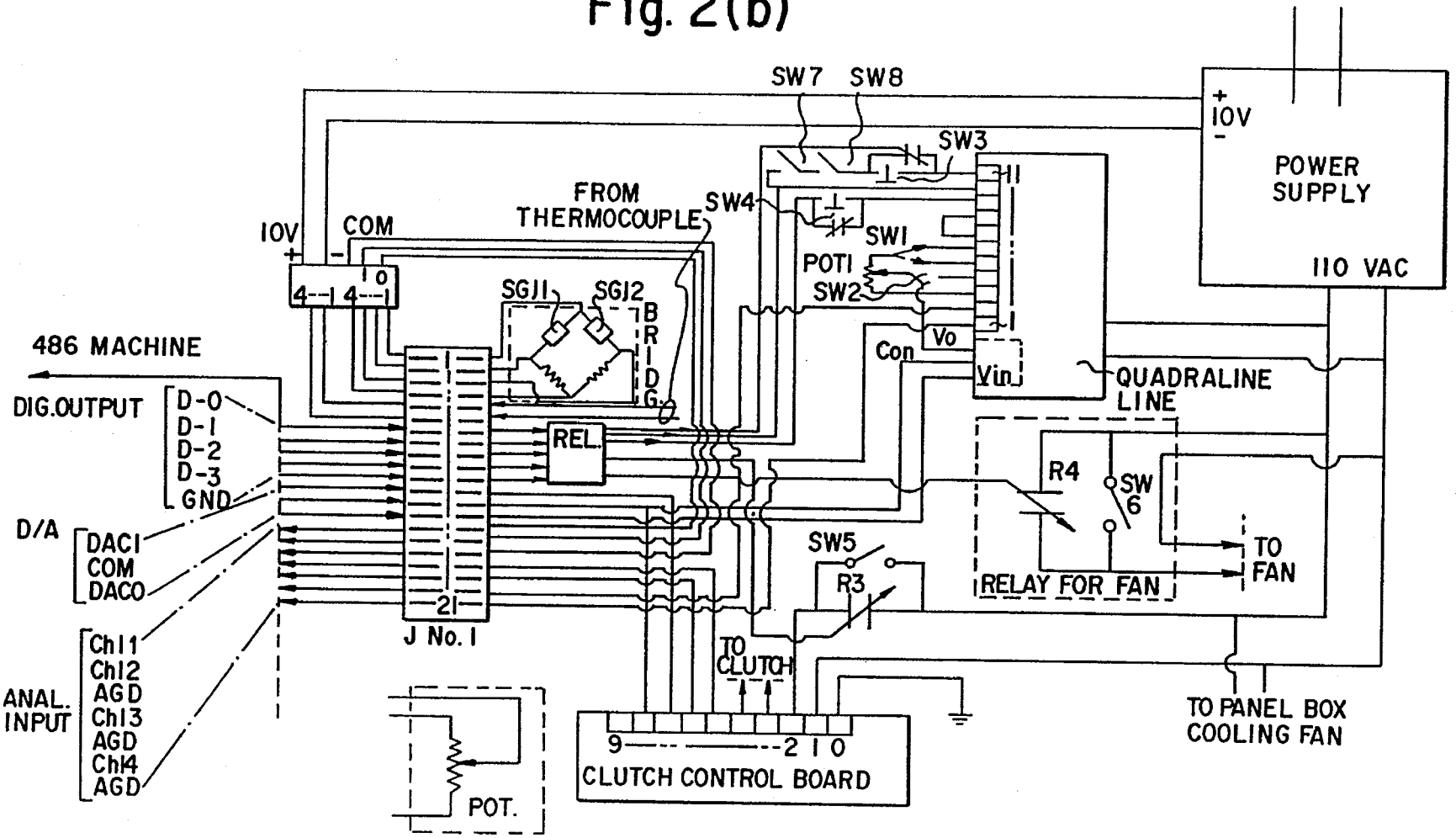
Figure 2C:
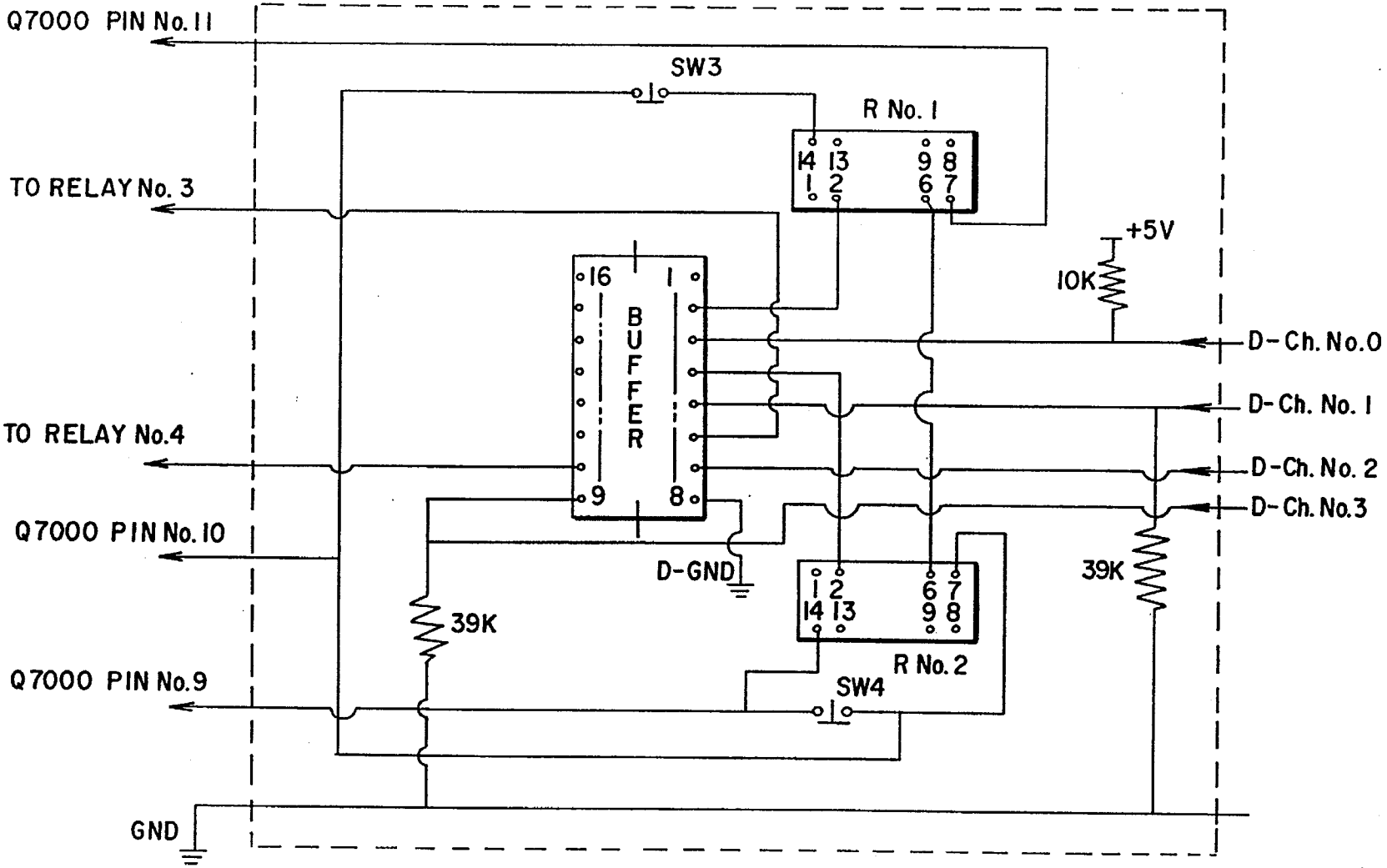

Referring to FIGS. 2(*a*), (*b*) and (*c*), diagrams of the mechanical and electrical systems of the microcontroller-based controller 22 are shown. FIG. 2(*a*) shows a diagram of the hardware configuration of the microcontroller-based controller 22. FIG. 2(*b*) shows the circuit diagram of the controller 22. FIG. 2(*c*) shows the circuit diagram of the relays 48, 50, 52 and 54 for the emergency stop and motor of the microcontroller-based controller 22.

Figure 3:
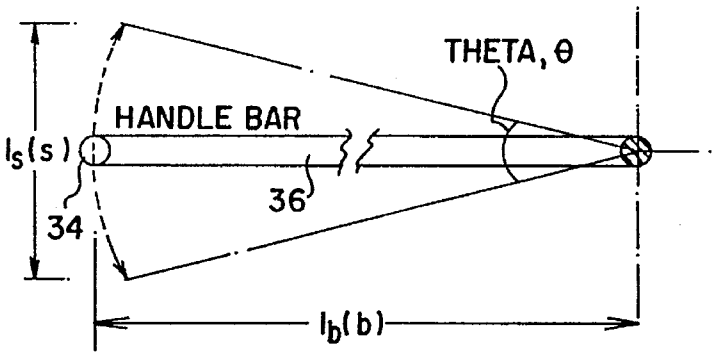
FIG. 3 is a schematic view of the handle bar of the exercise machine which the apparatus of the present invention is connected to via a connector.

Referring to FIG. 3, the schematic depicts the handle bars 34 of an exercise machine and the connector 36 which connects the handle bars 34 to the apparatus 10. The handle bars 34 are mechanically coupled to the drive shaft 26 via the connector 36, which in the preferred embodiment of the invention as shown in FIG. 3 is a lever mechanism. However, the connector 36 could also be a drum and pulley mechanism. The handle bars 34 are rotatable through an angle θhave a lever length of $1_b$(b) and a length through which the handle bars rotate of $1_s$(s).

Figure 4:
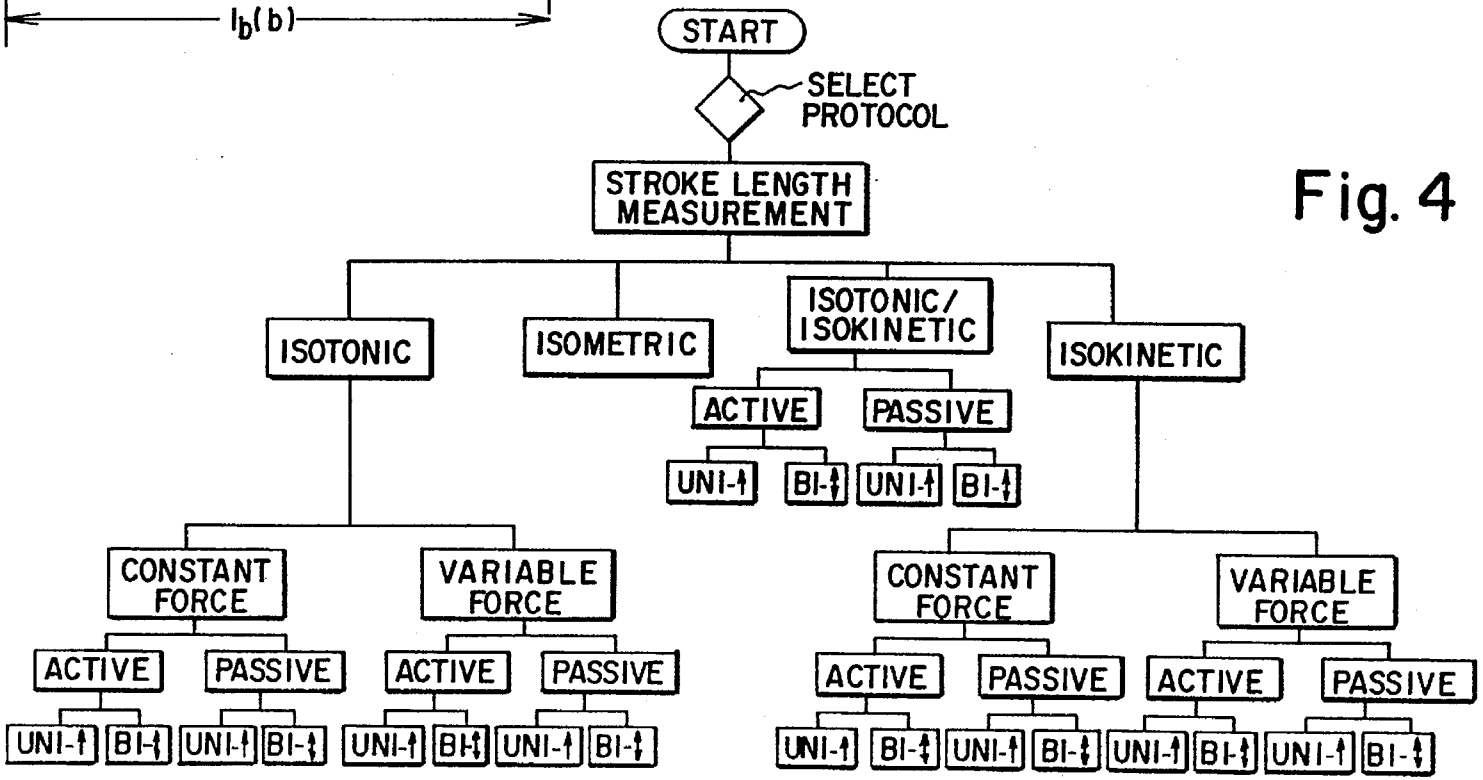
FIG. 4 is a flow chart of the system algorithm.

Referring to FIG. 4, a flow chart of the system algorithm is shown. FIG. 4 shows the algorithm for the entire system capable of performing all twenty-one protocols. The system algorithm begins with a user selecting the start button of the controller 22. After depressing the start button, the user is sent to a decision diamond where he/she must decide what type of exercise protocol to select, either isotonic, isometric, isokinetic or isotonic/isokinetic. In addition to the protocol selected, the user must enter the stroke length measurement $1_s$(s) appropriate to the particular user.

With these two bits of information entered to the controller 22, the user of the isotonic or isokinetic protocol must decide whether to select constant or variable force. Having chosen either constant or variable force, the user then must choose active or passive resistance in a uni- or bi-lateral direction.

A user who decides on either an isotonic/isokinetic or isometric protocol has fewer decisions that need to be made. Indeed, a user of an isotonic/isokinetic protocol need only make a choice between active or passive resistance in a uni-or bi-lateral direction and a user of an isometric protocol need make only the decision to choose the isometric protocol.

Figure 5A:
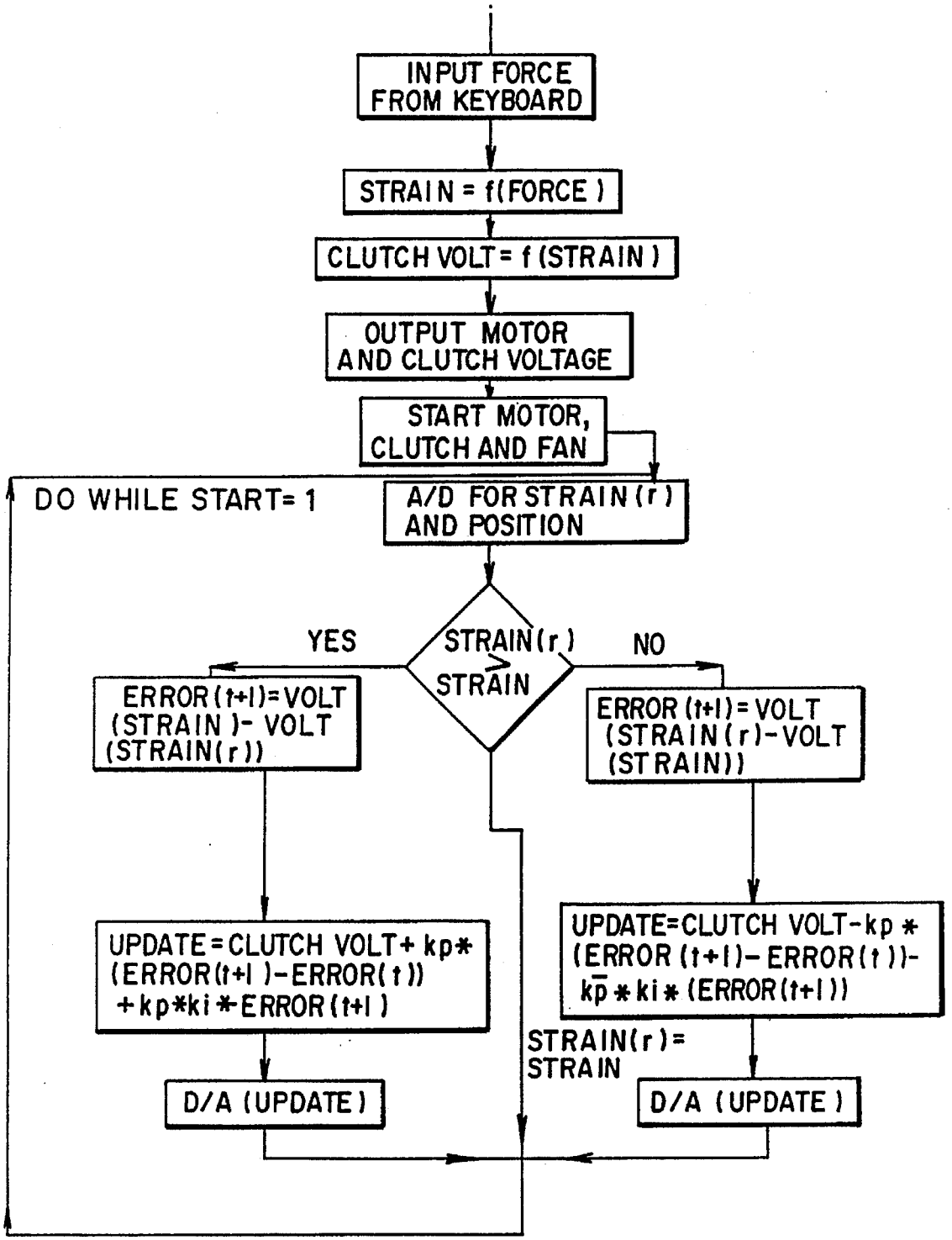
FIG. 5(*a*) is a flow chart of the 'isotonic force' module.
Figure 5B:
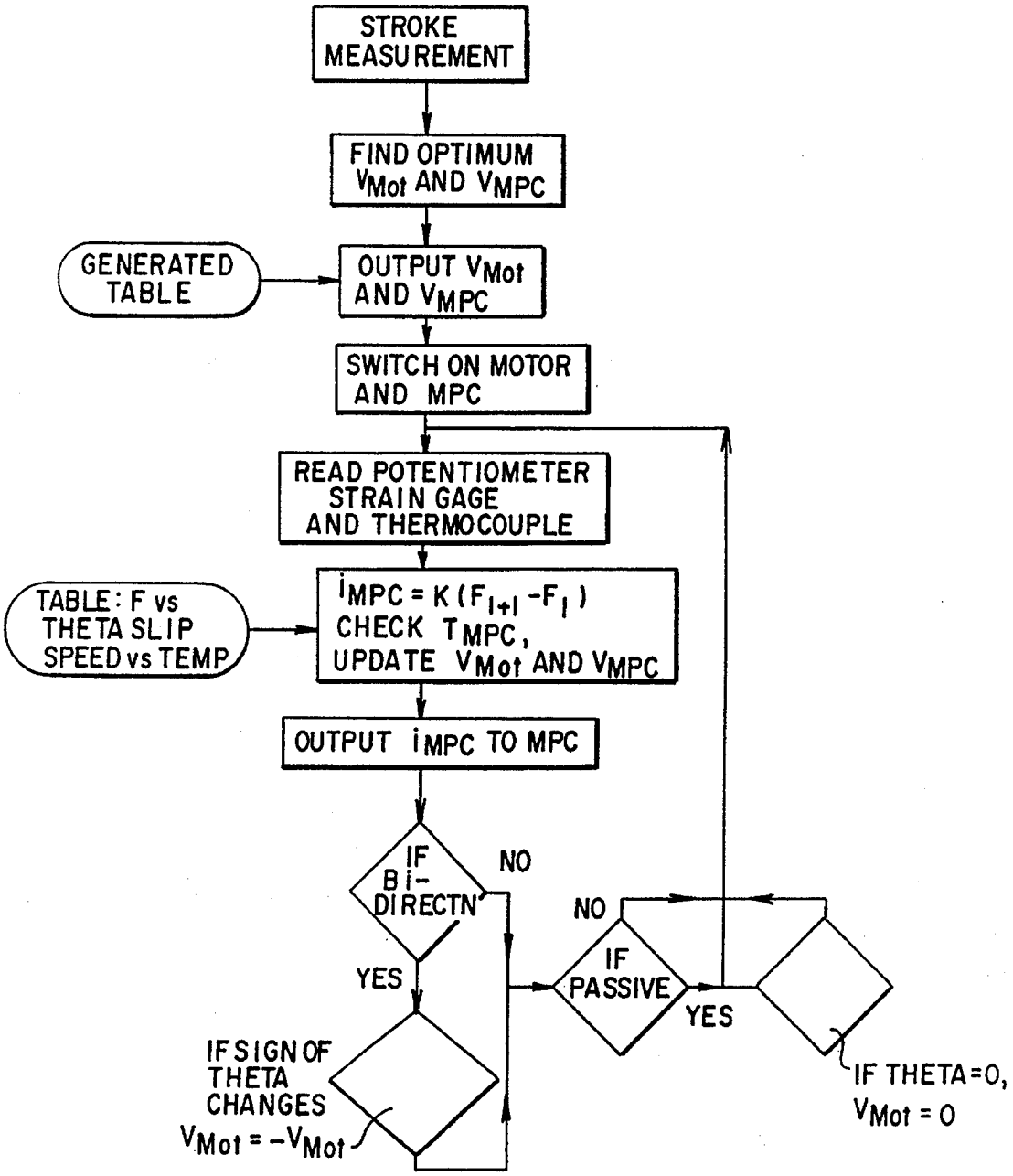
Figure 5:
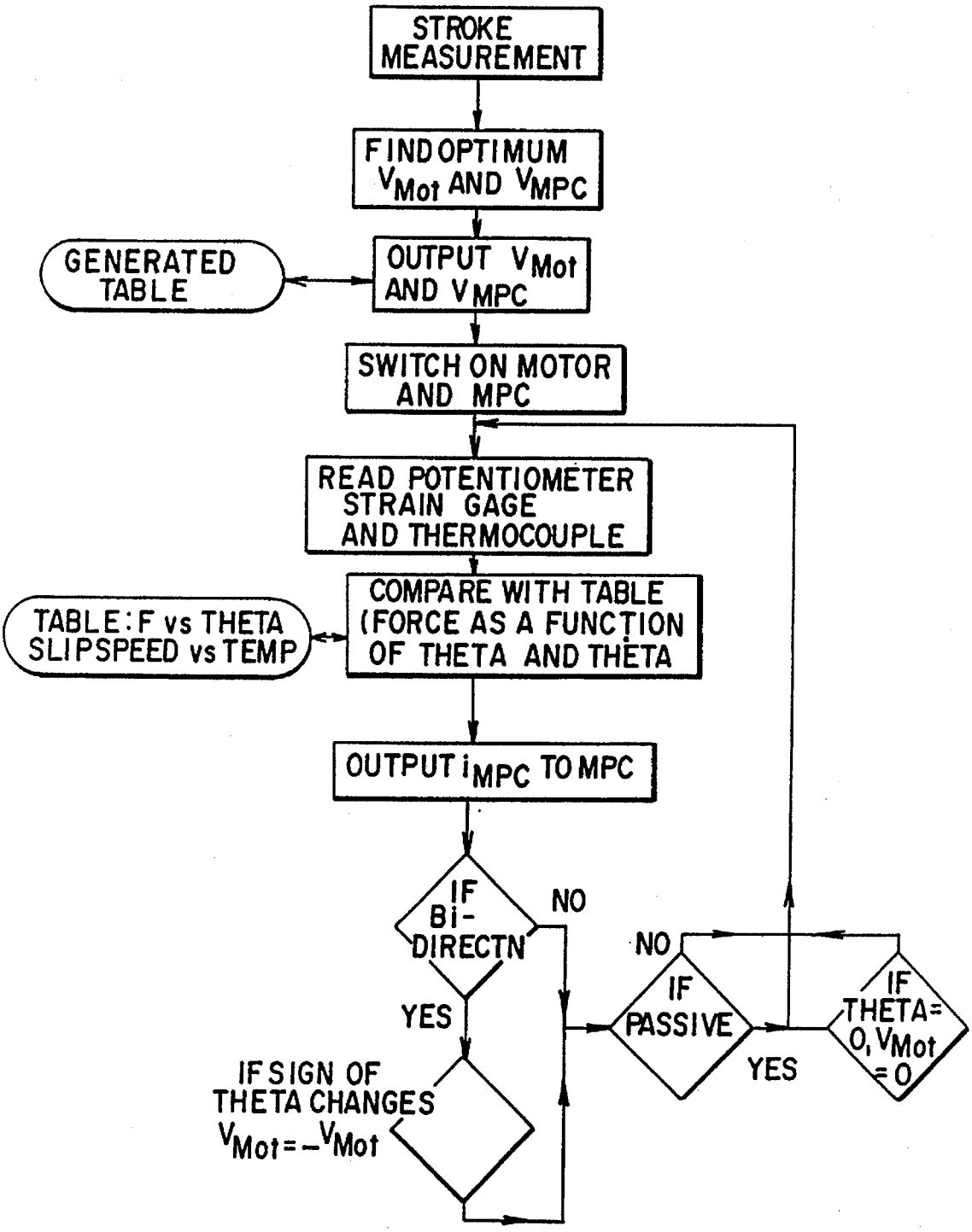
Figure 5D:
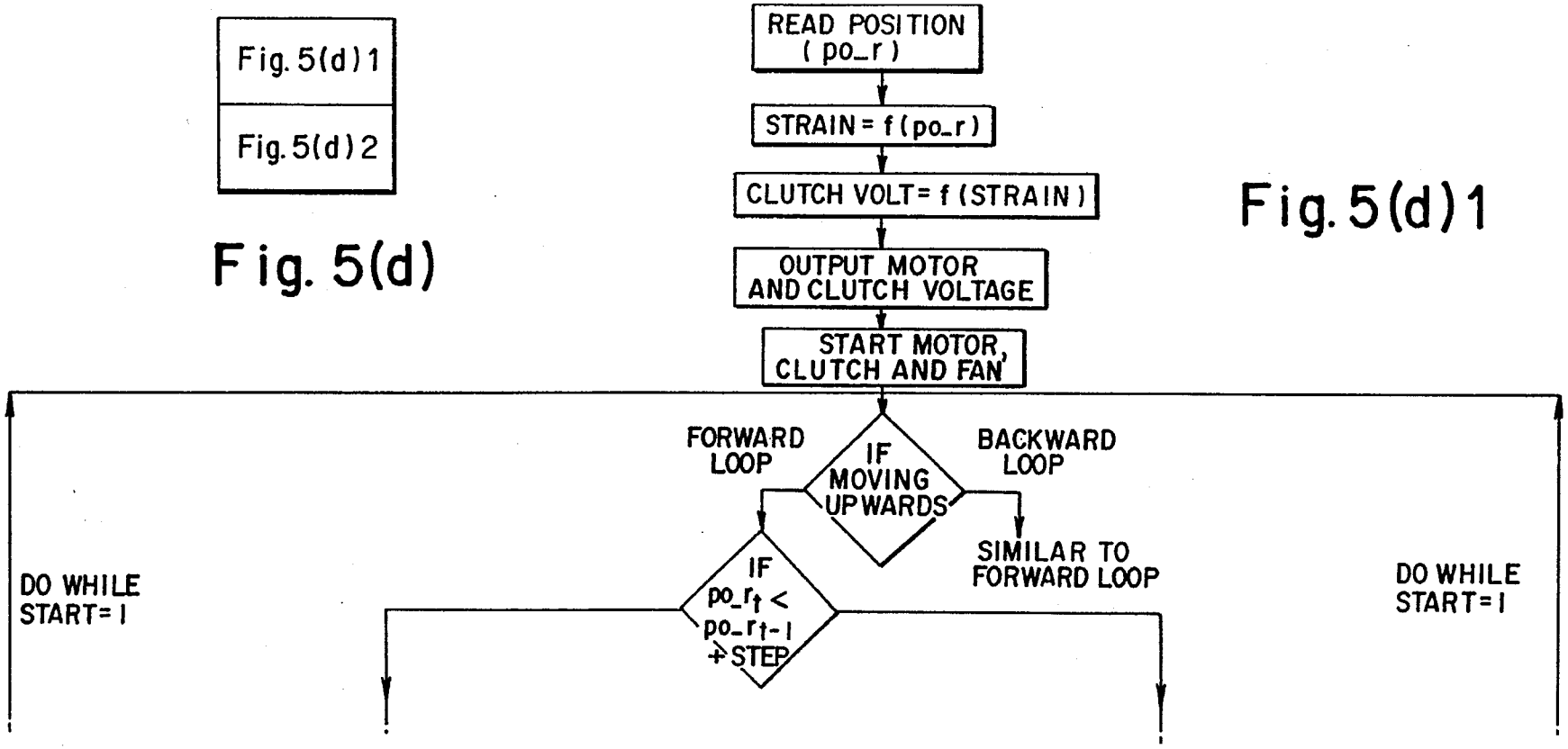

Referring to FIGS. 5(*a*), 5(*b*), 5(*c*) and 5(*d*), detailed flow charts of the isotonic, isokinetic and isotonic/isokinetic protocols are shown. FIG. 5(*a*) shows the flow chart of 'isotonic force' module. FIG. 5(b) shows the flow chart for the isotonic protocol. FIG. 5(*c*) shows the flow chart for the isokinetic protocol. FIG. 5(*d*) shows the flow chart of the 'variable force' or the isotonic/isokinetic protocol.

Referring to FIG. 5(*a*), a flow chart for the isotonic force module is shown. The flow chart begins with the user inputting the input force from the keyboard. The microcontroller uses the input force to calculate strain since strain is a function of force. The microcontroller uses the strain to calculate the clutch voltage since clutch volt is a function of strain. This information is sent to the output motor which uses the clutch voltage to start the motor, clutch and fan. Electronic sensors measure A/D strain(r) and position and compare strain(r) to a lookup value of strain.

If strain(r) is greater than strain, the computer calculates error(t+l)by subtracting volt(strain(r)) from volt(strain). Then an updated parameter is calculated by the following equation:

Update=clutch volt+kp* error[(t+1]+kp*ki* (error(t+1l)).

From this equation, D/A(update) is calculated and sent in a do loop back to the decision box of measuring A/D for strain and position in order for an updated comparison to take place.

If instead strain(r) was less than strain, the computer calculates error(t+1) by subtracting volt(strain) from volt-(strain(r)). Then an updated parameter is calculated by the following equation:

Update=clutch volt−kp* [error(t+1)]−kp*,ki*(error(t+1)).

From this equation, D/A(update) is calculated and sent in a do loop back to the decision box of measuring A/D for strain and position in order for an updated comparison to take place.

If strain(r) is equal to strain, the controller sends the infromation in a do loop back to the decision box of measuring A/D for strain and position in order for the comparison to be made again.

Referring to FIG. 5(*b*), a flow chart for the isotonic protocol is shown. The flow chart begins with the user inputtinguser's particular stroke length measurement $\mathbf{1}_s$(s) to the controller 22. The stroke length measurement $\mathbf{1}_s$(s) is used to find the optimum velocity $V_{mot}$ of the motor 12 and the optimum velocity $V_{MPC}$ of the magnetic particle clutch or MPC 16. The output velocity $V_{mot}$ of the motor 12 and the output velocity $V_{MPC}$ of the magnetic particle clutch or MPC 16 are chosen from the optimum values. The output $V_{MOT}$ and $V_{MPC}$ are then compared to the values from a generated table.

The motor 12 and magnetic particle clutch or MPC 16 are then switched on and readings are taken from the potentiometer or position sensor 32, the strain gage or force sensor 38 and the thermocouple or temperature sensor 18. The data read from the potentiometer 32, the strain gage 38 and the thermocouple or temperature sensor 18 is the sent to the signal conditioning unit of SCU 20. The signal conditioning unit or SCU 20 uses the data from the potentiometer or position sensor 32, the strain gage or force sensor 38 and the thermocouple or temperature sensor 18 to calculate the current $i_{MPC}$ of the magnetic particle clutch or MPC 16. The current $i_{MPC}$ is equal to a constant K times the difference between the force $F_{[\theta]}$as a function of the angle θ and the force $F_{[\theta]}$as a function of the angle θ'.

Once the current $i_{MPC}$ is calculated, the controller checks the torque $T_{MPC}$ of the magnetic particle clutch 16 and updates the velocity $V_{mot}$ of the motor 12 and the velocity $V_{MPC}$ of the magnetic particle clutch or MPC 16 and compares with a table of force F versus theta θ and slip speed ss versus temperature t to get the output $i_{MPC}$. The output $i_{MPC}$ is then sent to the magnetic particle clutch or MPC 16 and is then transmitted to a first decision diamond which asks if the magnetic particle clutch or MPC 16 is bi-laterally directed.

If the answer to the first decision diamond question is yes, that the magnetic particle clutch or MPC 16 is bi-laterally directed, then the user is asked a further question of if the sign of the angle theta θ changes from $V_{mot}$ to $-V_{mot}$ before being sent to a second decision diamond inquiring whether the resistance is passive. If the answer to the first decision diamond question is no, that the magnetic particle clutch or MPC 16 is not bi-laterally directed, then the user is sent directly to the second decision diamond which inquires if the resistance is passive.

With respect to the second decision diamond, if the answer to the question of whether the resistance is passive is yes, then a second inquiry is made as to if the angle theta θ is equal to zero and whether the velocity $V_{mot}$ of the motor 12 is equal to zero before the user is sent back into the middle of the flow chart to reread the potentiometer or position sensor 32, strain gage or force sensor 38 and thermocouple or temperature sensor 18 in order to recalculate the current $i_{MPC}$ of the magnetic particle clutch or MPC 16 and so forth to complete the loop as previously detailed. If the answer to the question of whether the resistance is passive is no, then the user is sent directly back into the middle of the flow chart to reread the potentiometer or position sensor 32, strain gage or force sensor 38 and thermocouple or temperature sensor 18 in order to recalculate the current $i_{MPC}$ of the magnetic particle clutch or MPC 16 and so forth to complete the loop as previously explained.

Referring to FIG. 5(*c*), a flow chart for the isokinetic protocol is shown. The flow chart begins with the user inputting the user's particular stroke length measurement $\mathbf{1}_s$(s) to the controller 22. The stroke length measurement $\mathbf{1}_s$(s) is used to find the optimum velocity $V_{mot}$ of the motor 12 and the optimum velocity $V_{MPC}$ of the magnetic particle clutch or MPC 16. The output velocity $V_{mot}$ of the motor 12 and the output velocity $V_{MPC}$ of the magnetic particle clutch or MPC 16 are chosen from the optimum values. The output $V_{mot}$ and $V_{MPC}$ are then compared to the values from a generated table.

The motor 12 and magnetic particle clutch or MPC 16 are then switched on and readings are taken from the potentiometer or position sensor 32, the strain gage or force sensor 38 and the thermocouple or temperature sensor 18. The data read from the potentiometer 32, the strain gage 38 and the thermocouple or temperature sensor 18 is the sent to the signal conditioning unit of SCU 20. The signal conditioning unit or SCU 20 uses the data from the potentiometer or position sensor 32, the strain gage or force sensor 38 and the thermocouple or temperature sensor 18 to calculate the current $i_{MPC}$ of the magnetic particle clutch or MPC 16. The current $i_{MPC}$ is equal to a constant K times the difference between the force $F_{[\theta}$ as a function of the angle θ and the force $F_{[\theta']}$ as a function of the angle θ'.

Once the current $i_{MPC}$ is calculated, the controller checks the torque $T_{MPC}$ of the magnetic particle clutch 16 and updates the velocity $V_{mot}$ of the motor 12 and the velocity $V_{MPC}$ of the magnetic particle clutch or MPC 16 and compares with a table of force F versus theta θ and slip speed ss versus temperature t to get the output $i_{MPC}$. The output $i_{MPC}$ is then sent to the magnetic particle clutch or MPC 16 and is then transmitted to a first decision diamond which asks if the magnetic particle clutch or MPC 16 is bi-laterally directed.

If the answer to the first decision diamond question is yes, that the magnetic particle clutch or MPC 16 is bi-laterally directed, then the user is asked a further question of if the sign of the angle theta θ changes from $V_{mot}$ to $-V_{mot}$ before being sent to a second decision diamond inquiring whether the resistance is passive. If the answer to the first decision diamond question is no, that the magnetic particle clutch or MPC 16 is not bi-laterally directed, then the user is sent directly to the second decision diamond which inquires if the resistance is passive.

With respect to the second decision diamond, if the answer to the question of whether the resistance is passive is yes, then a second inquiry is made as to if the angle theta θ is equal to zero and whether the velocity $V_{mot}$ of the motor 12 is equal to zero before the user is sent back into the middle of the flow chart to reread the potentiometer or position sensor 32, strain gage or force sensor 38 and thermocouple or temperature sensor 18 in order to recalculate the current $i_{MPC}$ of the magnetic particle clutch or MPC 16 and so forth to complete the loop as previously detailed. If the answer to the question of whether the resistance is passive is no, then the user is sent directly back into the middle of the flow chart to reread the potentiometer or position sensor 32, strain gage or force sensor 38 and thermocouple or temperature sensor 18 in order to recalculate the current $i_{MPC}$ of the magnetic particle clutch or MPC 16 and so forth to complete the loop as previously explained.

Referring to FIG. 5(*d*), a flow chart of the variable force or isotonic/isokinetic protocol is shown. The flow chart begins by reading the position (po_r) and then calculating strain as a function of position (po_r). The microcontroller uses the strain to calculate the clutch voltage since clutch volt is a function of strain. This information is sent to the output motor which uses the clutch voltage to start the motor, clutch and fan. Once the notor, clutch and fan are started, a decision diamond asks if the handle bars are being moved upwards. If yes, the information is sent through a forward loop which will be explained below. If no, the information is sent to a backward loop which is similar to the forward loop.

The foward loop begins with a decision diamond asking for a comparison between position at time t(po_$r_t$) and position at time t-1 (po_$r_{t-1}$). If po_$r_t$ is less than po_$r_{t-1}$, the question is asked whether strain(r) is greater than strain(n).

If yes, the computer calculates error(t+l) by subtracting volt(strain(r)) from volt(strain(n)). Then an updated parameter is calculated by the following equation:

Update=clutch volt+kp*[error(t+l)-error(t)]+kp*ki*(error(t+l)).

From this equation, D/A(update) is calculated and sent in a do loop back to the decision box of measuring A/D for strain and position in order for an updated comparison to take place.

If no, the computer calculates error(t+l) by subtracting volt(strain(n)) from volt(strain(r)). Then an updated parameter is calculated by the following equation:

Update=clutch volt - kp* [error (t+l) -error (t) ]- kp*ki* (error (t+l)).

From this equation, D/A(update) is calculated and sent in a do loop back to the decision box of measuring A/D for strain and position in order for an updated comparison to take place.

If strain(r) is equal to strain(n), the controller sends the infromation in a do loop back to the decision box of measuring A/D for strain and position in order for the comparison to be made again.

If in the forward loop, po_$r_t$ is greater than po_$r_{t-1}$, the question is asked whether strain(r) is greater than strain(n).

If yes, the computer calculates error(t+l) by subtracting volt (strain(r)) from volt (strain(n+l)). Then an updated parameter is calculated by the following equation:

Update=clutch volt +kp* [error (t+l) -error(t)]+kp*ki* (error (t+l)).

From this equation, D/A(update) is calculated and sent in a do loop back to the decision box of measuring A/D for strain and position in order for an updated comparison to take place.

If no, the computer calculates error(t+l) by subtracting volt(strain(n+l)) from volt(strain(r)). Then an updated parameter is calculated by the following equation:

Update=clutch volt - kp,[error(t+l)-error(t)]- kp,ki,(error(t+l)).

From this equation, D/A(update) is calculated and sent in a do loop back to the decision box of measuring A/D for strain and position in order for an updated comparison to take place.

If strain(r) is equal to strain(n), the controller sends the infromation in a do loop back to the decision box of measuring A/D for strain and position in order for the comparison to be made again.

Figure 6A:
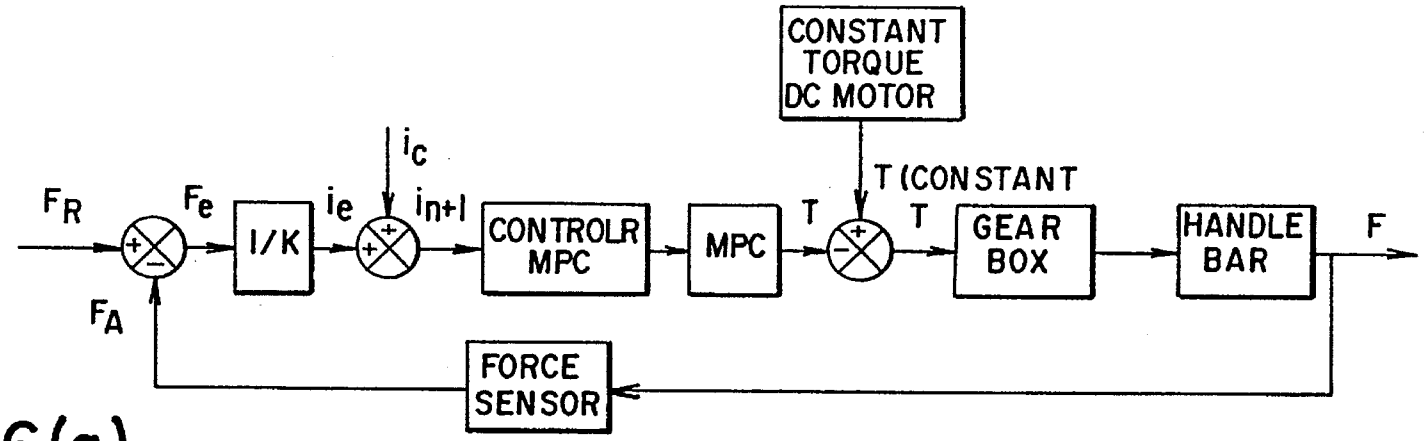
FIG. 6(*a*) is a control block diagram showing isotonic exercise using a constant force controlled parameter and active resistance.
Figure 6B:
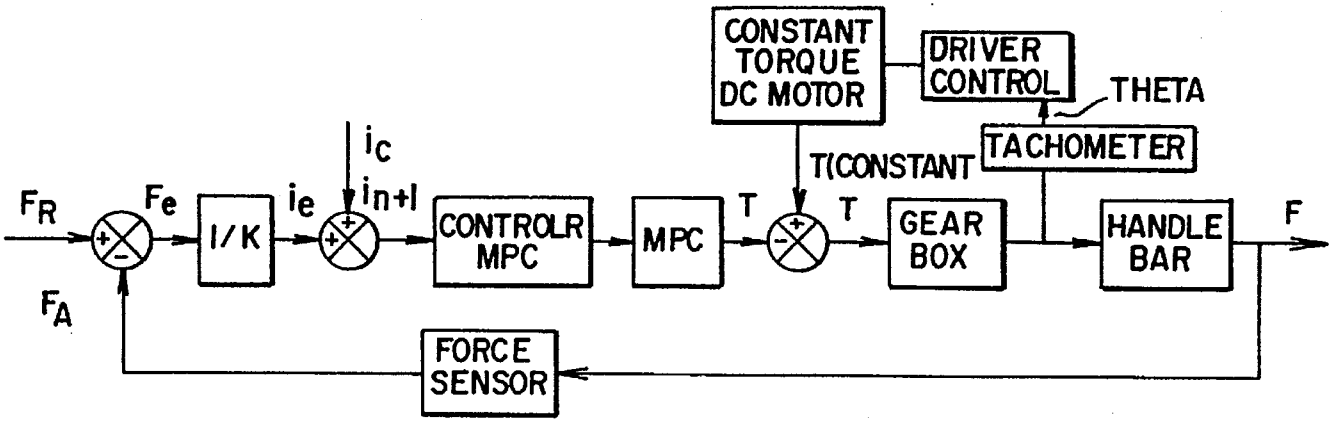
Figure 6C:
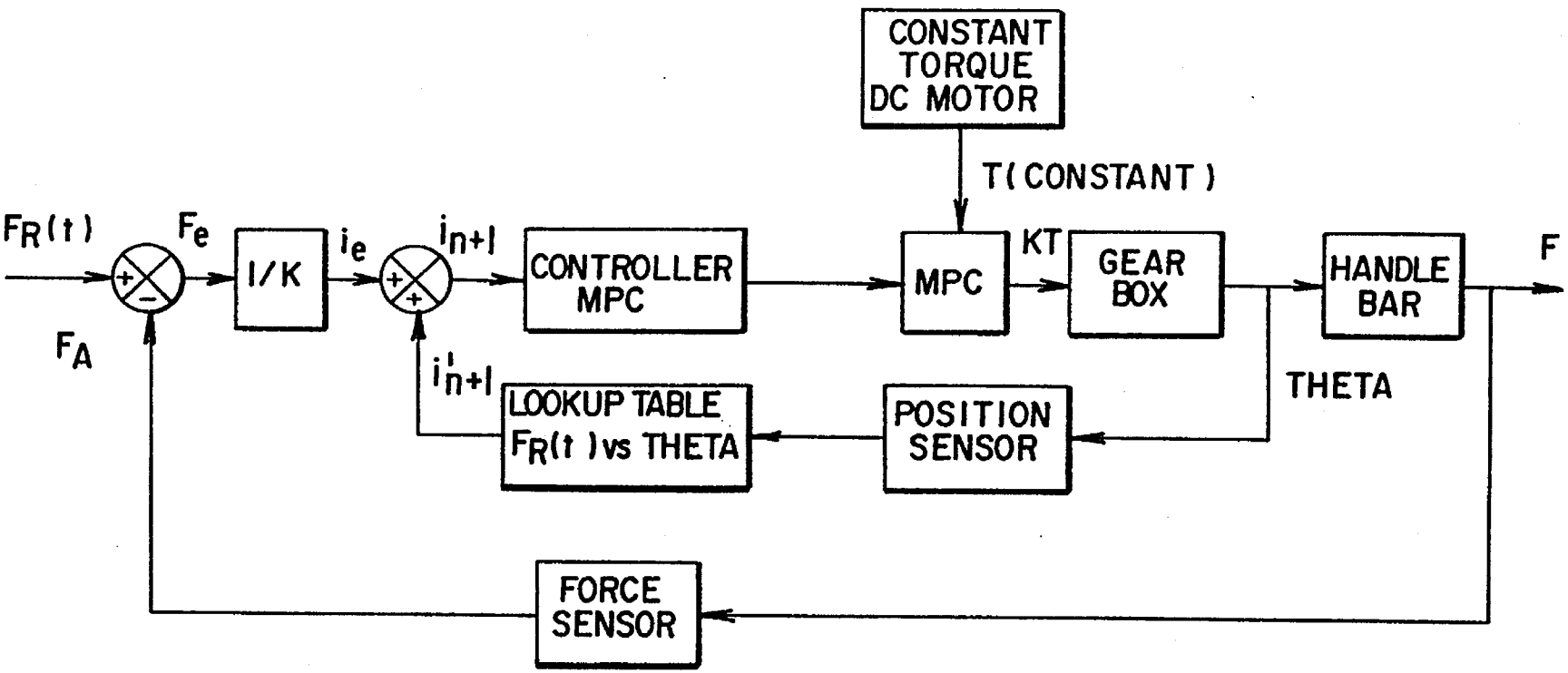
Figure 6:
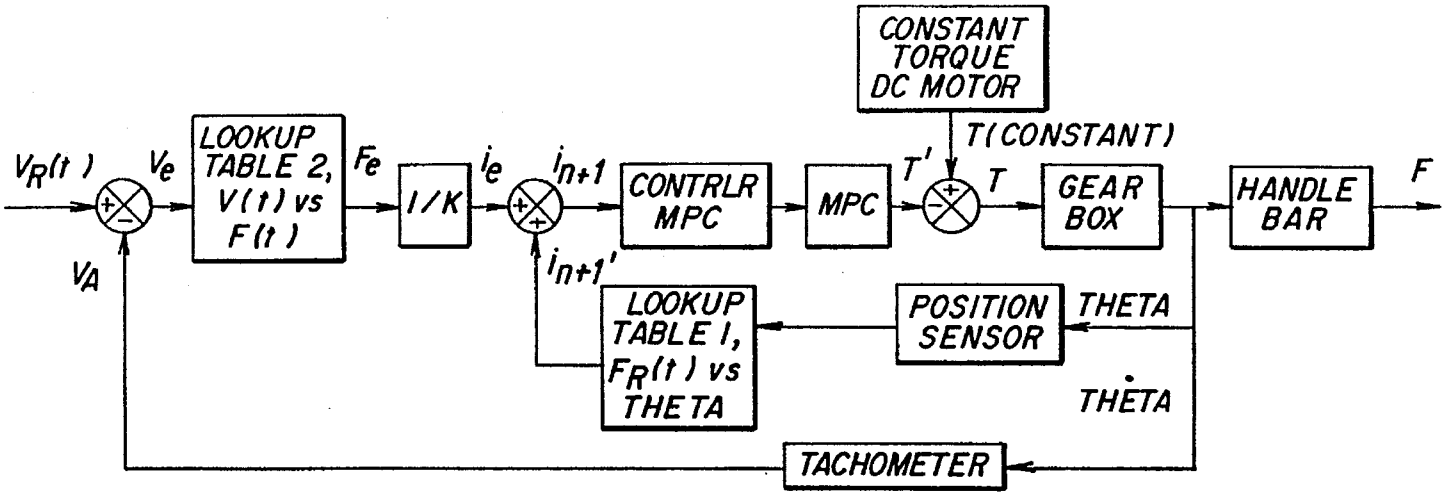

Referring to FIGS. 6(*a*), 6(*b*), 6(*c*) and 6(*d*), examples of control block diagrams illustrative of four of the twenty-one possible protocols are shown. FIG. 6(*a*) shows a control block diagram for the isotonic protocol when the controlled parameter is constant force and the resistance is active. FIG. 6(*b*) shows a control block diagram for the isotonic protocol when the controlled parameter is constant force and the resistance is passive. FIG. 6(*c*) shows a control block diagram for the isokinetic protocol when the controlled parameter is variable force and the resistance is active. FIG. 6(*d*) shows a control block diagram for the isokinetic protocol when the controlled parameter is constant force and the resistance is active.

Referring to FIG. 6(*a*), an amount of force $F_R$ is applied to the drive shaft 26 at a positive angle theta θ to result in another force $F_e$. The force $F_e$ is multiplied by a constant 1/K to arrive at a current $i_e$. The current $i_e$ is applied to the drive shaft 26 in combination with another current $i_c$, both at positive angles of theta θ, to result in a current $i_{n+1}$l . The current $i_{n+}$ is sent to the magnetic particle clutch controller or driver 42 which processes the current information and sends signals to drive the magnetic particle clutch or MPC 16. The magnetic particle clutch or MPC 16 delivers a torque T at a negative angle theta θ to the drive shaft 26 together with the constant torque, direct current or DC motor 12 which delivers a torque T(constant) at a positive angle theta θ to the drive shaft 26. In turn, a torque T is transmitted to the gear box 24. The gear box 24 in turn acts on the handle bars 34 of the exercise machine to produce a force F. The force F is read by the force sensor 38 which modifies the force F to a force $F_A$ which force $F_A$ is applied to the drive shaft 26 at a negative angle of theta θ in combination with the force $F_R$ to arrive at the force $F_e$.

Referring to FIG. 6(*b*), an amount of force $F_R$ is applied to the drive shaft 26 at a positive angle theta θ to result in another force $F_e$. The force $F_e$ is multiplied by a constant 1/K to arrive at a current $i_e$. The current $i_e$ is applied to the drive shaft 26 in combination with another current $i_c$, both at positive angles of theta θ, to result in a current $i_{n+1}$. The current $i_{n+1}$ is sent to the magnetic particle clutch or MPC controller or drive 42 which processes the current information and sends signals to the magnetic particle clutch or MPC 16. The magnetic particle clutch or MPC 16 delivers a torque T to the drive shaft 26 at a negative angle of theta θ together with the constant torque, direct current or DC motor 12 which delivers a torque T(constant) to the drive shaft 26 at a positive angle of theta θ. In turn, a torque T is transmitted to the gear box 24. The gear box 24 in turn acts on the handle bars 34 of the exercise machine to produce a force F. However, between the gear box 24 and the handle bars 34, a tachometer is use to measure the angle theta θ which information is sent to the driver control unit or motor driver 44 which then acts to drive to motor 12. The amount of force F applied to the handle bars is read by the force sensor 38 which modifies the force F to a force $F_A$ which force $F_A$ is applied to the drive shaft 26 at a negative angle of theta θ in combination with the force $F_R$ to arrive at the force $F_e$.

Referring to FIG. 6(*c*), an amount of force $F_R$ is applied to the drive shaft 26 at a positive angle theta θ to result in another force $F_e$. The force $F_e$ is multiplied by a constant 1/K to arrive at a current $i_e$. The current $i_e$ is applied to the drive shaft 26 in combination with another current $i_c$, both at positive angles of theta θ to result in a current $i_{n+1}$. The current $i_{n+1}$ is sent to the magnetic particle clutch or MPC controller or driver 42 which processes the current information and sends signals to the magnetic particle clutch or MPC 16. The magnetic particle clutch or MPC 16 receives a torque T(constant) from the constant torque motor 12 and in turn, delivers a torque multiplied by a constant KT to the gear box 24. The gear box 24 in turn acts on the handle bars 34 of the exercise machine to produce a force F. However, between the gear box 24 and the handle bars 34, a position sensor 32 is used sense position information which is compared to a lookup table of $F_R(t)$ versus the angle theta θ which information is used to calculate a current $i_{n+1}$, to be applied to the drive shaft 26 with the current $i_e$. to produce a current in+1 which is sent to the magnetic particle clutch or MPC controller or driver 42 which then acts to drive to magnetic particle clutch or MPC 16. The force F is read by the force sensor 38 which modifies the force F to a force $F_A$ which force $F_A$ is applied to the drive shaft 26 at a negative angle of theta θ in combination with the force $F_R$ to arrive at the force $F_e$.

Referring to FIG. 6(*d*), a velocity of $V_R(t)$ is applied to the drive shaft 26 at a positive angle theta θ to result in a velocity $V_e$. The velocity $V_e$ is compared to a lookup table 2 of V(t) versus F(t) to come up with a force $F_e$. The force $F_e$ is multiplied by a constant 1/K to arrive at a current $i_e$. The current $i_e$ is applied to the drive shaft 26 to result in a current $i_{n+1}$. The current $i_{n+1}$ is sent to the magnetic particle clutch or MPC controller or driver 42 which processes the current information and sends signals to drive the magnetic particle clutch or MPC 16. The magnetic particle clutch or MPC 16 delivers a torque T to the drive shaft 26 together with the constant torque, direct current or DC motor 12 which delivers a torque T(constant) to the drive shaft 26. In turn, a torque T is transmitted to the gear box 24. The gear box 24 in turn acts on the handle bars 34 of the exercise machine to produce a force F. However, between the gear box 24 and the handle bars 34, a tachometer and a position sensor are used to measure the angle theta θ. The angle information is compared to a lookup table 1 of $F_R(t)$ versus theta θ in order to produce a current $i'_{n+1}$ which is delivered to the drive shaft 26 at a positive angle of theta θ. The current $i'_{n+1}$ in combination with the current $i_e$ act to produce a current $i_{n+1}$ which is sent to the magnetic particle clutch controller or driver 42 which then acts to drive to magnetic particle clutch or MPC 16. The angle information is also used to produce a velocity $V_A$ which is applied to the drive shaft 26 at a negative angle of theta θ such as to combine with the velocity $V_R(t)$ applied to the drive shaft 26 at a positive angle of theta θ to form the velocity $V_e$. The force F is read by the force sensor 38 which modifies the force F to a force $F_A$ which force $F_A$ is applied to the drive shaft 26 in combination with the force $F_R$ to arrive at the force $F_e$.

Figure 7:
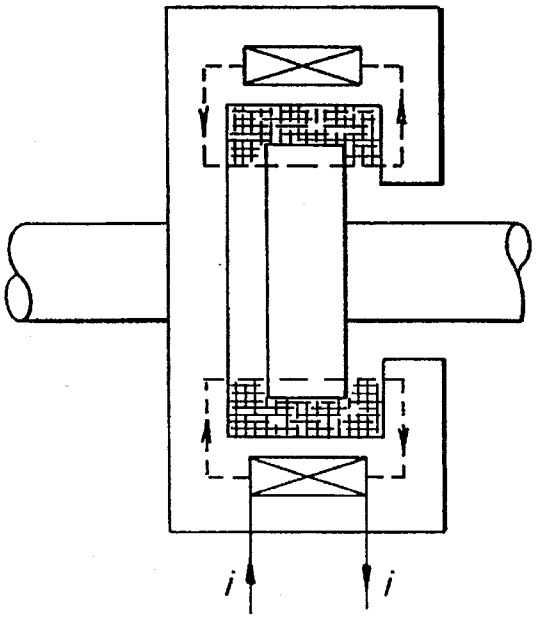
FIG. 7(*a*) is a schematic view of the magnetic particle clutch of the apparatus for use with an exercise machine.
Figure 7B:
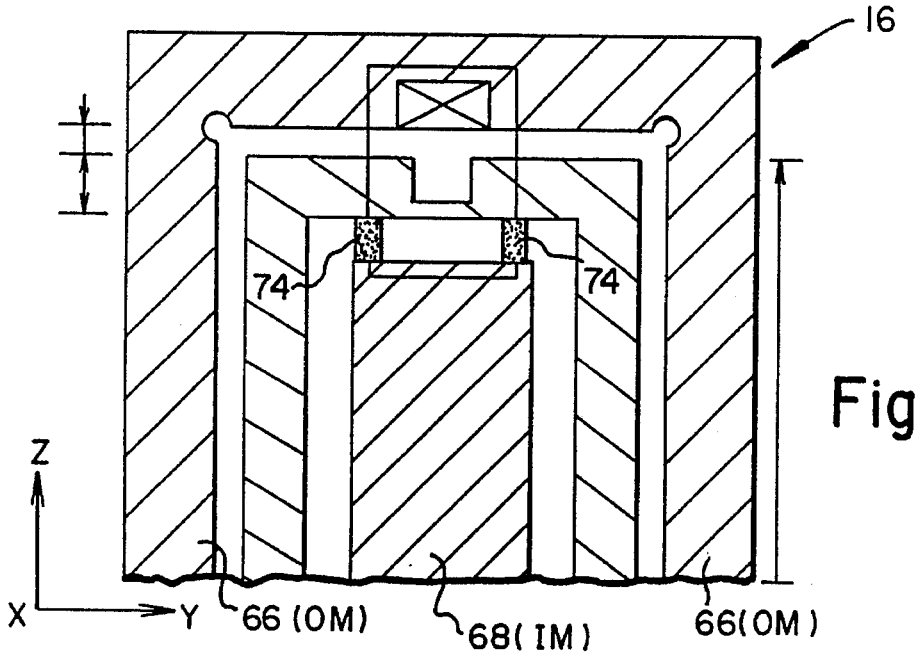
Figure 7C:
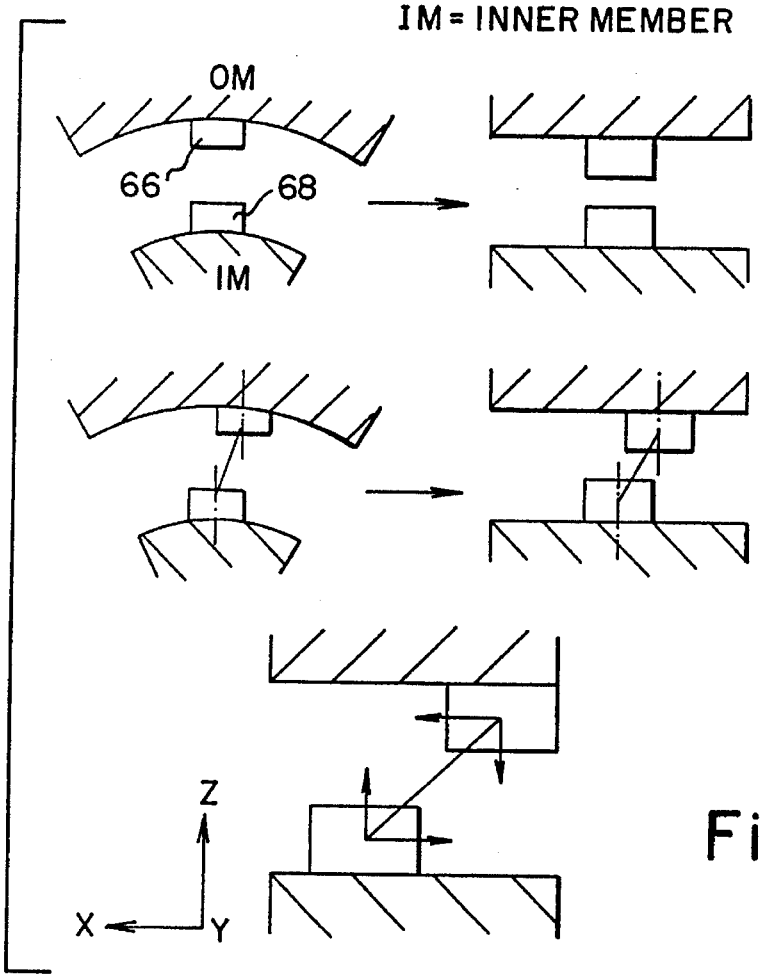

Referring to FIG. 7(*a*), a schematic view of a magnetic particle clutch 16 is shown. A magnetic field 64 is created within the magnetic particle clutch 16 as is shown in FIG. 7(*b*) . The magnetic particle clutch 16 has an outer member or OM 66 and an inner member or IM 64 such that the force created between the magnetic particles as shown in FIG. 7(*c*).

In FIG. 7(*b*), the schematic diagram shows of a typical magnetic particle clutch 16 wherein a drive shaft 26 is connected to the outer member or OM 66 and the driven shaft 26 is connected to the disc 70 and is positioned within the electromagnetic coil 72 is shown. The driven disc 70 does not have any mechanical contact with the outer member or OM 66 of the drive shaft 26.

A dry, finely divided magnetic particulate material 74, such as stainless steel, is contained in the region between the outer member or OM 66 and the driven disc 70. When the coil 72 is energized by passing current through it, a magnetic field is established which causes the particles 74 to bridge the gap between the outer member or OM 66 and the disc 70 and forms the link between the two.

Referring to FIG. 7(*c*), the magnetic flux path shown are nothing but the magnetic lines of force. Both shear and tensile stresses in these links resist relative motion between the outer member or OM 66 and the disc 70 and together provide the transmitting torque. The transmitting torque is therefore, directly proportional to the coil 72 current as shown by the graph in FIG. 10(*d*).

In developing the preferred embodiment of the invention, a mathematical model of the electromechanical system was used to establish a control algorithm. The system's control algorithm is shown in FIG. 4.

In the preferred embodiment of the present invention, the microcontroller-based controller 22 has analog to digital converters 76 and digital to analog converters 78 to interface with external analog devices such as signal conditioning unit or strain gage module 80, thermocouple module 82, clutch driver or controller 42, motor driver or controller 44 and position sensor 32. An Intel 8051 microcontroller-based controller 22 is used at a significant savings in cost. The software necessary to provide feedback on the performance indicators such as work load, elapsed time, energy spent etc., has been developed in connection with the microcontroller-based system. The source code is included in this application in appendix A and flow chart diagrams are included in FIGS. 7(*a*), 7(*b*) and 7(*c*).

In developing the connector or lever mechanism 36, as shown in FIG. 3 for use with an exercise machine, a shoulder press with active, passive, uni and bi-directional, variable resistance was chosen as representative of the most general case. In other words, all other combinations use the same hardware but require only a different control algorithm and connector or lever mechanism 36. The proposed range of resistance is 50 to 150 pounds. The working principle of such a shoulder press can be best understood from the functional block diagram as shown in FIG. 1(*b*).

Referring to FIG. 1(*b*), the output from a variable speed, constant torque, reversible motor 12 is coupled to the input drive shaft 26 as is shown in FIG. 7(*b*) of the magnetic particle clutch 16. By controlling the current in the magnetic particle clutch 16, a desired value of torque is obtained at the output drive shaft 84 of the magnetic particle clutch 16. This torque is then multiplied via a gear reduction unit 24. The output from the gear reduction unit 24 is then coupled to the handle bars 34 through a drive shaft 26 resting on bearings 28.

The procedure to develop the preferred embodiment of the present invention was to start backwards, i.e., from the handle bars 34, to ensure incorporation of force and speed parameters depending upon user needs. To provide the user with a fairly straight vertical motion while exercising, handle bars 34 of great length would be required. The greater the length of the handle bars 34, the smaller the horizontal displacement during vertical motion. But at the same time the torque required, the bending stresses and the cost of the material increase proportionately. Hence, as a compromise, the handle bars 34 having a length of four (4) feet was chosen as optimum.

Using data acquired from the exercising industry on various human parameters in a shoulder press exercise, we start from the maximum and average values of parameters considering an average person as follows: the maximum stroke length is thirty-one (31) inches and the average stroke length is twenty-three (23) inches; the maximum user force is two-hundred (200) to three (300) pounds and the average user force is 100 pounds; and, the maximum time period is three (3) seconds and the average time period is three-fourths (0.75) of a second.

The preferred embodiment of the present invention is geared towards clinical applications in which the user maximum force is limited to one-hundred-fifty (150) pounds. Nevertheless the maximum force producing capability of the machine can be increased by incorporating suitable design alternatives. Alternate embodiment would have applications for wieghtlifters and bodybuilders, in which case the maximum forces would be more in the range of two-hundred 200 to three-hundred 300 or more pounds.

Referring to FIG. 6, the maximum and average values of parameters considering an average person as discussed above and length of the handle bars 34 of four (4) feet are used to calculate the user end revolutions per minute (rpm) using the equations as follow:

$$rpm_u=2\theta/3t;$$

where, $rpm_u$=user end revolutions per minute;

$\theta=\tan g^{-1}\ [(1/2)(\mathbf{1}_s/\mathbf{1}_b)]$; where, $\mathbf{1}_s$=stroke length, $\mathbf{1}_b$=bar length (chosen as 48 inches); and t=time period.

The torque to be produced at the output shaft is given by:

$$T_o=(F)(l_b);$$

where, $T_O$=output torque; and

F=user force.

The most important parameter dictating the choice of a magnetic particle clutch 16 is its heat dissipating capacity. Other parameters influencing the choice are the torque transmission capability and the time response.

In the preferred embodiment, the work is done by the torque motor 12 as well as by the user when working in the negative stroke. This excess work done is lost in the form of heat in the magnetic particle clutch 16. If the heat dissipating capacity of the magnetic particle clutch 16 is not enough, the magnetic particles would lose their magnetism calling for their replacement. To ensure satisfactory performance, a methodology is used by which the temperature of the particles can be monitored on-line and used by the controller 22 to adjust the torque and motor speed.

The mathematical equation for the heat dissipation capacity of a magnetic particle clutch 16 is given by:

$$H=(T_o)(rpm_i-rpm_o);$$

where,

H=slip watts;

$T_o$=torque at the input shaft of the magnetic particle clutch 16 in ft-lbs=torque provided by the motor 12;

$rpm_i$=rpm at the input shaft 22; and $rpm_o$=rpm at the output shaft 22.

The torque transmission capability refers to the maximum torque that can be transmitted by the magnetic particle clutch 16. This in turn puts a constraint on the choice of torque motor 12 and the gear reduction unit 24.

The time response of a magnetic particle clutch 16 refers to the time lag between the desired output and the corresponding input. A low time response is necessary for the generation of smooth output profiles.

The preferred embodiment of the invention uses a C-10 FA magnetic particle clutch 16 manufactured by Magnetic Power Systems Inc. This particular clutch 16 is chosen because it satisfies all of the above-discussed parameters in that it has a heat dissipating capacity of four-hundred-sixty-five (465) Watts, ten (10) foot-pounds or ft-lbs of rated torque and a quick time response.

The use of different torque motors 12 is considered because it is found that the choice of motor 12 affects the slip heat in the magnetic particle clutch 16. The variable torque, variable speed motor 12 gives the minimum average slip heat where as a constant torque, constant speed motor gives the maximum average slip heat. Thus, the use of a variable torque, variable speed motor would be justified. However, in the preferred embodiment of the invention, a constant torque, variable speed motor 12 is used because a variable torque, variable speed motor is not commercially available in the required range.

In the preferred embodiment of the invention, the torque motor 12 used is a constant torque, variable speed, direct current or DC motor 12 having a one-and-one-half (1.5) horsepower or hp capacity running at two-hundred-twenty (220) volts. It is a single phase motor with a rated speed of one-thousand-seven-hundred- fifty (1750) revolutions per minute or rpms.

The preferred embodiment of the present invention has only one gear reduction unit 24 instead of two. At first, a gear reduction unit 24 was placed between the torque motor 12 and the magnetic particle clutch 16 and a second gear reduction unit 24 was placed between the magnetic particle clutch 16 and the transmission. It was discovered that the gear reduction unit 24 between the torque motor 12 and the magnetic particle clutch 16 could be eliminated in order to reduce the overall cost of the system.

In the preferred embodiment of the present invention, spur gears are chosen for the gear reduction unit 24 because of spur gear's inherent strength and capability to take load in either direction and a single gear ratio gear reduction unit 24 is chosen over a multiple gear ratio gear reduction unit 24. An ideal gear reduction unit 24 would be one which could give infinite gear ratios in a specific range. However, the cost and the feasibility of such a gear reduction unit 24 make the choice of a single ratio gear box necessary.

Keeping in view the amount of heat dissipated and the desired torque at the user end, suitable values of the gear ratio and the torque transmission capability of the gear reduction unit 24 are chosen. The mathematical equation governing the gear ratio is:

$$rpm_o=(G)(rpm_u);$$

where,

G=gear ratio of the gear box.

The gear reduction unit 24 chosen has a gear ratio of one-hundred-twenty to one (120:1) and a torque transmission capability of seventy-two-hundred (7200) in-lbs.

In the preferred embodiment of the present invention, the support frame 14 was specially fabricated by Atlantic Fitness Products to accommodate all the components and provide a bench for the user. The support frame 14 includes L-angles with square and rectangular tubes to provide a rigid support for the apparatus 10 keeping in mind its relatively large overall weight. All components are situated on the support frame 14 with care to take into account the appropriate height for each different component and thus, avoid any misalignments. The support frame 14 has a broad base made of rectangular tubes giving it ample stability. The tubes have holes at specific lengths thus providing an adjustable seat for the user. This design accommodates variation in user's height and reach.

Four design alternatives were investigated as shown in Table 4 which lists the final results for four alternatives.

TABLE 4

Results of Alternative Designs

| Case # | Force range (lbs) | Motor (hp or in-lb @ max & min rpm) | Magnetic particle clutch (watts) | Gear box (in-lb @ gear ration) |
|---|---|---|---|---|
| 1(a) | 50–100 lbs | 0.97 hp, (60 in-lb @ 1026.52 rpm) | C-10 FA 733 Watts 733 Watts | 5600.16 in-lb @ 93.32:1 |
| 1(b) | 100–150 lbs | 0.97 hp, 60 in-lb @ 1026.52 rpm | C-10 FA 733 Watts 733 Watts | 8400 in-lb @ 93.32:1 |
| 1(c) | 150–200 lbs | 0.83 hp, 90 in-lb @ 1026.52 rpm | C-10 FA 620 Watts | 11199.84 in-lb @ 93.32:1 |
| 1(d) | 50–200 lbs | 0.97 hp, 60 in-lb @ 1026.52 rpm | C-10 FA 733 Watts | 11199.84 in-lb @ 93.32:1 |
| 2(a) | 50–100 lbs | 0.97 hp 120 in-lb @ 513.37 rpm | C-10 FA 733 Watts 733 Watts | 5600.16 in-lb @ 46.67:1 |
| 2(b) | 100–150 lbs | 0.97 hp 120 in-lb @ 513.37 rpm | C-10 FA 733 Watts 733 Watts | 8400 in-lb @ 70:1 |
| 2(c) | 150–200 lbs | 0.83 hp 120 in-lb @ 434 rpm | C-10 FA 620 Watts 620 Watts | 11199.84 in-lb @ 93.32:1 |
| 2(d) | 50–200 lbs | 0.97 hp 120 in-lb @ 513.37 rpm | C-10 FA 733 Watts | 1)46.67 @ 5600.16 in-lb 2)70 @ 8400 in-lb 3)93.32 @ 11199.84 in-lb |
| 3(a) | 50–100 lbs | 60 in-lb 1149.7 rpm 1026.52 rpm | C-10 FA 410.61 Watts 733.23 Watts | 5600.16 in-lb @ 93.32:1 |
| 3(b) | 100–150 lbs | 90 in-lb 1026.52 rpm 578.58 rpm | C-10 FA 733.23 Watts 619.91 Watts | 8400 in-lb @ 93.32:1 |
| 3(c) | 150–200 lbs | 120 in-lb 578.58 rpm 390.71 rpm | C-10 FA 619.91 Watts 558.16 Watts | 11199.84 in-lb @ 93.32:1 |
| 3(d) | 50–200 lbs | 120 in-lb 1149.7 rpm 390.71 rpm | C-10 FA | 11199.84 in-lb @ 93.32:1 |
| 3(e) | 0–150 lbs | 1.5 hp 1750 rpm | C-10 FA | 7200 in-lb @ 120:1 |
| 4(a) | 50–100 lbs | 120 in-lb 574.97 rpm 513.37 rpm | C-10 FA 410.69 Watts 733 Watts | 5600.16 in-lb @ 46.67:1 |

TABLE 4-continued

| Case # | Force range (lbs) | Motor (hp or in-lb @ max & min rpm) | Magnetic particle clutch (watts) | Gear box (in-lb @ gear ration) |
|---|---|---|---|---|
| | | Results of Alternative Designs | | |
| 4(b) | 100–150 lbs | 120 in-lb<br>770 rpm<br>434 rpm | C-10 FA<br>733 Watts<br>620 Watts | 8400 in-lb @ 70:1 |
| 4(c) | 150–200 lbs | 120 in-lb<br>578.65 rpm<br>390.71 rpm | C-10 FA<br>620 Watts<br>558.16 Watts | 11199.84 in-lb @ 93.32:1 |
| 4(d) | 50–200 lbs | 120 in-lb<br>862.4 rpm<br>390.71 tpm | C-10 FA | 1)46.67 @ 5600.16 in-lb<br>2)70 @ 8400 in-lb<br>3)93.32 @ 11199.84 in-lb |

Case 1: Constant horse power motor and constant gear ratio gear box.
Case 2: Constant horse power motor and variable gear ratio gear box.
Case 3: Constant torque motor and constant gear ratio gear box.(*)
Case 4: Constant torque motor and variable gear ratio gear box.

The third design criteria was chosen as the final design because it satisfied the performance requirements within the budget and time constraints.

The three critical components of the design choice are: first, the preferred magnetic particle clutch 16 is Magnetic Power Systems Inc.'s Model C-10 FA which has a heat dissipating capacity of four-hundred-sixty-five (465) Watts, a rated torque of ten (10) foot-pounds or ft-lbs and a time response of fifteen-one-hundredths (0.15) of a second and which is modified to include temperature control capability by incorporating a temperature sensor or thermocouple into the clutch 16; second, the preferred gear reduction unit 24 is a cycloidal gear system with a gear ratio of one-hundred-twenty to one (120:1) and a maximum rated torque transmission capability of seventy-two-hundred (7200) inch-pounds or in-lbs; and third, the preferred torque motor 12 is a single phase, constant torque, variable speed, direct current or DC motor 12 having a capacity of one-and-one-half (1.5) horsepower or hp running at tow-hundred-twenty 220 Volts and a rated speed of seventeen-hundred-fifty (1750) revolutions per minute or rpms.

A mathematical model of the present invention was developed to assist in theoretical evaluation of the system capabilities and to point out areas limiting the performance of the machine.

MATHEMATICAL MODELLING

1. MAGNETIC PARTICLE CLUTCH OR MPC

Referring to FIG. 7(*b*), the following assumptions are made regarding the permeabilities:

1. $\mu_1, \mu_2, \mu_3 \approx \infty$
2. $\mu_4 < \mu_3$

Keeping in mind these assumptions, we also refer to FIG. 7(*c*) for the flux path as shown.

In Maxwell's equations, neglecting the displacement current term, the equations thus obtained are said to be in the "magneto quasi static" form as follows:

$$\int_c H.dl = \int_s J.da \tag{6}$$

$$\int_s B.da = 0 \tag{7}$$

where,

H=magnetic field intensity;

J=electric field intensity; and

B=magnetic field density.

Assuming the magnetic flux density to be uniform across the core-section, the equations get modified as follows:

$$\Phi_c = B_c A_c \tag{8}$$

$$F = Ni = \Phi H.\ dl \tag{9}$$

where, $\Phi_c$=flux in the core;

$B_c$=uniform flux density in the core; and $A_c$=area of cross-section of the core.

It is assumed that the flux path follows a path whose length is mean core length, $1_c$. Hence, $$F = Ni = H_c l_c \tag{10}$$

where, $H_c$=average magnitude of H in the core.

Also, $$B = \mu H \tag{11}$$

where,

μ=magnetic permeability of the core.

Neglecting the fringing effect and assuming that the cross sectional areas of the core and the air gap are same, we have $$B_g = B_c = \Phi / A_c \tag{12}$$

From equations (9) and (11), we get:

$$F = Ni = H_c l_c + H_9 l_g \tag{13}$$

$$F = Ni = (B_c/\mu)(l_c) + (B_g/\mu_o)(g) \tag{14}$$

Assuming that the core has constant permeability:

$$F = [(\Phi)(l_c)]/[(\mu)(A_c)] + [(\Phi)(g)]/[(M_o)(A_c)] \tag{15}$$

-continued $$= \Phi(R_c + R_g) \quad (16)$$

where, $$R_c = 1_c/\mu A_c.$$

Thus, $$R_g = (g)/[(M_o)(A_c)]$$

$$\Phi = (F)/(R_c + R_g) \quad (17)$$

Assuming the core reluctance to be very small as compared to the air gap reluctance because $\mu \gg \mu_o$:

$$\Phi \approx F/R_g = [(F)(\mu_o)(A_c)]/g = [(Ni)(\mu_o)(A_c)]/g \quad (18)$$

If magnetic field varies with time, an electric field is produced, given by Faraday's law:

$$\int_c E.ds = -d/dt \int_s B.da \quad (19)$$

where,

E=Electric field intensity. (20)

Neglecting the electric field intensity, E, in the wire, the electric field intensity or emf, E, becomes e or induced emf. Assuming that total flux is dominated by core flux and the winding links the core flux N times:

$$e = N[(d\Phi)/(dt)] = (dt)] = (d\lambda)/(0dt) \quad (21)$$

where, $\lambda = N\Phi$=flux linkage of the winding; and $\Phi$=instantaneous value of the time varying flux.

For a material of constant permeability, there is a linear relationship between $\Phi$ and i which gives:

$$L = (\lambda)/(i) \quad (22)$$

where,

L=inductance associated with the winding. From equations (18) and (22), $$L = [(N^2)(\mu_o)(A_c)]/g. \quad (23)$$

This formula is derived from Maxwell's equations and will be used below in further calculations.

2. DERIVATION OF GOVERNING EQUATIONS

In FIG. 7(*b*), we assume that $1_A$ and g do not offer any resistance which is a valid assumption because the core has high permeability. Although g may offer some reluctance, this will merely result in decreasing the flux in the system and it will not have any other effect on the derivation of the working equations. Therefore, the only reluctance is offered by the air gaps between the magnetic particles 74.

Next, we simplify the situation by considering only two magnetic particles 74 between the outer member or OM 66 and the inner member or IM 68. FIG. 7(*c*) depicts the side view of the magnetic particle and shows that the curvature of the inner member or IM 68 and the outer member or OM 66 with respect to the magnetic particle 74 size is very small. Hence, we approximate the surfaces to be flat.

If now an input torque is applied to the outer member or OM 66, it will displace the outer member or OM 66 by an angle of magnitude, $\Phi$. Making the above-mentioned assumptions, we have:

$$L(x) = [(N^2)(\mu r)(A_{gap})]/2g \quad (24)$$

where, $A_{gap} = 1(1-x)D_{MP}$;

$D_{MP}$=size of the magnetic particles; and $\mu r$=permeability of the magnetic particles.

Therefore, $$L(x) = [(N^2)(\mu r)(1-x)(D_{MP})]/[(2g)(D_{MP})] \quad (25)$$

It is to be noticed that g is the air gap between the magnetic particles. Due to the small size and large number of magnetic particles 74, they will be almost touching each other. Hence, g is the gap between their centers and therefore g, is taken as $gD_{MP}$.

Also, $$f_{f1d}(x) = -(\delta W)/(\delta x) \quad (26)$$

$$W = (1/2)[L(x)\ i^2] \quad (27)$$

$$W = (1/2)[(N^2)(\mu_r)(1-x)(i^2)]/(2g) \quad (28)$$

$$(\delta W)/(\delta x) = -f_{f1d}x = [-(\delta)/(\delta x)](1/2)\{(N^2\mu_r(1-x)(i^2)]/2g \quad (29)$$

$$= (1/2)[(N^2)(\mu_r)(i^2)]/2g \quad (30)$$

$$= [(N^2)(\mu_r)(i^2)]/4g. \quad (31)$$

For simplicity, particle 74 may be considered to be attached to the outer member or OM 66. Therefore, a torque is transmitted to the inner member or IM 68, given by $$T = [N^2\mu_r i^2/4g](xR) \quad (32)$$

This torque will not be added to the vertical stack of particles in FIG. 7(*c*). These particles shown in a vertical row will aid in transmitting the same force and hence the same torque.

But since we have particles distributed all around the circumference, $$T_{total} = \int_0^{2\pi r} [n^2\mu_r i^2 R/4g] \quad (33)$$

$$= \pi N^2\mu_r i^2 R^2/2g \quad (34)$$

Until now, we have assumed that the air gap "g" remains constant.

But actually, the air gap "g" changes which results in the generation of a force in the z direction as seen in FIG. 7(*b*). This force will cause the shaft to bend in a manner given by the following equations:

$$f_x = -[\delta W/\delta g] \quad (35)$$

$$= -[N^2\mu_r(1-x)i^2/4](x)[(\delta)/(\delta g)][1/g] \quad (36)$$

$$= -[N^2\mu_r(1x)i^2/4g^2] \quad (37)$$

Similarly, there will be an axial force equivalent to, $$f_T = \delta W/\delta g \quad (38)$$

$$= (1/2)[N^2\mu_r i^2/2g] \quad (39)$$

3. SYSTEM DESIGN

The equations relating the two most important parameters of a magnetic particle clutch or MPC 16 have been obtained. The parameters being torque transmitted and the heat dissipated. The governing parameters are:

$$T = \pi N2\mu ri2R2/2g \quad (40)$$

$$G = T(RPM_{ins} - RPM_{out}) \quad (41)$$

Figure 8:
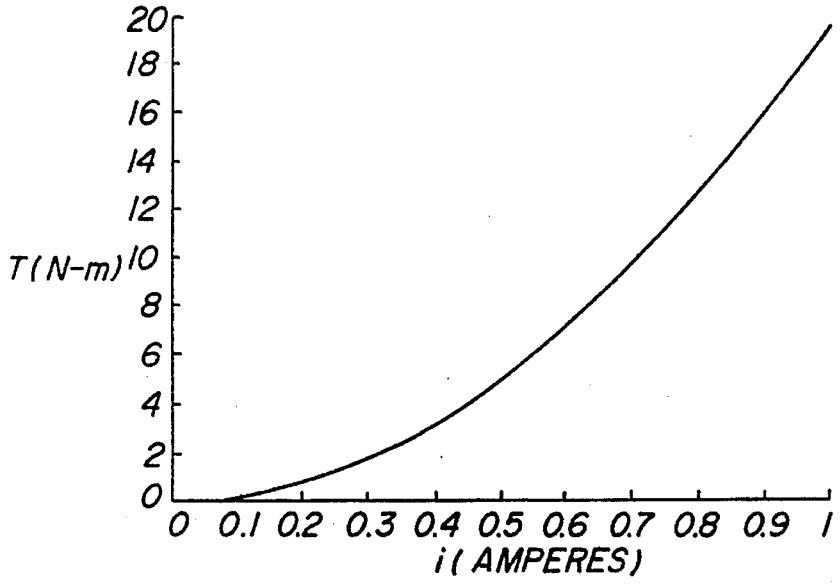
FIG. 8 is a graph showing torque measured in Newton-meters versus current measured in amperes.

The design of a magnetic particle clutch or MPC 16 for a "Smart Exercising machine" as in the present invention can be obtained following the above-referenced equations. An appropriate choice of N, R and i to satisfy the constraints on the design will have to be realized. This procedure of the designing of a magnetic particle clutch or MPC 16 can be extended to other applications as well. The equations governing the design of a magnetic particle clutch or MPC 16 for a specific application have been obtained. Simulations on the equation obtained generate FIG. 8. FIG. 8 shows a plot having a close proximity to the manufacturer's plot for the same parameters. The plot obtained differs at high currents because of the result of saturation of the magnetic circuit at such high values of currents. At such high values of current the product of i and $\mu_r$ starts decreasing rapidly. This shows that the results obtained are satisfactory in the light of the approximations made in order to simplify the model.

4. TORQUE MOTOR

Figure 9:
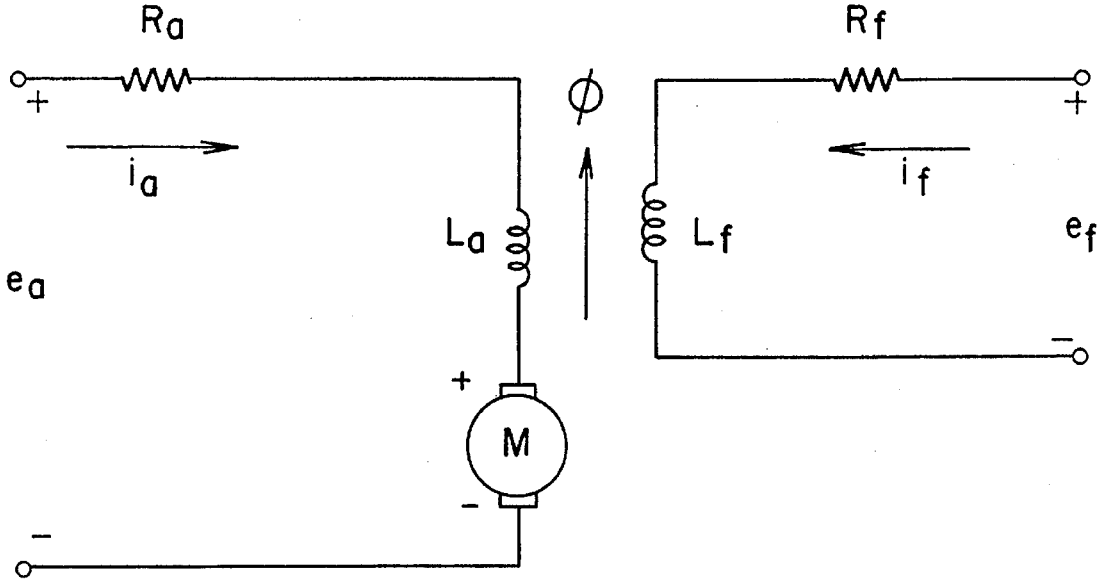
FIG. 9 is a schematic view of the electrical circuit in a direct current or DC motor.

The torque motor is a two-hundred-twenty (220) volt, single phase, two (2) horsepower or hp motor with constant torque and variable speed. To construct a suitable model, the following assumptions are made:

1. With reference to the circuit diagram of FIG. 9, the speed control is applied in the form of applied voltage $c_a$ (t). The time duration of this voltage is sufficiently long enough so that the filed current is constant.

2. Linear behavior with no energy loss is assumed. Since air gap flux is proportional to the filed current by:

$$\Phi(t)=k_f i_f$$

$$T_m(t)=K_m\Phi i_a=K_m K_f i_a=k_i i_a$$

where, $K_f$=flux constant $K_m$, $K_i$=torque constants

From the circuit diagram, we get:

$$(di_a)/(dt)=[(i)/(L_a)](e_a(t))-[(R_a)/(L_a)](i_a(t))[(i)/(L_a)](e_b(t))$$

$$T_m(t)=Ki_a(t)$$

$$e_b(t)=(K_b)[(d\theta_m)/(dt)]=K_b\omega_{m(t)}$$

$$[(d^2)(\theta_m(t)]/(dt^2=(1/J_m)(T_m(t)0-(1/J_m)(T_L(t))-(B_m/j_m)(d\Theta_m/dt)$$

where, $L_a$=armature inductance;

$R_a$=armature resistance;

$e_b$=back emf;

$T_m$=torque developed by the motor 12;

$K_b$=back emf constant;

$\theta_m$=rotor angular displacement;

$\omega_m$=rotor angular velocity;

$J_m$=rotor inertia of motor 12;

$T_L$=load torque; and $B_m$=viscous frictional constant.

With these equations a third order model of the motor 12 can be written as follows:

$$\begin{matrix} \frac{di_a(t)}{dt} & -\frac{R_a}{L_a} & -\frac{K_b}{L_a} & 0\, i_a(t) & -\frac{1}{L_a} & 0 \\ \frac{d\omega_m(t)}{dt} & -\frac{K_1}{J_m} & -\frac{B_m}{J_m} & 0\, \omega_m(t) + 0\, e_a(t) & -\frac{1}{J_m} & T_L(t) \\ \frac{d\theta_m(t)}{dt} & 0 & 1 & 0\, \theta_m(t) & 0 & 0 \end{matrix}$$

5. CONTROLLER

The prototype built features a Gateway 2000, 486/33 PC-compatible machine, using Keithley Metrabyte's DAS-20 board for data acquisition. The A/D conversion capability of the board consists of eight (8) differential or sixteen (16) single ended, switch selectable channels with software readable status. The resolution is twelve (12) bits and the accuracy is one-one-hundredth of a percent (0.01%) of the reading. The input range is switch selectable, maximum range obtained at a setting of negative ten (−10) to positive ten (+10) volts. The average conversion time is eight-and-one-half (8.5) microseconds.

The DAS-20 board supplies two (2) channels for analog outputs. These provide twelve (12) bit, non-multiplying, double-buffered signals with a maximum output drive of five (5) milliamperes. The output range is switch selectable, maximum range being at negative ten (−10) to positive ten (+10) volts.

The data from the strain gage circuit is conditioned by a strain gage input module 5B38. The module accepts signals from full bridge and half bridge three-hundred (300) ohms to ten (10) kilo-ohm transducers. It provides an excitation of positive ten (+10) volts and produces an output of negative five (−5) to positive five (+5) volts. It features a band width of ten (10) kilo-hertz. The input span limits are negative thirty (−30) to positive thirty (+30) milli-volts at three (3) milli-volts/volts sensitivity. The accuracy is eight-one-hundredth of a percent (0.08%) of the span and includes the combined effects of gain, offset and excitation errors, repeatability, hysteresis and nonlinearity.

A thermocouple input module 5B37, type J is used to condition the data obtained from the thermocouple in the magnetic particle clutch or MPC 16. The module provides an output of zero (0) to positive five (+5) volts at an accuracy of negative one-half degrees centigrade (−0.5° C.) to positive one-half degrees centigrade (+0.5° C.) over a positive five degree centigrade (+5° C.) to a positive forty-five degree centigrade (+45° C.) ambient temperature range.

EXERCISING PROTOCOLS

Although there are a total of 21 different protocols as shown in Table 1, only a few distinct protocols are discussed below:

1. ISOTONIC, CONSTANT FORCE, ACTIVE RESISTANCE, UNI-DIRECTIONAL

A closed control is designed for this protocol and is shown in FIG. 6(*a*) The purpose of this protocol is to maintain a constant force irrespective of the velocity. This is achieved by superimposing the error current, $i_e$, on constant current, $i_c$. The constant current, $i_c$, is obtained directly from the manufacturer's catalog of magnetic particle clutch 16 depending upon the constant force required.

$$i_c=(1/K)F_R$$

where,

1/K=transfer function of magnetic particle clutch 16; and $F_R$=constant force desired.

The acquired force, $F_A$ is fed back. A comparison between $F_R$ and $F_A$ gives the error force, $F_e$ and hence the error current:

$$F_e=F_R-F;\ and$$

$$i_e=(1/K)F_e.$$

The algebraic sum of the error current and constant current, $i_{n+1}$, drives the magnetic particle clutch 16.

$$i_{n+1}=i_c+i_e.$$

2. ISOTONIC, CONSTANT FORCE, ACTIVE RESISTANCE, BI-DIRECTIONAL

In this protocol we desire a bi-directional force instead of uni-directional as in the previous protocol. This can be obtained by reversing the direction of rotation of motor 12. The reversal of direction is coupled to the angular position of the handle bars 34.

3. ISOTONIC, CONSTANT FORCE, PASSIVE RESISTANCE, UNI-DIRECTIONAL

The control loop for this protocol is shown in FIG. 6(*b*). The need for this protocol is to provide a passive force. This is achieved by feeding back the angular velocity of the handle bar 34 through a tachometer. The current to the motor 12 is arrested if the angular velocity becomes zero. This further arrests the motion of handle bars 34 giving passive force.

The control equations for the loop are:

$$F_E=F_R-F_A;$$

$$i_e=(1/K)F_e; \text{ and}$$

$$i_T=0, \text{ if } 73=0; \text{ where,}$$

$i_T$=current to the torque motor 12. 4. ISOTONIC, CONSTANT FORCE, PASSIVE RESISTANCE, BI-DIRECTIONAL The difference between this protocol and the previous one is the requirement of a bi-directional force. This can be obtained by reversing the direction of rotation of the motor 12.

5. ISOTONIC, VARIABLE FORCE, ACTIVE RESISTANCE, UNI-DIRECTIONAL

Although definition of Isotonic requires generation of a constant force, this protocol goes beyond to provide a variable force. The control loop is developed and is shown in FIG. 6(*c*).

Here, the "required force" varies with time. Thus, we no longer have a constant current, $i_c$. Instead, a new value of current is obtained from a "lookup table." This value depends on the angular position of the handle bars 34 which is fed back through a position sensor 32. The following equations are obtained from the control loop:

$$F_R(t)-F_A=F_e;$$

$$i_e=(1/K)F_e; \text{ and}$$

$$i_{n+1}=i_e+i'_{n+1}$$

where, $i'_{n+1}+f(\theta)$ and $\theta=f(t)$.

6. ISOKINETIC, ACTIVE RESISTANCE, UNI-DIRECTIONAL

The control loop for this protocol is developed and is shown in FIG. 6(*d*). The prime requirement of isokinetic force is to maintain a constant velocity. This is obtained by feeding back the acquired velocity, $V_c$ and comparing it to the desired velocity, $V_R$. This gives error velocity, $V_E$. The logic used is that the velocity of the user is inversely proportional to the force. On similar thoughts, $F_e$ is obtained from "lookup table 2" corresponding to $V_e$.

The control equations for this loop are:

$$V_R(t)-V_A=V_E;$$

$$F_e=f(V_e);$$

$$i_e=(1/K)F_e;$$

$$i_{n+1}=i_e+i'_{n+1}; \text{ and}$$

$$i_{n+1}=f(\theta) \text{ and } \theta=f(t).$$

The preferred embodiment of the apparatus for use with an exercise machine of the present invention performs all possible combinations of isotonic, isokinetic, isometric exercise routines with constant or variable force and active or passive resistance in a bi- or uni-lateral direction.

SYSTEMS LEVEL OPERATION

In operation, the handle bars 34 initially rest on the support with no external forces other than the gravitational force acting on them. In operation, the user switches the system on and enters the starting resistance and stroke length $1_s$(s) or his/her height and weight. The torque motor 12 starts rotating at a predetermined speed. The controller 22 controls the variable, direct current or DC current to energize the coil so that the torque transmitted by the driving shaft 26 of the magnetic particle clutch 16 generates the desired starting resistance at the handle bars 34. At this stage, the driven shaft 26 will be slipping smoothly.

If the user starts moving the handle bars 34 upward, he or she shall feel the selected starting resistance. As the user pushes the handle bars 34 upward, the controller 22, based on the control algorithm, generates commands continuously to provide the desired resistance profile. During the downward stroke, the controller 22 manipulates the clutch 16 so that the resistance profile is retraced accurately. During these motions, if at any time the velocity of the handle bars 34 exceed that of a predetermined maximum value, the controller 22 kills the resistance immediately thus guaranteeing user safety. A user interface algorithm has been developed in C programming language and is attached below as Appendix A.

Appendix A

Appendix A

```
/*****************************************************************
USER-INTERFACE FOR SMART EXERCISE MACHINE PROTOCOLS
This program uses a TurboC compiler
*****************************************************************/

#include "stdio.h"
#include "dos.h"
#include "stdlib.h"
#define BORDER 1
#define ESC 27
#define REV_VID 0x70
#define NORM_VID 7
void save_video(), restore_video();
void goto_xy(), cls(), write_video();
void display_menu(), draw_border();
char *exercise_type[]= {
"isoTonic",
"isoKinetic",
"isoMetric",
"Isotonic/isokinetic",
"Exit"
```

```
};
char *force_type[]= {
"Constant force",
"Variable force"
};
char *active_passive[]={
"Active force",
"Passive force"
};
char *direction[]={
"Uni-directional",
"Bi-directional"
};
is_in(char *s, char c);
/* input user's selection */
get_resp(x, y, count, menu, keys)
int x, y, count;
char *menu[];
char *keys;
{
union inkey {
char ch[2];
int i;
} c;
int arrow_choice=0, key_choice;
y++;
/* highlight the first selection */
goto_xy(x, y);
write_video(x, y, menu[0], REV_VID); /* reverse video */
for(;;) {
```

```
while(!bioskey(1)) ; /* wait for key stroke */
c.i = bioskey(0);    /* read the key */
/* reset the selection to normal video */
goto_xy(x+arrow_choice, y);
write_video(x+arrow_choice, y,
menu[arrow_choice], NORM_VID); /* redisplay */
if(c.ch[0]) { /* is normal key */
/* see if it is a hot key */
key_choice = is_in(keys, tolower(c.ch[0]));
if(key_choice) return key_choice-1;
/* check for ENTER or space bar */
switch(c.ch[0]) {
case '\r': return arrow_choice;
case ' ' : arrow_choice++;
break;
case ESC : return -1; /* cancel */
}
}
else {  /* is special key */
switch(c.ch[1]) {
case 72: arrow_choice--; /* up arrow */
break;
case 80: arrow_choice++; /* down arrow */
break;
}
}
if(arrow_choice==count) arrow_choice=0;
if(arrow_choice<0) arrow_choice=count-1;
/* highlight the next selection */
goto_xy(x+arrow_choice, y);
write_video(x+arrow_choice, y, menu[arrow_choice], REV_VID);
```

```
}
}
/* display a pop-up menu and return selection
returns -2 if menu cannot be constructed
returns -1 if user hits escape key
otherwise the item number is returned starting
with 0 as the first (top most) entry
*/
int popup(menu, keys, count, x, y, border)
char *menu[];        /* menu text */
char *keys;          /* hot keys */
int count;     /* number of menu items */
int x, y;      /* X,Y coordinates of left hand corner */
int border;    /* no border if 0 */
{
register int i, len;
int endx, endy, choice;
unsigned int *p;
if((x>24) || (x<0) || (y>79) || (y<0)) {
printf("range error");
return -2;
}
/* compute the dimensions */
len = 0;
for(i=0; i<count; i++)
if(strlen(menu[i]) > len) len = strlen(menu[i]);
endy = len + 10 + y;
endx = count + 1 + x;
if((endx+1>24) || (endy+1>79)) {
printf("menu won't fit");
```

```
return -2;
}
/* allocate enough memory for it */
p = (unsigned int *) malloc((endx-x+1) * (endy-y+1));
if(!p) exit(1);  /* install your own error handler here */
/* save the current screen data */
save_video(x, endx+1, y, endy+1, p);
if(border) draw_border(x, y, endx, endy);
/* display the menu */
display_menu(menu, x+1, y+1, count);
/* get the user's response */
choice = get_resp(x+1, y, count, menu, keys);
/* restore the original screen */
restore_video(x, endx+1, y, endy+1, (char *) p);
free(p);
return choice;
}
/* display the menu in its proper location */
void display_menu(menu, x, y, count)
char *menu[];
int x, y, count;
{
register int i;
for(i=0; i<count; i++, x++) {
goto_xy(x, y);
printf(menu[i]);
}
}
void draw_border(startx, starty, endx, endy)
int startx, starty, endx, endy;
{
```

```
register int i;
for(i=startx+1; i<endx; i++) {
goto_xy(i, starty);
putchar(179);
goto_xy(i, endy);
putchar(179);
}
for(i=starty+1; i<endy; i++) {
goto_xy(startx, i);
putchar(196);
goto_xy(endx, i);
putchar(196);
}
goto_xy(startx, starty); putchar(218);
goto_xy(startx, endy); putchar(191);
goto_xy(endx, starty); putchar(192);
goto_xy(endx, endy); putchar(217);
}
/* display a string with specified attribute */
void write_video(x, y, p, attrib)
int x, y;
char *p;
int attrib;
{
union REGS r;
register int i;
for(i=y; *p; i++) {
goto_xy(x, i);
r.h.ah = 9; /* write character function */
r.h.bh = 0; /* assume active display page is 0 */
r.x.cx = 1; /* number of times to write the character */
```

```
r.h.al = *p++; /* character */
r.h.bl = attrib; /* attribute */
int86(0x10, &r, &r);
}
}
/* save a portion of the screen */
void save_video(startx, endx, starty, endy, buf_ptr)
int startx, endx, starty, endy;
unsigned int *buf_ptr;
{
union REGS r;
register int i,j;
for(i=starty; i<endy; i++)
for(j=startx; j<endx; j++) {
goto_xy(j, i);
r.h.ah = 8; /* read character function */
r.h.bh = 0; /* assume active display page is 0 */
*buf_ptr++ = int86(0x10, &r, &r);
putchar(' '); /* clear the screen */
}
}
/* restore a portion of the screen */
void restore_video(startx, endx, starty, endy, buf_ptr)
int startx, endx, starty, endy;
unsigned char *buf_ptr;
{
union REGS r;
register int i,j;
for(i=starty; i<endy; i++)
for(j=startx; j<endx; j++) {
goto_xy(j, i);
```

```
r.h.ah = 9; /* write character function */
r.h.bh = 0; /* assume active display page is 0 */
r.x.cx = 1; /* number of times to write the character */
r.h.al = *buf_ptr++; /* character */
r.h.bl = *buf_ptr++; /* attribute */
int86(0x10, &r, &r);
}
}
/* clear the screen */
void cls()
{
union REGS r;
r.h.ah=6; /* screen scroll code */
r.h.al=0; /* clear screen code */
r.h.ch=0; /* start row */
r.h.cl=0; /* start column */
r.h.dh=24; /* end row */
r.h.dl=79; /* end column */
r.h.bh=7;  /* blank line is blank */
int86(0x10, &r, &r);
}
/* send the cursor to x,y */
void goto_xy(x,y)
int x,y;
{
union REGS r;
r.h.ah=2; /* cursor addressing function */
r.h.dl=y; /* column coordinate */
r.h.dh=x; /* row coordinate */
r.h.bh=0; /* video page */
int86(0x10, &r, &r);
```

```
}
is_in(s, c)
char *s, c;
{
register int i;
for(i=0; *s; i++) if(*s++==c) return i+1;
return 0;
}
void main_menu()
{
int choice, choice1, choice2, choice3;
float value, min, mid, max;
FILE *fp, *fq, *fr;
fr = fopen("c:\\viewdac\\viewdac.ini","w");
fprintf(fr,"%s\n","load.macros.file c:\\sem\\mac\\str_len.mac");
fprintf(fr,"%s\n","run.macro str_len");
fclose(fr);
choice = popup(exercise_type, "tkmix", 5, 1, 5, BORDER);
switch(choice)
{
case 0:
choice1 = popup(force_type, "cv", 2, 5, 10, BORDER);
printf("\n");
if (choice1 == 0)
{
choice2 = popup(active_passive, "ap", 2, 9, 15, BORDER);
printf("\n");
if (choice2 == 0)
{
choice3 = popup(direction, "ub", 2, 13, 20, BORDER);
printf("\n");
```

```
if (choice3 == 0)
{
printf("Enter desired constant force: ");
scanf("%f",&value);
fq = fopen("c:\\sem\\dat\\cforce.dat","w");
fprintf(fq,"%f",value);
fclose(fq);
printf ("\n\n");
printf (" ISOTONIC ACTIVE UNI_DIRECTIONAL with a CONSTANT\n");
printf (" FORCE of %f lbs.\n\n\n",value);
system("c:\\viewdac\\viewdac > nul");
system("cls");
system("c:\\sem\\bin\\str-len.exe c:\\sem\\dat\\hb_pos.dat");
system("c:\\sem\\bin\\ucfv-ext.exe");
system("c:\\sem\\bin\\mkccvtbl.exe");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system("cls");
main_menu();
}
else if (choice3 == 1)
{
printf("Enter desired constant force: ");
scanf("%f",&value);
fq = fopen("c:\\sem\\dat\\cforce.dat","w");
fprintf(fq,"%f",value);
fclose(fq);
```

```
printf ("\n\n");
printf (" ISOTONIC ACTIVE BI_DIRECTIONAL with a CONSTANT\n");
printf (" FORCE of %f lbs.\n\n\n",value);
system("c:\\viewdac\\viewdac > nul");
system("cls");
system("c:\\sem\\bin\\str-len.exe c:\\sem\\dat\\hb_pos.dat");
system("c:\\sem\\bin\\mkccvtbl.exe");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
else if (choice2 == 1)
{
choice3 = popup (direction, "ub", 2, 5, 10, BORDER);
printf("\n");
if (choice3 == 0)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\sem\\bin\\mkccvtbl.exe");
system("c:\\viewdac\\viewdac > nul");
```

```
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocogw);
fclose(fr);
system ("c:\\viewdac\\viewdac > nul");
system ("del c:\\viewdac\\viewdac.ini");
system ("cls");
main_menu();
}
else if (choice3 == 1)
{
printf("Enter desired constant force: ");
scanf("%f",&value);
fq = fopen("c:\\sem\\dat\\cforce.dat","w");
fprintf(fq,"%f",value);
fclose(fq);
printf("Constant force selected : %f\n",value);
system("c:\\sem\\bin\\mkccvtbl.exe");
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
```

```
}
}
}
else if (choice1 == 1)
{
choice2 = popup(active_passive, "ap", 2, 5, 10, BORDER);
printf("\n");
if (choice2 == 0)
{
choice3 = popup(direction, "ub", 2, 5, 10, BORDER);
printf("\n");
if (choice3 == 0)
{
printf("\nEnter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\nForce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
system("c:\\sem\\bin\\mkvcvtbl.exe");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
```

```
system ("c:\\viewdac\\viewdac > nul");
system ("del c:\\viewdac\\viewdac.ini");
system ("cls");
main_menu();
 }
 else if (choice3 == 1)
 {
 printf("\Nenter minimum value of force range desired: ");
 scanf("%f",&min);
 printf("\Nenter mid-value of force range desired: ");
 scanf("%f",&mid);
 printf("\Nenter maximum value of force range desired: ");
 scanf("%f",&max);
 printf ("\Nforce range selected : %f %f %f\n",min,mid,max);
 fq = fopen("c:\\sem\\dat\\vforce.dat","w");
 fprintf(fq,"%f\n%f\n%f\n",min,mid,max);
 fclose(fq);
 system("c:\\viewdac\\viewdac > nul");
 system("cls");
 system("c:\\sem\\bin\\str-len.exe c:\\sem\\dat\\hb_pos.dat");
 system("c:\\sem\\bin\\mkvcvtbl.exe");
 fr = fopen("c:\\viewdac\\viewdac.ini","w");
 fprintf(fr,"%s\n","load.macros.file c:\\sem\\mac\\iso_all.mac");
 fprintf(fr,"%s\n","run.macro load_protocol");
 fclose(fr);
 system ("c:\\viewdac\\viewdac > nul");
 system ("del c:\\viewdac\\viewdac.ini");
 system ("cls");
 main_menu();
 }
 {
```

```
else if (choice2 == 1)
{
choice3 = popup(direction, "ub", 2, 5, 10, BORDER);
printf("\n");
if (choice3 == 0)
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
system("c:\\sem\\bin\\mkvcvtbl.exe");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
{
```

```
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
system("c:\\viewdac\\viewdac > nul");
system("cls");
fq = fopen("c:\\sem\\dat\\vforce.dat","w");
fprintf(fq,"%f\n%f\n%f\n",min,mid,max);
fclose(fq);
system("c:\\sem\\bin\\str-len.exe c:\\sem\\dat\\hb_pos.dat");
system("c:\\sem\\bin\\mkvcvtbl.exe");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
}
break;
case 1:
choice1 = popup(force_type, "cv", 2, 5, 10, BORDER);
printf("\n");
if (choice1 == 0)
{
```

```
choice2 = popup(active_passive, "ap", 2, 5, 10, BORDER);
printf("\n");
if (choice2 == 0)
{
choice3 = popup(direction, "ub", 2, 5, 10, BORDER);
printf("\n");
if (choice3 == 0)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
{
printf("Enter desired constant force: ");
scanf("%f",&value);
printf("Constant force selected : %f\n",value);
```

```
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
else if (choice2 == 1)
{
choice3 = popup(direction, "ub", 2, 5, 10, BORDER);
printf("\n");
if (choice3 == 0)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.ex c:\\sem\\dat\\hb_pos.dat");
```

```
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system("del c:\\viewdac\\viewdac.ini");
system ("cls");
main_menu();
}
else if (choice3 == 1)
{
printf("Enter desred constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
}
```

```
else if (choice1 == 1)
{
choice2 = popup(active_passive, "ap", 2, 5, 10, BORDER);
printf("\n");
if (choice2 == 0)
{
choice3 = popup(direction, "ub", 2, 5, 10, BORDER);
printf("\n");
if (choice3 == 0)
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
```

```
}
else if (choice3 == 1)
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
else if (choice2 == 1)
{
choice3 = popup(direction, "ub", 2, 5, 10, BORDER);
system ("cls");
main_menu();
```

```
}
else if (choice3 == 1)
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
}
break;
case 2:
choice1 = popup(force_type, "cv", 2, 5, 10, BORDER);
printf("\n");
```

```
if (choice1 == 0)
{
choice2 = popup(active_passive, "ap", 2, 5, 10, BORDER);
printf("\n");
if (choice2 == 0)
{
choice3 = popup(direction, "ub", 2, 5, 10, BORDER);
printf("\n");
if (choice3 == 0)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
{
printf("Enter desired constant force: ");
```

```
scanf("%f",&value);
printf("Constant force selected : %f\n",value);
 fq = fopen("c:\\sem\\dat\\cforce.dat","w");
 fprintf(fq,"%f",value);
 fclose(fq);
 system("c:\\viewdac\\viewdac > nul");
 system("cls");
 system("c:\\sem\\bin\\str-len.exe c:\\sem\\dat\\hb_pos.dat");
 fr = fopen("c:\\viewdac\\viewdac.ini","w");
 fprintf(fr,"%s\n","load.macros.file c:\\sem\\mac\\iso_all.mac");
 fprintf(fr,"%s\n","run.macro load_protocol");
 fclose(fr);
 system ("c:\\viewdac\\viewdac > nul");
 system ("del c:\\viewdac\\viewdac.ini");
 system ("cls");
 main_menu();
 }
 }
 else if (choice2 == 1)
 {
 choice3 = popup(direction, "ub", 2, 5, 10, BORDER);
 printf("\n");
 if (choice3 == 0)
 {
  printf("Enter desired constant force: ");
  scanf("%f",&value);
  printf("Constant force selected : %f\n",value);
  fq = fopen("c:\\sem\\dat\\cforce.dat","w");
  fprintf(fq,"%f",value);
  fclose(fq);
  system("c:\\viewdac\\viewdac > nul");
```

```
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
```

```
}
}
}
else if (choice1 == 1)
{
choice2 = popup(active_passive, "ap", 2, 5, 10, BORDER);
printf("\n");
if (choice2 == 0)
{
choice3 = popup(direction, "ub", 2, 5, 10, BORDER);
printf("\n");
if (choice3 == 0)
{
printf("Enter desired constant force: ");
scanf("%f",&value);
printf("Constant force selected : %f\n",value);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
 {
 printf("Enter desired constant force: ");
```

```
scanf("%f",&value);
printf("Constant force selected : %f\n",value);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
else if (choice2 == 1)
{
choice3 = popup(direction, "ub", 2, 5, 10, BORDER);
printf("\n");
if (choice3 == 0)
{
printf("Enter desired constant force: ");
scanf("%f",&value);
printf("Constant force selected : %f\n",value);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
```

```
system ("c:\\viewdac\\viewdac > nul");
system ("del c:\\viewdac\\viewdac.ini");
system ("cls");
main_menu();
}
else if (choice3 == 1)
{
printf("Enter desired constant force: ");
scanf("%f",&value);
printf("Constant force selected : %f\n",value);
system("c:\\viewdac\\viewdac > nul");
 system("cls");
 system("c:\\sem\\bin\\str-len.exe c:\\sem\\dat\\hb_pos.dat");
 fr = fopen("c:\\viewdac\\viewdac.ini","w");
 fprintf(fr,"%s\n","load.macros.file c:\\sem\\mac\\iso_all.mac");
 fprintf(fr,"%s\n","run.macro load_protocol");
 fclose(fr);
 system ("c:\\viewdac\\viewdac > nul");
 system ("del c:\\viewdac\\viewdac.ini");
 system ("cls");
 main_menu();
 }
 }
 }
 break;
 case 3:
 choice1 = popup(force_type, "cv", 2, 5, 10, BORDER);
 printf("\n");
 if (choice1 == 0)
 {
```

```
choice2 = popup(active_passive, "ap", 2, 5, 10, BORDER);
printf("\n");
if (choice2 == 0)
{
choice3 = popup(direction, "ub", 2, 5, 10, BORDER);
printf("\n");
if (choice3 == 0)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
{
printf("Enter desired constant force: ");
scanf("%f",&value);
printf("Constant force selected : %f\n",value);
```

```
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
else if (choice2 == 1)
{
choice3 = popup(direction, "ub", 2, 5, 10, BORDER);
printf("\n");
if (choice3 == 0)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
```

```
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
{
printf("Enter desired constant force: ");
scanf("%f",&value);
printf("Constant force selected : %f\n",value);
fq = fopen("c:\\sem\\dat\\cforce.dat","w");
fprintf(fq,"%f",value);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
}
```

```
else if (choice1 == 1)
{
choice2 = popup(active_passive, "ap", 2, 5, 10, BORDER);
printf("\n");
if (choice2 == 0)
{
choice3 = popup(direction, "ub", 2, 5, 10, BORDER);
printf("\n");
if (choice3 == 0)
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
```

```
}
else if (choice3 == 1)
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
else if (choice2 == 1)
{
choice3 = popup(direction, "ub", 2, 5, 10, BORDER);
printf("\n");
if (choice3 == 0)
```

```
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
else if (choice3 == 1)
{
printf("\Nenter minimum value of force range desired: ");
scanf("%f",&min);
printf("\Nenter mid-value of force range desired: ");
scanf("%f",&mid);
printf("\Nenter maximum value of force range desired: ");
scanf("%f",&max);
```

```
printf ("\Nforce range selected : %f %f %f\n",min,mid,max);
fq = fopen("c:\\sem\\dat\\vforce.dat","w");
fprintf(fq,"%f\n%f\n%f\n",min,mid,max);
fclose(fq);
system("c:\\viewdac\\viewdac > nul");
system("cls");
system("c:\\sem\\bin\\str-len.exe c:\\sem\\dat\\hb_pos.dat");
fr = fopen("c:\\viewdac\\viewdac.ini","w");
fprintf(fr,"%s\n","load.macros.file c:\\sem\\mac\\iso_all.mac");
fprintf(fr,"%s\n","run.macro load_protocol");
fclose(fr);
system ("c:\\viewdac\\viewdac > nul");
system ("del c:\\viewdac\\viewdac.ini");
system ("cls");
main_menu();
}
}
}
break;
case 4:
system("del c:\\viewdac\\viewdac.ini");
system("cls");
printf ("\nGoodBye...\n");
break;
}
} /* end main_menu() */
void main()
{
cls();
goto_xy(0,0);
system("cls");
```

```
main_menu();

}
```

The algorithm successfully manages the selection of the desired protocol thereby invoking the sequence, shown below in Appendix B, in order to measure the stroke length of the user in the viewdac.

Appendix B

```
/*****************************************************************

CODE TO MEASURE THE STROKE LENGTH OF THE USER

This driver uses the machine language library of DAS20

This code uses TurboC++ compiler

*****************************************************************/

#include <stdio.h>

#define CONVERT 0.00488

int init()

{

int error;

int mode = 0;

int data[3];

data[0] = 0x300;

data[1] = 2;

data[2] = 1;

error= das20(mode, data);

return error;

}

int queue(int input1, int input2, int input3)

{

int mode = 1;

int data[3];

int error;
```

```
data[0] = input1;
data[1] = input2;
data[2] = input3;
error = das20(mode, data);
return error;
}
freq()
{
int mode = 24;
int data[3];
int error;
data[0] = 5000;  //will give a freq of
data[1] =0;          // 1kHz
error = das20(mode, data);
return error;
}
main() // function to perform A/D conversions through mode 4
{
int mode =4;
int break1 = 1;
int break2 = 1;
float max, min;
FILE *fp, *fq;
int error;
int array[3000];
float user_data[3000];
int *r = array;
float *q = user_data;
int data[4];
int i;
if ((fp = fopen("c:\\tc\\manish\\data_st", "w")) == NULL)
```

```
{
puts("cannot open file\n");
exit(0);
}
if ((fq = fopen("c:\\tc\\manish\\str_par", "w")) == NULL)
{
puts("cannot open file\n");
exit(0);
}
data[0] = 3000;
data[1] = offadr(array);
data[2] = 2;
data[3] = 1;
if((init()) !=0)        //call to das20 mode0
{
printf("error # %d has occurred in mode 0\n", init());
exit(0);
}
if ((queue(0,1,1)) !=0)  // call the queue for ato d converion
{
printf("error # %d has occurred in mode 1\n", queue(1,1,1));
exit(0);
}
if ((freq()) !=0)       // frequency of data collection
{
printf("error # %d has occurred in mode 24\n", freq());
exit(0);
}
printf("\t to calculate the stroke length, do an upward stroke \n");
printf("\t followed by a backward stroke and terminated by a \n");
printf("\t forward stroke \n");
```

```
printf("hit any key to start the measurement\n");

 if (getchar())

 {

 printf("the do while loop has begun\n");

 if ((error = das20(mode, data)) !=0)     // call to mode 4 for data acquisition

 {

 printf("error # %d has occurred while loading mode 4\n", error);

 }

 for(i=0; i<3000; i++)      // store the data on the hard disk and convert

 {                          // the data from bits to voltages

 *(q+i) = (*(r+i))*CONVERT;

 fprintf(fp, "%f\n", *(q+i));

 }

 for (i=0; i<3000; i++)

 {

 if(*(q+i) < *(q+i+1));

 else

 {

 if(*(q+i) >= *(q+i+1) && *(q+i)>=*(q+i+2) && *(q+i)>=*(q+i+3)

 && *(q+i) >= *(q+i+4) && *(q+i) >= *(q+i+5) &&

 *(q+i) >= *(q+i+6) && *(q+i) >= *(q+i+7) &&

 *(q+i) >= *(q+i+8) && *(q+i) >= *(q+i+9))

 {

 max = *(q+i);

 fprintf(fq, "Maximum point = %f\n", max);

 break1=0;

 break;

 }

 }

 }
```

```
if (break1!=0)
{
printf("the minimum point could not be found\n");
}
// let's calculate the minimum point
for (; i<3000; i++)
{
if(*(q+i) > *(q+i+1));
else
{
if(*(q+i) <= *(q+i+1) && *(q+i)<=*(q+i+2) && *(q+i)<=*(q+i+3)
&& *(q+i) <= *(q+i+4) && *(q+i) <= *(q+i+5) &&
*(q+i) <= *(q+i+6) && *(q+i) <= *(q+i+7) &&
*(q+i) <= *(q+i+8) && *(q+i) <= *(q+i+9))
{
 min = *(q+i);
 fprintf(fq, "Minimum point = %f\n", min);
 break2 = 0;
 break;
 }
 }
 }
 if (break2!=0)
 {
 printf("the maximum point could not be found\n");
 }
 }
 fclose(fp);
 fclose(fq);
 return *r;
 }
```

It then evaluates the maximum and minimum points in the data collected by the viewdac, thus, completing the measurement of the stroke length. This is followed by the system call to thee viewdac which then loads the sequence file, as shown below in Appendix C, pertaining to the protocol selected by the user.

Appendix C

```
/*********************************************************************

DRIVER FOR ISOTONIC, ACTIVE, UNI-DIRECTIONAL EXERCISE

This code uses machine language library of DAS20

This code uses TurboC++ compiler

*********************************************************************/

#include <stdio.h>

#include <math.h>

#define CONV 204.8

#define I_CONV 0.00244

#define A_STRAIN 0.01869

#define B_STRAIN 0.41065

int array[10000];

int *p = array;

int init()      //function to initialize the das20

{

int error;

int mode = 0;

int data[3];

data[0] = 0x300;

data[1] = 2;

data[2] = 1;

error= das20(mode, data);

if(error)

{

printf("error #%d in mode 0\n", error);
```

```
exit(0);
}
return 0;
}
int queue(input1, input2, input3)     //function to set the queue for A/D
int input1;
int input2;
int input3;
{
int mode = 1;
int data[3];
int error;
data[0] = input1;
data[1] = input2;
data[2] = input3;
error = das20(mode, data);
if(error)
{
printf("error #%d in mode 1\n", error);
exit(0);
}
return 0;
}
int freq()     //function to set the frequency for A/D collection
{
int mode = 24;
int data[3];
int error;
long int temp;
printf("enter the frequency that you want to collect the data at \n");
scanf("%ld", &temp);
```

```
data[0] = (int)(5000000/temp);
data[1] =0;
printf("the value of the temp is %ld\n", temp);
printf("the value of the divisor is %d\n", data[0]);
error = das20(mode, data);
if(error)
{
printf("error #%d in mode 24\n", error);
 exit(0);
 }
 return 0;
 }
 int mode7(ch, volt)  //function for D/A, also converts volts into bits
 int ch;
 float volt;
 {
 int error;
 int mode=7;
 int data[2];
 data[0] = ch;
 data[1] = volt*CONV;      // conversion to bits
 //printf("the value of the volt is %d\n", data[1]);
 error = das20(mode, data);
 if(error)
 {
 printf("error #%d in mode 7\n", error);
 exit(0);
 }
 return 0;
 }
```

```
int dout(digital)       // value of digital is in bits
int digital;
{
int mode = 15;
int error;
int data[1];
data[0] = digital;
error = das20(mode, data);
if(error)
{
printf("error #%d in mode 15\n", error);
exit(0);
}
return 0;
}
int initialize()        // function to initialize digital outputs and D/A's
{
init();                 //load the das20
freq();                 // load the frequecny for A/D
dout(0);                // initialize the digital outputs
queue(0,3,2);           // call to load channel 0 (force)(first entry therefore 2)
queue(1,3,1);           //load channel 1 (last entry therefore 1)
return 0;
}
int mode4(offset)       // call to function with offset from the beginning
int offset;
{
int error;
int mode =4;
int data[4];
data[0] =2;   // collect two points every time
```

```
data[1] = offadr(array+offset);
data[2] = 2;  // sampling rate set via mode 24;
data[3] = 1;  // data from bipolar input
error = das20(mode, data);
if (error)
{
printf("error #%d in mode 4\n", error);
exit(0);
}
return 0;
}
int mode26()
int mode=26;
int data[1];
int error;
data[0] = 0;
error = das20(mode,data);
if (error)
{
printf("error #%d in mode 26\n", error);
exit(0);
}
return 0;
}
// Some necessary mathematical functions
float load_strain(force)      // function to convert force into strain
float force;
{
float strain = A_STRAIN*force + B_STRAIN; // equation: ax+b
return strain;
}
```

```
float str_volt(strain) // returns the MPC volt for desired strain for quadratic equation
loat strain;
{
float a,b,c,d,e, volt, A, B, C, temp, root1, root2;
 a = -9.5748;
 b = 15.9598;
 c = -36.2933;
 d = 0.01869;
 e = 0.41064;
 A = d*a;
 B = d*b;
 C = d*c +e -strain;
 printf("the value of the strain %f\n", strain);
 temp = sqrt(B*B - 4*A*C);
 root1 = (-B + temp)/(2*A);
 root2 = (-B -temp)/(2*A);
 printf("A = \t%f\n B = \t%f\n C = \t%f\n temp = \t%f\n root1 = \t%f\n root2 =
 \t%f\n ", A, B, C, temp, root1, root2);
 volt = root1> 1 ? root1 : root2;   // root =1 is the point of symmetry
 if (volt <0)
 {
 printf("something wrong here\n");
 exit(0);
 }
 return volt;
 }
 float convert(bits) //function to convert bits into bipolar data
 int bits;
 {
 float volt;
 volt = bits*I_CONV;
 return volt;
```

```
}
int find_case(arg)
float arg;
{
int arg_case;
if (arg > -0.31057 && arg <= 2.0)
{
arg_case =1;
}
else if(arg > -0.70185 && arg <= -0.31057)
{
arg_case = 2;
}
else if( arg > -1.3222 && arg <= -0.70185)
{
arg_case = 3;
}
else if (arg > -3.0 && arg <= -1.3222)
{
arg_case = 4;
}
else
{
printf("the value of the strain %f has gone beyond limits\n", arg);
arg_case =0;
}
return arg_case;
}
float eqn1(argm)
float argm;
{
```

```
float volt;
volt = -4.93127*argm + 0.26849;
return volt;
}
float eqn2(argm)
float argm;
{
float volt;
volt = -2.0446*argm + 1.1650;
return volt;
}
float eqn3(argm)
float argm;
{
float volt;
volt = -1.2896*argm + 1.6949;
return volt;
}
float eqn4(argm)
float argm;
{
float volt;
volt = -0.9746*argm + 2.113;
return volt;
}
float abso(number)
float number;
{
float temp;
if (number < 0)
{
```

```
temp = (-number);
}
else
{
temp = number;
}
return temp;
}
float call(str, value) //a pointer to function is the argument
float (*str)();
float value;
{
float result;
result = (*str)(value);
return result;
}
float last(argu)
int argu;
{
float last_value;
switch(argu)
{
case 1:
last_value = -0.31057;
break;
case 2:
last_value = -0.70185;
break;
case 3:
last_value = -1.3222;
break;
```

```
case 4:
last_value = -1.9378;
break;
default:
printf("unrecognized case %d in last value function\n", argu);
exit(0);
}
return last_value;
}
float first(argu)
int argu;
{
float first_value;
switch(argu)
{
case 1:
first_value = -0.14834;
break;
case 2:
first_value = -0.31057;
break;
case 3:
first_value = -0.70185;
break;
case 4:
first_value = -1.3222;
break;
default:
printf("unrecognized case %d in first value function\n", argu);
exit(0);
}
```

```
return first_value;
}
float co_diff(value1, value2, a_case, b_case)
float value1;
float value2;
int a_case;
int b_case;
{
float *z;
float *func[4];
int i;
float temp1, temp2;
float add[4];
float total =0;
func[0] = (float *)eqn1;
func[1] = (float *)eqn2;
func[2] = (float *)eqn3;
func[3] = (float *)eqn4;
add[0]= 0;
add[1] = 0;
add[2] = 0;
add[3] = 0;
temp1 = last(a_case);
z = func[a_case-1];
add[a_case-1] = call(z, temp1) - call(z, value1);
temp2 = first(b_case);
z = func[b_case-1];
add[b_case-1] = call(z, value2) - call(z, temp2);
for(i=a_case+1; i<b_case; i++)
{
temp1 = first(i);
```

```
temp2 = last(i);
z = func[i-1];
add[i-1] = call(z, temp2) - call(z, temp1);
}
for(i=0; i<4; i++)
{
total += add[i];
}
return abso(total);
}
float pos_update(actual, desired) //desired force is more than the actual
float actual;
float desired;
{
float *z;
float *func[4];
float temp, change;
int actual_case = find_case(actual);
int desired_case = find_case(desired);
func[0] = (float *)eqn1;
func[1] = (float *)eqn2;
func[2] = (float *)eqn3;
func[3] = (float *)eqn4;
if(actual_case == desired_case)
{
z = func[actual_case-1];
temp = call(z, actual) - call(z, desired); //eqn gives values
change = abso(temp);
}
else if(actual_case ==0 || desired_case ==0) //values gone beyond range
{
```

```
change = 0;
}
else
{
temp= co_diff(actual, desired, actual_case, desired_case);
change = abso(temp);
 }
 return change;
 }
 main()
 {
 float for_d, init_mpc, strain_d, step, temp1, temp2, check, dodo, dud;
 int i,j, index;
 int waste;
 float update[5000];
 float *q = update;
 FILE *fp, *fq, *fr;
 if ((fp = fopen("c:\\tc\\manish\\force.mat", "w")) == NULL)
 {
 puts("cannot open file 1\n");
 exit(0);
 }
 if ((fq = fopen("c:\\tc\\manish\\postn.mat", "w")) == NULL)
 {
 puts("cannot open file 2\n");
 exit(0);
 }
 if ((fr = fopen("c:\\tc\\manish\\volts.mat", "w")) == NULL)
{
puts("cannot open file 3\n");
exit(0);
```

```
}
initialize();          // execute the initialize function
printf("this is the palce\n");
printf("enter the constant force desired\n");
scanf("%f", &for_d);
printf("value entered %f\n", for_d);
printf("hit any key to start the exercise\n");
dout(7);       //start the motor and the MPC
mode7(0,9.0);        //send -9 volts to the motor
scanf("%c", &waste);
strain_d = load_strain(for_d);      //convert the force into strain
printf("load entered %f\n", for_d);
printf("strain calculated %f\n", strain_d);
init_mpc = str_volt(strain_d);      //calculate the MPC volts for desired strain
mode7(1, init_mpc);          // start the MPC with the initial voltage
update[0] = init_mpc;
printf("the initial voltage is %f or %f\n", update[0], *q);
printf("the loop has been reached\n");
for(i=0; !kbhit() && i<9990; i+=2) // now our looping starts & stop when key hit
{
mode4(i);
check = convert(*(p+i));
index = (i/2 +1);
if(check > strain_d)         //actual strain is less than desired
{
dodo = pos_update(check, strain_d); //force is less so increase he volt
if(dodo ==0)
{
break;
}
update[index] = update[index -1] + dodo;
```

```
if(update[index] > 3.5)
{
update[index] = 3.5;
}
else if(update[index] < 0.0)
{
update[index] = 0.1;
}
step = (update[index] - update[index-1])/500;
if(step ==0.0)
{
mode7(1, update[index-1]);
fprintf(fr, "%f\n", update[index-1]);
}
else
{
for (update[index-1]; update[index-1] <= update[index]; update[index-1] += step)
{
mode7(1, update[index-1] ); // send the updated voltage
fprintf(fr, "%f\n", update[index-1]);
}
}
}
else if(check < strain_d)   // actual strain is more than desired
{
temp1= check;       // swap the parameters to function call
temp2 = strain_d;
dodo = pos_update(temp2, temp1);
if(dodo ==0)
{
break;
}
```

```
update[index] = update[index-1] - dodo;
if(update[index] > 3.5)
{
update[index] = 3.5;
}
else if(update[index] < 0.0)
{
update[index] = 0.1;
}
step = (update[index-1] - update[index])/500;
if(step==0)
{
mode7(1,update[index-1]);
fprintf(fr, "%f\n", update[index-1]);
}
else
{
for (update[index-1]; update[index-1] >= update[index]; update[index-1] -= step)
{
mode7(1, update[index-1] );
fprintf(fr, "%f\n", update[index-1]);
}
}
}
else
{
continue;      // the two values are the same
}
printf("the value of index for this loop is %d\n", index);
}
printf("the last value of i is %d\n", i);
```

```
dout(0);
mode26();
for (j=0; j<i; j +=2)
{
fprintf(fp, "%f\n", convert(*(p+j))); // convert force into volts and write
fprintf(fq, "%f\n", convert(*(p+j+1))); // convert position into volts and write
}
fclose(fp);
fclose(fq);
fclose(fr);
return;
}
```

The algorithm also manages the large data files generated by the viewdac thereby facilitating record maintenance of a frequent user. These data files also form an excellent source to comment on user performance and can be used as performance indicators in the long run.

FIGS. 4, 5(*a*), 5(*b*), 5(*c*) and 5(*d*) show the flow chart of the user interface in C programming language and a typical sequence file, shown below, created from the macros of the viewdac.

TYPICAL SEQUENCE

```
        START_PROG:                                  /* START OF PROGRAM */

1   1   DO;

        /* DEFAULT 8051 DECLARATIONS */
        $INCLUDE (:F0:REG51.DCL)
    =   /*  REGISTER DECLARATIONS FOR 8051 */
    =
2   1 = DECLARE REG  LITERALLY 'REGISTER';
    =
    =   /********** BYTE REGISTERS ********/
3   1 = DECLARE
    =     P0   BYTE  AT(80H)  REG,
    =     P1   BYTE  AT(90H)  REG,
    =     P2   BYTE  AT(0A0H) REG,
    =     P3   BYTE  AT(0B0H) REG,
    =     PSW  BYTE  AT(0D0H) REG,
    =     ACC  BYTE  AT(0E0H) REG,
    =     B    BYTE  AT(0F0H) REG,
    =     SP   BYTE  AT(81H)  REG,
    =     DPL  BYTE  AT(82H)  REG,
    =     DPH  BYTE  AT(83H)  REG,
    =     PCON BYTE  AT(87H)  REG,
```

```
=     TCON BYTE  AT(88H)  REG,
=     TMOD BYTE  AT(89H)  REG,
=     TL0  BYTE  AT(8AH)  REG,
=     TL1  BYTE  AT(8BH)  REG,
=     TH0  BYTE  AT(8CH)  REG,
=     TH1  BYTE  AT(8DH)  REG,
=     IE   BYTE  AT(0A8H) REG,
=     IP   BYTE  AT(0B8H) REG,
=     SCON BYTE  AT(98H)  REG,
=     SBUF BYTE  AT(99H)  REG;
=
=
=   /********* BIT REGISTERS ********/
=
=    /********* PSW  BITS ********/
4  1 =  DECLARE
=     CY   BIT  AT(0D7H) REG,
=     AC   BIT  AT(0D6H) REG,
=     F0   BIT  AT(0D5H) REG,
=     RS1  BIT  AT(0D4H) REG,
=     RS0  BIT  AT(0D3H) REG,
=     OV   BIT  AT(0D2H) REG,
=     P    BIT  AT(0D0H) REG,
=
=    /********* TCON BITS ********/
=     TF1  BIT  AT(8FH)  REG,
=     TR1  BIT  AT(8EH)  REG,
=     TF0  BIT  AT(8DH)  REG,
=     TR0  BIT  AT(8CH)  REG,


=     IE1  BIT  AT(8BH)  REG,
=     IT1  BIT  AT(8AH)  REG,
=     IE0  BIT  AT(89H)  REG,
=     IT0  BIT  AT(88H)  REG,
=
=    /*********  IE  BITS ********/
=     EA   BIT  AT(0AFH) REG,
=     ES   BIT  AT(0ACH) REG,
=     ET1  BIT  AT(0ABH) REG,
=     EX1  BIT  AT(0AAH) REG,
=     ET0  BIT  AT(0A9H) REG,
=     EX0  BIT  AT(0A8H) REG,
=
=    /*********  IP  BITS ********/
=     PS   BIT  AT(0BCH) REG,
=     PT1  BIT  AT(0BBH) REG,
=     PX1  BIT  AT(0BAH) REG,
=     PT0  BIT  AT(0B9H) REG,
=     PX0  BIT  AT(0B8H) REG,
=
=    /*********  P3  BITS ********/
=     RD   BIT  AT(0B7H) REG,
=     WR   BIT  AT(0B6H) REG,
=     T1   BIT  AT(0B5H) REG,
=     T0   BIT  AT(0B4H) REG,
=     INT1 BIT  AT(0B3H) REG,
=     INT0 BIT  AT(0B2H) REG,
=     TXD  BIT  AT(0B1H) REG,
=     RXD  BIT  AT(0B0H) REG,
=
=    /********* SCON BITS ********/
=     SM0  BIT  AT(9FH)  REG,
=     SM1  BIT  AT(9EH)  REG,
=     SM2  BIT  AT(9DH)  REG,
=     REN  BIT  AT(9CH)  REG,
=     TB8  BIT  AT(9BH)  REG,
=     RB8  BIT  AT(9AH)  REG,
=     TI   BIT  AT(99H)  REG,
=     RI   BIT  AT(98H)  REG;

    /* TABLE DECLARATIONS */
    $INCLUDE (:F1:TABLE.DCL)
```

```
      =  /* THIS FILE CONTAINS THE LOOKUP TABLES USED BY SEM.PLM */
      =
      =  /* TABLE - STRAIN VRS FORCE IN LBS */
5   1 =  DECLARE STR$FOR$TAB (512) WORD CONSTANT(
      =  289, 288, 287, 286, 285, 284, 283, 282, 281, 280, 279, 277, 276, 275, 274, 273,
      =  272, 271, 270, 269, 268, 267, 266, 265, 264, 263, 262, 261, 260, 259, 258, 257,
      =  256, 254, 253, 252, 251, 250, 249, 248, 247, 246, 245, 243, 242, 241, 240, 239,
      =  238, 237, 236, 235, 234, 233, 232, 230, 229, 228, 227, 226, 225, 224, 223, 222,
      =  221, 220, 219, 218, 217, 216, 215, 214, 213, 212, 211, 210, 209, 207, 206, 205,
      =  204, 203, 202, 201, 200, 199, 198, 197, 196, 195, 194, 193, 192, 191, 190, 189,
      =  188, 187, 186, 184, 183, 182, 181, 180, 179, 178, 177, 176, 175, 174, 173, 172,
      =  171, 170, 169, 168, 167, 165, 166, 165, 164, 163, 161, 160, 159, 158, 157, 156,
      =  155, 154, 153, 152, 151, 150, 149, 148, 147, 146, 145, 144, 143, 142, 141, 140,
      =  139, 137, 136, 135, 134, 133, 132, 131, 130, 129, 128, 127, 126, 125, 124, 123,
      =  122, 121, 120, 119, 118, 117, 116, 114, 113, 112, 111, 110, 109, 108, 107, 106,


      =  105, 104, 103, 102, 101, 100, 99,  98,  97,  96,  95,  94,  93,  91,  90,  89,
      =  88,  87,  86,  85,  84,  83,  82,  81,  80,  79,  78,  77,  76,  75,  74,  73,
      =  72,  71,  70,  68,  67,  66,  65,  64,  63,  62,  61,  60,  59,  58,  57,  56,
      =  55,  54,  53,  52,  51,  50,  49,  48,  47,  46,  44,  43,  42,  41,  40,  39,
      =  38,  37,  36,  35,  34,  33,  32,  31,  30,  29,  28,  27,  26,  25,  24,  23,
      =  21,  20,  19,  18,  17,  16,  15,  14,  13,  12,  11,  10,  9,   8,   7,   6,
      =  5,   4,   3,   2,   1,   0);
      =
      =  /* TABLE - STRAIN VRS CLUTCH VOLTAGE */
6   1 =  DECLARE STR$CL$TAB (512) BYTE CONSTANT(
      =  255, 255, 255, 255, 255, 255, 255, 255, 255, 255, 255, 255, 255, 255, 255, 255,
      =  255, 255, 255, 255, 255, 255, 255, 255, 255, 255, 255, 255, 255, 255, 255, 255,
      =  255, 255, 255, 255, 255, 255, 255, 255, 255, 255, 255, 255, 255, 255, 255, 255,
      =  255, 255, 255, 255, 255, 255, 255, 255, 255, 255, 255, 255, 255, 255, 255, 255,
      =  255, 255, 255, 255, 255, 255, 255, 255, 255, 255, 255, 255, 255, 255, 255, 255,
      =  255, 255, 255, 255, 255, 255, 255, 255, 255, 255, 255, 255, 255, 254, 253,
      =  252, 251, 250, 250, 249, 248, 248, 247, 246, 246, 245, 244, 243, 243, 242, 241,
      =  241, 240, 239, 238, 238, 237, 236, 236, 235, 234, 233, 233, 232, 231, 230, 229,
      =  229, 228, 227, 226, 226, 225, 224, 223, 222, 222, 221, 220, 219, 218, 218, 217,
      =  216, 215, 214, 214, 213, 212, 210, 209, 208, 208, 207, 206, 205, 204, 203, 202,
      =  201, 201, 200, 199, 198, 197, 196, 195, 194, 193, 192, 191, 190, 189, 188, 187,
      =  186, 185, 184, 183, 182, 181, 180, 179, 178, 177, 176, 175, 174, 173, 172, 171,
      =  169, 168, 167, 166, 165, 164, 163, 161, 160, 159, 158, 156, 155, 154, 153, 151,
      =  150, 149, 147, 146, 145, 143, 142, 140, 139, 137, 136, 134, 133, 131, 130, 128,
      =  126, 124, 123, 121, 119, 117, 115, 113, 111, 109, 107, 105, 102, 100, 97,  95,
      =  92,  89,  86,  2,   6,   10,  15,  20,  28,  0);

7   1    DECLARE DECL LITERALLY 'DECLARE';

         /* FOR 8255 */
8   1    DECL PA_A BYTE AT (0FFFCH) AUXILIARY;
9   1    DECL PB_A BYTE AT (0FFFDH) AUXILIARY;
10  1    DECL PC_A BYTE AT (0FFFEH) AUXILIARY;
11  1    DECL CTRL_8255A BYTE AT (0FFFFH) AUXILIARY;
12  1    DECL PA_B BYTE AT (0FFF8H) AUXILIARY;
13  1    DECL PB_B BYTE AT (0FFF9H) AUXILIARY;
14  1    DECL PC_B BYTE AT (0FFFAH) AUXILIARY;
15  1    DECL CTRL_8255B BYTE AT (0FFFBH) AUXILIARY;
16  1    DECL DISP_DR BYTE AT (.PA_B) AUXILIARY;

         /* FOR 8031 */
17  1    DECL
         SOC BIT AT (090H) REG,
         EOC BIT AT (091H) REG,
         D_MOTOR BIT AT (092H) REG,
         D_CLUTCH BIT AT (093H) REG,
         D_FAN BIT AT (094H) REG,
         DISP_RS BIT AT (095H) REG,
         DISP_RW BIT AT (096H) REG,
         DISP_EN BIT AT (097H) REG,
         KBD_AVAIL BIT AT (0B2H) REG,
         KBD_EN BIT AT (0B5H) REG;

         /* OTHER DECLARATIONS */
18  1    DECL (ENT_VAL,EXER_TYPE) BYTE;
```

```
19  1     DECL (START,ENTER) BIT;
20  1     DECL (MOT_VOLT,CL_VOLT) BYTE;


21  1     DECL (AD_STRAIN,AD_POSTN) WORD;
22  1     DECL ERROR (2) WORD;

          /* ALL PROCEDURES ARE DECLARED BELOW */

23  2     INIT_SYSTEM: PROCEDURE;                          /* INITIALISES THE SYSTEM */
24  2         IE=10000001B;
25  2         IP=0;
26  2         TCON=0;
27  2         TMOD=0;
28  2         SCON=0;
29  2         PCON=0;
30  2         CTRL_8255A=10011000B;
31  2         CTRL_8255B=10000010B;
32  2         EOC=1;                                       /* CONFIGURE P1.1 FOR INPUT */
33  1     END INIT_SYSTEM;

34  2     INIT_VAR: PROCEDURE;                             /* INTIALISES VARIABLES */
35  2         START=0;
36  2         MOT_VOLT, CL_VOLT=0;                         /* PUT INITIAL VALUES HERE */
37  2         ERROR(0), ERROR(1)=0;                        /* INITIALISE ERRORS */
38  1     END INIT_VAR;

          /* DISPLAY ROUTINES */
39  2     DISP_FLAG: PROCEDURE (CHAR, RS_BIT);             /* CHECKS DISPLAY BUSY FLAG */
40  2         DECL CHAR BYTE, RS_BIT BIT;
41  2         CTRL_8255B=CTRL_8255B OR 00010000B;
42  2         DISP_EN=1;                                   /* STROBE TO ENABLE DISPLAY */
43  2         DISP_EN=0;                                   /* NEGATIVE EDGE ENABLE */
44  3         DO WHILE (BOOLEAN(ROL(DISP_DR,1))=1);        /* WAIT FOR THE DISPLAY */
45  3             DISP_EN=1;                               /* STROBE TO ENABLE DISPLAY */
46  3             DISP_EN=0;                               /* NEGATIVE EDGE ENABLE */
47  3         END;
48  2         CTRL_8255B=CTRL_8255B AND 11101111B;
49  2         DISP_EN=1;
50  2         DISP_RW=0;
51  2         DISP_RS=RS_BIT;
52  2         DISP_DR=CHAR;
53  2         DISP_EN=0;
54  2         DISP_EN=1;
55  2         DISP_RS=0;
56  1     END DISP_FLAG;

57  2     DISP_INIT: PROCEDURE;                            /* INITIALISES DISPLAY */
58  2         DECL DISP_COMM BYTE;
59  2         CTRL_8255B=CTRL_8255B AND 11101111B;
60  2         DISP_RS, DISP_RW=0;
61  2         DISP_COMM=03FH;
62  2         CALL DISP_FLAG (DISP_COMM,0);
63  2         DISP_COMM=0EH;
64  2         CALL DISP_FLAG (DISP_COMM,0);
65  2         DISP_COMM=07H;
66  2         CALL DISP_FLAG (DISP_COMM,0);
67  2         DISP_COMM=01H;
68  2         CALL DISP_FLAG (DISP_COMM,0);
69  2         DISP_RS=1;
70  1     END DISP_INIT;


71  2     DISP_CHAR: PROCEDURE (CHAR);                     /* DISPLAYS A CHARACTER */
72  2         DECL CHAR BYTE;
73  2         CALL DISP_FLAG(CHAR,1);
74  1     END DISP_CHAR;

75  2     DISPLAY: PROCEDURE (ADDR1,ADDR2);                /* DISPLAYS 2 LINES */
76  2         DECL (ADDR1, ADDR2) WORD;
77  2         DECL (STR1 BASED ADDR1)(16) BYTE;
78  2         DECL (STR2 BASED ADDR2)(16) BYTE;
79  2         DECL I BYTE;
80  3         DO I=0 TO 15;
81  3             CALL DISP_CHAR (STR1(I));
```

```
 82  3        END;
 83  3        DO I=0 TO 15;
 84  3            CALL DISP_CHAR (STR2(I));
 85  3        END;
 86  1    END DISPLAY;

          /* KEYBOARD ROUTINES */
 87  2    GET_INPUT: PROCEDURE;                          /* KEYBOARD ENTRY ROUTINE */
 88  2        ENTER=0;
 89  2        ENT_VAL=0;
 90  3        DO WHILE ENTER=0;                          /* WAIT FOR ENTER KEY */
 91  3        END;
 92  1    END GET_INPUT;

 93  2    KEYBOARD: PROCEDURE INTERRUPT 0;               /* INTERRUPT FOR KEYBOARD */
 94  2        DECL KEY_IN BYTE;
 95  2        DISABLE;                                   /* DISABLE INTERRUPTS */
 96  2        KEY_IN=SHR(SHL(PB_B,4),4);                 /* KEY DECODING */

 97  2        IF KEY_IN<10 THEN                          /* NUMERIC KEYS */
 98  3            DO;
 99  3                ENT_VAL=ENT_VAL*10+KEY_IN;         /* UPDATE KEYED IN VALUE */
100  3                CALL DISP_CHAR (KEY_IN+30);        /* DISPLAY ENTERED KEY */
101  3            END;
102  2        ELSE
                  DO CASE (KEY_IN - 10);                 /* CHECK FOR FUNCTION KEYS */
103  4                DO;                                /* START KEY */
104  4                    IF START <> 1 THEN START=1;
106  4                    ENTER=1;
107  4                END;
108  4                DO;                                /* CLEAR KEY */
109  4                    ENT_VAL=0;
110  4                    CALL DISP_FLAG (01H,0);
111  4                END;
112  3                ;                                  /* KEY FOR FUTURE USE */
113  3                ;                                  /* KEY FOR FUTURE USE */
114  4                DO;                                /* STOP KEY */
115  4                    START=0;
116  4                    ENTER=1;
                          /* EXECUTE STOP ROUTINES IF ANY */
117  4                END;
118  3                ENTER=1;                           /* ENTER KEY */
119  3            END;                                   /* END CASE */
120  2        ENABLE                                     /* ENABLE INTERRUPTS */


121  1    END KEYBOARD;

          /* DELAY ROUTINE */
122  2    DELAY: PROCEDURE (TIME_SEC);                   /* TIME_SEC IS DELAY IN SECS */
123  2        DECLARE (TIME_SEC,FIN_INDEX,I) WORD;
124  2        FIN_INDEX=TIME_SEC*10000/250;
125  3        DO I=1 TO FIN_INDEX;
126  3            CALL TIME (250);
127  3        END;
128  2        CALL TIME (TIME_SEC MOD 250);
129  1    END DELAY;


          /* SELECTION AND CONTROL ROUTINES */

130  2    SELECT: PROCEDURE;                             /* SELECT EXERCISE TYPE */
131  2        DECL SEL_FLAG BIT;
132  2        SEL_FLAG=0;
133  3        DO WHILE SEL_FLAG = 0;
134  3            CALL DISPLAY (.(' 1. ISOTONIC   '),.(' 2. VAR. FORCE '));
135  3            CALL GET_INPUT;
136  3            IF (ENT_VAL < 1) OR (ENT_VAL > 2) THEN
137  4                DO;
138  4                    CALL DISP_FLAG (01H,0);
139  4                    CALL DISPLAY (.(' INVALID CHOICE '),.(' ENTER  AGAIN  '));
140  4                    CALL DELAY (2);
141  4                END;
142  3            ELSE
```

```
204  2          END MORE;
205  1     END CALCULATE;

206  2     STROKE_LEN: PROCEDURE WORD;                          /* RETURNS BASE OF STROKE */
207  2         DECLARE (MAX_POSTN,MIN_POSTN,STROKE,TEMP) WORD;
208  2         START = 0;
209  2         CALL DISPLAY (.(' STROKE  LENGTH '),.(' MEASUREMENT '));
210  2         CALL DISPLAY (.(' EXERCISE FOR '),.(' TWO CYCLES '));
211  2         MAX_POSTN = 0;
212  2         MIN_POSTN = 550;
213  3         DO WHILE START = 0;                              /* WAIT FOR START KEY */
214  3         END;

215  3         DO WHILE START = 1;
216  3             CALL AD_CONVERT (2, 0, .AD_STRAIN);


217  3             IF AD_POSTN > MAX_POSTN THEN MAX_POSTN = AD_POSTN;
219  3             IF AD_POSTN < MIN_POSTN THEN MIN_POSTN = AD_POSTN;
221  3         END;

222  2         CALL DISPLAY (.('STROKE LENGTH '),.('OF THE USER IS '));
223  2         CALL DELAY (2);
               /* CALCULATE USER STROKE */
224  2         STROKE = (((MAX_POSTN - MIN_POSTN) * 10 * 314 * 96) / (511 * 5));

225  3         DO WHILE STROKE <> 0;                            /* DISPLAY USER STROKE */
226  3             TEMP = STROKE MOD 10;
227  3             STROKE = STROKE / 10;
228  3             CALL DISP_CHAR (TEMP+30);
229  3         END;

230  2         RETURN (.MAX_POSTN);                             /* BASE OF STROKE DATA */

231  1     END STROKE_LEN;

232  2     ISOTONIC: PROCEDURE;                                 /* ISOTONIC EXERCISE */
233  2         DECL FORCE WORD;
234  2         DECL STRAIN WORD;
235  2         CALL DISPLAY (.(' ISOTONIC FORCE '), .('ENTER FORCE(LBS)'));

236  2         KBD_FORCE:                                       /* DESIRED FORCE ENTRY */
               CALL GET_INPUT;
237  2         IF (ENT_VAL < 30 OR ENT_VAL > 150 ) THEN
238  3             DO;
239  3                 CALL DISP_FLAG (01H, 0);
240  3                 CALL DISPLAY (.('  OUT OF RANGE  '), .('  ENTER  AGAIN  '));
241  3                 GOTO KBD_FORCE;
242  3             END;
243  2         ELSE FORCE = ENT_VAL;

244  2         STRAIN = SEARCH (FORCE);                         /* THIS IS A TYPED PROCEDURE */
245  2         CL_VOLT = STR$CL$TAB(STRAIN);                    /* CORRESPONDING CLUTCH VOLT */
246  2         CALL DAC_CONVERT (9, 0);                         /* OUTPUT MOTOR VOLTAGE */
247  2         CALL DAC_CONVERT (CL_VOLT, 1);                   /* OUTPUT CLUTCH VOLTAGE */
248  2         D_MOTOR, D_CLUTCH, D_FAN = 1;                    /* START MOTOR, CLUTCH & FAN */

249  3         DO WHILE START = 0;                              /* WAIT FOR START KEY */
250  3         END;

251  3         DO WHILE START = 1;                              /* ISOTONIC CONTROL LOOP */
252  3             CALL AD_CONVERT (2, 0, .AD_STRAIN);          /* A/D STRAIN & POSITION */
253  3             CALL CALCULATE (AD_STRAIN, STRAIN);          /* UPDATE CLUTCH VOLTAGE */
254  3         END;
255  1     END ISOTONIC;

256  2     VAR_FORCE: PROCEDURE;                                /* VARIABLE FORCE EXERCISE */
257  2         DECL (LOW_FOR,HI_FOR,LOW_BACK,HI_BACK) WORD;/* RANGE OF FORCE */
258  2         DECL VAR$FOR$TAB (512) BYTE AUXILIARY;           /* TABLE FOR FORWARD STROKE */
259  2         DECL VAR$BACK$TAB (512) BYTE AUXILIARY;          /* TABLE FOR BACKWARD STROKE */
260  2         DECL (STRAIN,DIFF_BACK,DIFF_FOR) WORD;
261  2         DECL PO_BASE WORD;
262  2         DECL (PO_ARRAY BASED PO_BASE) (2) WORD;
```

```
263  2        DECL I BYTE;


               /* DISPLAY AND ENTRY OF VARIABLE FORCE DATA */

264  2         CALL DISPLAY (.(' VARIABLE FORCE '),.('  ENTER VALUES  '));
265  2         CALL DELAY (2);

266  2         UP_LO_ENT:
               CALL DISPLAY (.(' FORWARD STROKE '),.('LOWER LIMIT LBS'));
267  2         CALL GET_INPUT;
268  2         IF (ENT_VAL < 30 OR ENT_VAL > 100 ) THEN
269  3             DO;
270  3                 CALL DISP_FLAG (01H, 0);
271  3                 CALL DISPLAY (.('  OUT OF RANGE  '), .('  ENTER  AGAIN  '));
272  3                 GOTO UP_LO_ENT;
273  3             END;
274  2         ELSE LOW_FOR = ENT_VAL;

275  2         UP_HI_ENT:
               CALL DISPLAY (.(' FORWARD STROKE '),.('UPPER LIMIT LBS'));
276  2         CALL GET_INPUT;
277  2         IF (ENT_VAL < 30 OR ENT_VAL > 150 ) THEN
278  3             DO;
279  3                 CALL DISP_FLAG (01H, 0);
280  3                 CALL DISPLAY (.('  OUT OF RANGE  '), .('  ENTER  AGAIN  '));
281  3                 GOTO UP_HI_ENT;
282  3             END;
283  2         ELSE HI_FOR = ENT_VAL;

284  2         IF HI_FOR < LOW_FOR THEN
285  3             DO;
286  3                 CALL DISP_FLAG (01H, 0);
287  3                 CALL DISPLAY (.(' INVALID  DATA  '), .('  ENTER  AGAIN  '));
288  3                 GOTO UP_LO_ENT;
289  3             END;

290  2         DOWN_LO_ENT:
               CALL DISPLAY (.('BACKWARD STROKE '),.('LOWER LIMIT LBS'));
291  2         CALL GET_INPUT;
292  2         IF (ENT_VAL < 30 OR ENT_VAL > 100 ) THEN
293  3             DO;
294  3                 CALL DISP_FLAG (01H, 0);
295  3                 CALL DISPLAY (.('  OUT OF RANGE  '), .('  ENTER  AGAIN  '));
296  3                 GOTO DOWN_LO_ENT;
297  3             END;
298  2         ELSE LOW_BACK = ENT_VAL;

299  2         DOWN_HI_ENT:
               CALL DISPLAY (.('BACKWARD STROKE '),.('UPPER LIMIT LBS'));
300  2         CALL GET_INPUT;
301  2         IF (ENT_VAL < 30 OR ENT_VAL > 150 ) THEN
302  3             DO;
303  3                 CALL DISP_FLAG (01H, 0);
304  3                 CALL DISPLAY (.('  OUT OF RANGE  '), .('  ENTER  AGAIN  '));
305  3                 GOTO DOWN_HI_ENT;
306  3             END;
307  2         ELSE HI_BACK = ENT_VAL;



349  3                 STRAIN = VAR$FOR$TAB(AD_POSTN);
350  3             ELSE                                  /* MOVING DOWNWARDS */
                       STRAIN = VAR$BACK$TAB(AD_POSTN);

351  3                 CALL CALCULATE (AD_STRAIN, STRAIN); /* IMPLEMENTS PI CONTROL */
352  3         END;
353  1     END VAR_FORCE;

354  1     BEGIN CYCLE:                                  /* MAIN EXECUTION ROUTINE */
```

```
308  2        IF HI_BACK < LOW_BACK THEN
309  3           DO;
310  3              CALL DISP_FLAG (01H, 0);
311  3              CALL DISPLAY (.(' INVALID  DATA  '), .('  ENTER  AGAIN  '));
312  3              GOTO DOWN_LO_ENT;
313  3           END;

             /* STROKE MEASUREMENT */
314  2        PO_BASE = STROKE_LEN;

             /* CREATION OF VARIABLE FORCE TABLE FORWARD AND BACKWARD STROKES */
             /* LINEAR PROFILE IS ASSUMED CAN BE CHANGED AS PER REQUIREMENT */

315  2        VAR$FOR$TAB(0) = SEARCH (LOW_FOR);
316  2        VAR$FOR$TAB(511) = SEARCH (HI_FOR);
317  2        VAR$BACK$TAB(0) = SEARCH (LOW_BACK);
318  2        VAR$BACK$TAB(511) = SEARCH (HI_BACK);
319  2        DIFF_FOR = (VAR$FOR$TAB(511) - VAR$FOR$TAB(0))/(PO_ARRAY(0) - PO_ARRAY(1));
320  2        DIFF_BACK = (VAR$BACK$TAB(511)-VAR$BACK$TAB(0))/(PO_ARRAY(0)-PO_ARRAY(1));

321  3        DO I = 1 TO PO_ARRAY(1);
322  3           VAR$FOR$TAB(I) = VAR$FOR$TAB(0);
323  3           VAR$BACK$TAB(I) = VAR$BACK$TAB(0);
324  3        END;

325  3        DO I = (PO_ARRAY(1)+1) TO PO_ARRAY(0);
326  3           VAR$FOR$TAB(I) = VAR$FOR$TAB(I-1) + DIFF_FOR;
327  3           VAR$BACK$TAB(I) = VAR$BACK$TAB(I-1) + DIFF_BACK;
328  3        END;

329  3        DO I = (PO_ARRAY(0)+1) TO 510;
330  3           VAR$FOR$TAB(I) = VAR$FOR$TAB(511);
331  3           VAR$BACK$TAB(I) = VAR$BACK$TAB(511);
332  3        END;

             /* INITIALIZATION */

333  3        DO I = 0 TO 1;
334  3           PO_ARRAY(I) = 0;
335  3        END;

336  2        CALL AD_CONVERT (2, 0, .AD_STRAIN);          /* CHECK POSITION */
337  2        PO_ARRAY(I) = AD_POSTN;
338  2        CL_VOLT = VAR$FOR$TAB(AD_POSTN);             /* INITIAL CLUTCH VOLTAGE */
339  2        CALL DAC_CONVERT (9, 0);                     /* DAC - MOTOR */
340  2        CALL DAC_CONVERT (CL_VOLT, 1);               /* DAC - CLUTCH */
341  2        D_MOTOR, D_CLUTCH, D_FAN = 1;                /* DIGITAL STATRT */

342  3        DO WHILE START = 0;                          /* WAIT FOR START KEY */
343  3        END;

344  3        DO WHILE START = 1;                          /* EXERCISE LOOP */
345  3           CALL AD_CONVERT (2, 0, .AD_STRAIN);       /* CHECK FORCE AND POSITION */
346  3           PO_ARRAY(0) = PO_ARRAY(1);
347  3           PO_ARRAY(1) = AD_POSTN;
348  3           IF (PO_ARRAY(1) >= PO_ARRAY(0))
                 THEN                                     /* MOVING UPWARDS */
```

```
355  1     START_EXER:                                  /* CALL EXERCISE ROUTINE */
           DO WHILE 1;
356  2        CALL INIT_VAR;
357  2        CALL DISP_INIT;
358  2        CALL DISPLAY (.(' W E L C O M E  '),.('SELECT EXERCISE '));
359  2        CALL DELAY (2);
360  2        CALL SELECT;
361  3        DO CASE EXER_TYPE;
362  3           CALL ISOTONIC;
363  3           CALL VAR_FORCE;
364  3        END;
365  2     END;

366  1     END START_PROG;                              /* END MAIN MODULE */
```

SAFETY FEATURES

Another highly desirable feature in a exercise machine is the incorporation of safety features to prevent any harmful effect on the user and to provide a safer, more effective mode of exercising. The preferred embodiment of the present invention incorporates numerous safety features.

First, the range of motion varies from person to person depending on the user's arm length. This requires limiting the stroke length $1_s(s)$ of the exercise machine. This can be achieved by providing mechanical stops on the shaft 26. These stops cut the current supply to the magnetic particle clutch 16 whenever the range of motion exceeds the desired value.

Second, in the event of an accident which prevents the user from applying any force, the handle bars 34 can be locked. This is desired to avoid the "free falling" handle bars 34 from hitting the user. It can be achieved by a constant feedback of angular velocity. The current to the magnetic particle clutch or MPC 16 is cut off as soon as the acceleration exceeds that of gravity. This essentially locks the handle bars 34.

Third, the beginning of an exercising routine requires the user to select a desired protocol and also the maximum and the minimum values of a force. Due to a closed control loop, the user is prevented from working at any value outside the desired force curve.

Fourth, since human intervention is essential to switch from one protocol to another, the chances of accident are minimized.

Fifth, the wide variation in the protocol results is a highly personalized and flexible machine. This is desirable for clinical applications where a user's force profile may consist of sharp peaks and valleys. The use of a closed control loop system follows the desired trajectory with least error.

Sixth, the above discussed protocols involve a closed control loop system. This results in a check and balance safety mechanism. This is a highly desirable feature for it prevents errors from accumulating. The frequency of feedback decreases the error at each time step. In essence, the desired force and velocity profiles are obtained with high accuracy.

PERFORMANCE INDICATORS

Performance indicators of an exercise machine present general information about the exercise performed. A study of the state of the art reveals that they are really important for marketing success. The present invention has numerous performance indicators.

First, the calories spent by an individual during an exercise is a direct measure of the work done. This forms an essential feature of the fitness community. The outline control facilitates in obtaining the curve between forces applied and work done. The area of such a curve gives the work done.

Second, every exercise boils down to lifting and lowering weights. A good measure of a user's performance is the max weight or average weight lifted. A similar argument applies to the user's velocity profile. The requirement here is to interpret the data in a different manner. Hence, it can be easily obtained.

Third, in clinical therapy, pulse rate is an important measure of user's state of physical fitness. Its variations in a cycle help a doctor to draw important conclusions. Incorporated on-line control and an appropriate sensor can easily achieve this desired performance indicator.

Fourth, the "smart" exercise machine requires the user to select a desired protocol and also the working level. As the exercise proceeds, a continuous comparison between the set goals and the achieved goals can be realized.

Fifth, the microcontroller-based computer controller 38 facilitates in providing the desired data in numerical or graphical form. Such data is easy to interpret.

EXERCISE PATTERNS

The next step in the development of the "smart" exercise machine is to incorporate various exercise patterns. This adds flexibility to the machine and enables the user to exercise maximum number of muscles. The above discussion is valid for a shoulder press. Since almost all exercise patterns require a rotational motion, they can be accommodated by the use of adequate adapters.

Some of the exercise patterns which are in wide use are: 1. Knee extension/flexion; 2. Knee internal/external rotation; 3. Hip internal/external rotation; 4. Shoulder extension/flexion; 5. Shoulder internal/external rotation; 6. Wrist extension/flexion; and 7. Elbow extension/flexion.

All the above exercise patterns require a rotational motion. The minimum values of torque differ from exercise to exercise. This can be taken care of by the proposed on-line control. To achieve the desired motion, characteristic of an exercise adequate adapters will be designed.

The forms of the invention shown and described in this disclosure represent illustrative preferred embodiments thereof. It is understood that the invention is defined in the claimed subject matter which follows and that various modifications thereof which become obvious in light of reading the description are incorporated therein.

We claim:

1. A method of operating an apparatus for use with an exercise machine wherein said apparatus includes a reversible, variable speed, constant torque motor means fixedly mounted on a frame for providing a user of said exercise machine with independently variable force and speed so that said user of said exercise machine can perform a plurality of exercise protocols including combinations of isotonic and isokenetic exercises with either a constant or variable force controlled parameter and an active or passive resistance in an uni- or bi-lateral direction a magnetic particle clutch means mounted on said force creation means and gear drive reduction means fixedly mounted on said frame and mechnically coupled to said magnetic particle clutch by a drive shaft for varying said output speed, comprising the method steps of:

generating a plurality of signals from a plurality of sensing means within said apparatus;

conditioning said signals for processing;

processing said signals for operatively controlling a clutch driver means and a motor driver means for driving said magnetic particle clutch means and said motor means, respectively;

actuating a connecting means between a handle means of said exercise machine and said drive shaft of said motor means wherein said acutating of said connecting means is controlled by said clutch driver means and said motor driver means; and sensing temperature information from said magnetic particle clutch means and sending said information to said controller for processing and transfer of said processed information to said clutch driver means and said motor driver means for controlling said magnetic particle clutch means and said motor means, respectively.

2. The method as in claim 1 further comprising the step of sensing position information from said drive shaft mechanically coupled to said magnetic particle clutch means and sending said information to said controller for processing and transfer of said processed information to said clutch driver and means said motor driver means for controlling said magnetic particle clutch means and said motor means, respectively.

3. The method as in claim 2 further comprising the step of sensing force information from said connecting means which connects said drive shaft to said handle means of said exercise machine and sending said information to said controller for processing and transfer of said processed information to said clutch driver means and said motor driver means for controlling said magnetic particle clutch means and said motor means, respectively.

* * * * *